US012433459B2

(12) United States Patent
Park et al.

(10) Patent No.: US 12,433,459 B2
(45) Date of Patent: Oct. 7, 2025

(54) STATION FOR CLEANER

(71) Applicant: LG Electronics Inc., Seoul (KR)

(72) Inventors: Hyunwoo Park, Seoul (KR); Dongjae Lee, Seoul (KR); Yeonghan Jeong, Seoul (KR); Jinhyouk Shin, Seoul (KR); Sungjun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 371 days.

(21) Appl. No.: 18/029,818

(22) PCT Filed: Oct. 6, 2021

(86) PCT No.: PCT/KR2021/013650

§ 371 (c)(1),
(2) Date: Mar. 31, 2023

(87) PCT Pub. No.: WO2022/075718

PCT Pub. Date: Apr. 14, 2022

(65) Prior Publication Data

US 2023/0371766 A1 Nov. 23, 2023

(30) Foreign Application Priority Data

Oct. 8, 2020 (KR) ..... 10-2020-0130068
Oct. 21, 2020 (KR) ..... 10-2020-0136739

(51) Int. Cl.
*A47L 9/00* (2006.01)
*A47L 9/28* (2006.01)

(52) U.S. Cl.
CPC ..... *A47L 9/0009* (2013.01); *A47L 9/28* (2013.01); *A47L 9/2873* (2013.01)

(58) Field of Classification Search
CPC ..... A47L 9/2873; A47L 2201/024; A47L 9/0009; A47L 9/28
See application file for complete search history.

(56) References Cited

U.S. PATENT DOCUMENTS 9,492,048 B2 11/2016 Won et al.
10,786,129 B1 * 9/2020 Ebrahimi Afrouzi ..... A47L 9/2873
2020/0138255 A1 5/2020 Sato et al.

FOREIGN PATENT DOCUMENTS

CN 101049218 A 10/2007
EP 4137027 A1 2/2023
JP 2017-189453 10/2017
JP 2017-189453 A 10/2017
(Continued)

OTHER PUBLICATIONS

Extended European Search Report in European Appln. No. 21877969.2, mailed on Sep. 27, 2024, 5 pages.
(Continued)

*Primary Examiner* — Andrew A Horton
(74) *Attorney, Agent, or Firm* — Fish & Richardson P.C.

(57) ABSTRACT

A cleaner station includes: a housing; a dust collecting motor configured to generate a suction force for sucking dust in a dust bin of a cleaner; a dust collecting part disposed at an upper side in a gravitational direction of the dust collecting motor; a coupling part including a coupling surface to which the cleaner is coupled; and a fixing unit configured to fix the cleaner when the cleaner is coupled to the coupling part, thereby allowing a user to seal the cleaner without applying a separate force.

20 Claims, 26 Drawing Sheets

(56) References Cited

FOREIGN PATENT DOCUMENTS

| | | | |
|---|---|---|---|
| JP | 2018-500998 | | 1/2018 |
| JP | 2018-500998 | A | 1/2018 |
| KR | 10-2007-0012109 | | 1/2007 |
| KR | 10-2007-0012109 | A | 1/2007 |
| KR | 10-2020-0074055 | | 6/2020 |
| KR | 10-2020-0074055 | A | 6/2020 |

OTHER PUBLICATIONS

Office Action in Australian Appl. No. 2021357265, mailed on Feb. 14, 2025, 4 pages.

* cited by examiner

STATION FOR CLEANER

CROSS-REFERENCE TO RELATED APPLICATIONS

This application is a National Stage application under 35 U.S.C. § 371 of International Application No. PCT/KR2021/013650, filed on Oct. 6, 2021, which claims the benefit of Korean Application Nos. 10-2020-0136739, filed on Oct. 21, 2020, and 10-2020-0130068, filed on Oct. 8, 2020. The disclosures of the prior applications are incorporated by reference in their entirety.

TECHNICAL FIELD

The present disclosure relates to a cleaner station, and more particularly, to a cleaner station configured to draw dust, stored in a cleaner, into the cleaner station.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking foreign substances such as dust from the floor while autonomously traveling in the zone to be cleaned.

To this end, the robot cleaner includes a distance sensor configured to detect a distance from an obstacle such as furniture, office supplies, or walls installed in the zone to be cleaned, and left and right wheels for moving the robot cleaner.

In this case, the left wheel and the right wheel are configured to be rotated by a left wheel motor and a right wheel motor, respectively, and the robot cleaner cleans the room while autonomously changing its direction by operating the left wheel motor and the right wheel motor.

However, because the handy cleaner, the stick cleaner, or the robot cleaner in the related art has a dust bin with a small capacity for storing collected dust, which inconveniences the user because the user needs to empty the dust bin frequently.

In addition, because the dust scatters during the process of emptying the dust bin, there is a problem in that the scattering dust has a harmful effect on the user's health.

In addition, if residual dust is not removed from the dust bin, there is a problem in that a suction force of the cleaner deteriorates.

In addition, if the residual dust is not removed from the dust bin, there is a problem in that the residual dust causes an offensive odor.

Patent Document US 2020-0129025 A1 discloses a dust bin to be combined with a stick vacuum cleaner.

In the case of the combination of the dust bin and the vacuum cleaner in Patent Document US 2020-0129025 A1, a sealing member may correspond to a size of a dust outlet and be disposed to surround the dust outlet.

In Patent Document US 2020-0129025 A1, the sealing member is fixedly disposed on a dust inlet port to seal a portion between the dust bin and a cup body of the vacuum cleaner.

With this configuration, a gap between the dust bin and the vacuum cleaner may be sealed when a user inserts the dust bin into the vacuum cleaner.

However, the configuration disclosed in Patent Document US 2020-0129025 A1 is inconvenient for the user because the user needs to push the vacuum cleaner to the dust bin by applying a force to seal the gap between the dust bin and the vacuum cleaner.

In addition, Patent Document US 2020-0129025 A1 merely discloses the sealing member used to seal the gap between the vacuum cleaner and the dust bin, but the configuration thereof cannot prevent the separation between the vacuum cleaner and the dust bin or prevent the sway of the vacuum cleaner that may occur during the process of fixing the vacuum cleaner and removing the dust.

Meanwhile, Patent Document KR 2020-0074054 A discloses a vacuum cleaner and a docking station.

In the case of a cleaner station, a structure, which is docked to a dust collecting container, is disposed on an upper surface of the cleaner station. In this case, a method of separating a dust bin from the cleaner and then coupling only the dust bin may be used. However, there is inconvenience in that the user needs to directly separate the dust bin from the cleaner.

In addition, in the above-mentioned vacuum cleaner, an axis of an extension tube, an axis of a suction port, and an axis of the dust collecting container are disposed in parallel with one another. In this case, even though the cleaner mounted with the dust collecting container may be coupled to the station, a flow path through which dust and air may flow needs to be bent at least two times in order to introduce the air and the dust into the station. For this reason, there is a problem in that the structure of the flow path is complicated and efficiency in collecting the dust deteriorates.

In this case, in the vacuum cleaner, a dust collecting container has a discharge port through which air is discharged, and the docking station includes an opening/closing device configured to open or close the discharge port.

However, the opening/closing device serves to block the discharge port to prevent an inflow of outside air but does not serve to seal a portion between a dust bin and a station.

Therefore, there is a need to develop a structure of a station capable of minimizing a loss of flow path and coupling the vacuum cleaner to the station in the state in which the dust collecting container is mounted on the vacuum cleaner.

Further, there is a need to develop a structure capable of sealing a portion between the cleaner and the station and fixing the cleaner to the station because a fixing force required to be applied to the station is increased as the vacuum cleaner is mounted on the station in the state in which the dust collecting container is coupled to the vacuum cleaner.

DISCLOSURE

Technical Problem

The present disclosure has been made in an effort to solve the above-mentioned problems in the related art, and an object of the present disclosure is to provide a cleaner station capable of eliminating inconvenience caused because a user needs to empty a dust bin all the time.

Another object of the present disclosure is to provide a cleaner station capable of preventing dust from scattering when emptying a dust bin.

Still another object of the present disclosure is to provide a cleaner station capable of providing convenience for a user by enabling the user to remove dust in a dust bin without a separate manipulation.

Yet another object of the present disclosure is to provide a cleaner station, in which a cleaner may be mounted in a state in which an extension tube and a cleaning module are mounted.

Still yet another object of the present disclosure is to provide a cleaner station capable of minimizing an occupied space on a horizontal plane even in a state in which a cleaner is mounted.

A further object of the present disclosure is to provide a cleaner station capable of minimizing a loss of flow force for collecting dust.

Another further object of the present disclosure is to provide a cleaner station, in which dust in a dust bin is invisible from the outside in a state in which a cleaner is mounted.

Still another further object of the present disclosure is to provide a cleaner station capable of removing an offensive odor caused by residual dust by preventing the residual dust from remaining in a dust bin.

Yet another further object of the present disclosure is to provide a cleaner station capable of fixing a vacuum cleaner to the station in a state in which a dust collecting container is coupled to the vacuum cleaner.

Still yet another further object of the present disclosure is to provide a cleaner station capable of allowing a user to seal a cleaner without applying a force at the time of coupling the cleaner to a station.

A further object of the present disclosure is to provide a cleaner station capable of automatically sealing a cleaner while detecting a coupled state of the cleaner at the time of coupling the cleaner to a station.

Another further object of the present disclosure is to provide a cleaner station capable of stably fixing a dust bin by simultaneously pressing two opposite sides of the dust bin of the cleaner.

Still another further object of the present disclosure is to provide a cleaner station capable of blocking a space, through which a fixing member moves inward or outward, in a state in which a cleaner is not coupled, and preventing the fixing member from being exposed to the outside.

Technical Solution

To achieve the above-mentioned objects, the present disclosure provides a cleaner station including: a housing; a dust collecting motor accommodated in the housing and configured to generate a suction force for sucking dust in a dust bin of a cleaner; a dust collecting part accommodated in the housing and configured to capture the dust in the dust bin; a coupling part disposed in the housing and including a coupling surface to which the cleaner is coupled; and a fixing unit configured to fix the cleaner when the cleaner is coupled to the coupling part.

The fixing unit may include: a fixing part motor configured to provide power; and a fixing member configured to move toward the dust bin from the outside of the dust bin to fix the dust bin.

In this case, a rotational force applied from the fixing part motor may be converted into a rectilinear motion to move the fixing member.

The fixing unit may further include: a first power transmission member coupled to the fixing part motor and configured to rotate using power of the fixing part motor and rectilinearly move a second power transmission member; a second power transmission member configured to rectilinearly move in conjunction with the rotation of the first power transmission member; a fixing part casing coupled to the second power transmission member and configured to guide the rectilinear movement of the second power transmission member; a link arm rotatably coupled to the fixing member and configured to move the fixing member when the second power transmission member rectilinearly moves; and a connection pin configured to connect the second power transmission member and the link arm.

The first power transmission member may further include a cam main body to which a shaft of the fixing part motor is coupled.

The connection rod may protrude from the cam main body and be disposed to be eccentric from a rotation axis of the cam main body.

The first power transmission member may further include: a cam main body to which a shaft of the fixing part motor is coupled; a first cam protruding and extending from an outer peripheral surface of the cam main body by a predetermined angle in a circumferential direction; and a second cam protruding and extending radially outward from the outer peripheral surface of the cam main body and disposed to be spaced apart from the first cam at a predetermined interval based on a rotation axis of the cam main body.

The second power transmission member may further include a cam coupling portion to which a connection rod is inserted into and coupled so that the second power transmission member may move together with the first power transmission member; and a guide portion extending from the cam coupling portion and coupled to the fixing part casing.

The cam coupling portion may include: a coupling portion main body; and a connection rod coupling hole provided in the form of a long hole in the coupling portion main body, and the connection rod may be inserted into and coupled to the connection rod coupling hole.

The guide portion may include: a guide portion main body extending from two opposite ends of the cam coupling portion; a guide rod coupling hole provided in the form of a long hole in the guide portion main body and configured to allow a guide rod of the fixing part casing to be inserted into and coupled to the guide rod coupling hole; and a pin coupling hole formed in the guide portion main body and configured to allow one end of a connection pin connected to the link arm to be inserted into and coupled to the pin coupling hole.

The fixing part casing may include: a casing main body; a cam accommodation hole formed in the casing main body and configured to accommodate at least a part of the first power transmission member; and a guide rod protruding from the casing main body and inserted into and coupled to the second power transmission member.

The fixing part casing may include: a lower stopper protruding with a level difference from the casing main body and disposed at a lower side in a gravitational direction of the second power transmission member; an upper stopper protruding with a level difference from the casing main body and disposed at an upper side in the gravitational direction of the second power transmission member; a guide rib protruding from the casing main body and configured to connect the lower stopper and the upper stopper; and a guide rail formed on the lower stopper and configured to accommodate the connection pin.

The link arm may include: an arm main body; a first coupling hole formed at one end of the arm main body and coupled to the connection pin; and a second coupling hole formed at the other end of the arm main body and coupled to the fixing member.

The fixing member may include: a hinge portion formed at one end of the sealing frame and rotatably coupled to the housing; an arm coupling portion protruding from the sealing frame and configured to allow the link arm to be rotatably coupled to the arm coupling portion; a first pressing portion disposed on a sidewall of the coupling part, configured to reciprocatingly move toward the dust bin, and formed to correspond to a shape of the dust bin; a second pressing portion connected to the first pressing portion and formed to correspond to a shape of a battery housing of the cleaner; and a movable sealer configured to seal the dust bin and disposed on a surface of the first pressing portion directed toward the dust bin.

The cleaner station according to the present disclosure may further include a charging part configured to supply power to the cleaner; and a control unit configured to control the coupling part, the charging part, and the fixing unit.

The coupling part may further include a coupling sensor configured to detect whether the cleaner is coupled to the coupling part.

The control unit may operate the fixing part motor when the cleaner is coupled to the coupling part.

The control unit may operate the fixing part motor when power is applied to a battery of the cleaner through the charging part.

The fixing unit may include a first power transmission member coupled to the fixing part motor and configured to rotate using power of the fixing part motor; a second power transmission member configured to engage with the first power transmission member and convert a rotational force of the fixing part motor into a rectilinear movement; a third power transmission member configured to engage with the first power transmission member, convert a rotational force of the fixing part motor into a rectilinear movement, and guide the rectilinear movement of the second power transmission member; and a fixing part link linked to the second power transmission member and the fixing member.

The coupling part may further include: sidewalls disposed at two opposite sides of the coupling surface and perpendicularly connected to the coupling surface; and a fixing member entrance hole formed along the sidewalls so that the fixing member enters and exits the fixing member entrance hole.

The fixing unit may include a fixing part casing coupled to the sidewalls, and the fixing member may be rotatably coupled to the fixing part casing.

The fixing part casing may further include a shutter configured to open or close the fixing member entrance hole.

The fixing unit may include a shutter link linked to the third power transmission member and the shutter.

The second power transmission member may include a gear frame having first gear teeth configured to engage with the first power transmission member; and a second power transmission member pin protruding from the gear frame and rotatably coupled to the fixing part link.

The second power transmission member may further include a guide rib extending from the gear frame and slidably coupled to the third power transmission member.

The second power transmission member may further include a spring accommodation groove disposed in the gear frame and formed in a major axis direction of the gear frame so as to accommodate a spring therein.

The third power transmission member may include: a guide rail configured to accommodate the second power transmission member and guide sliding of the second power transmission member; and second gear teeth protruding from the guide rail and configured to engage with the first power transmission member.

The third power transmission member may include: a shutter operating wall bent and extending from the guide rail; and a shutter operating pin protruding from the shutter operating wall and coupled to the shutter link.

The fixing unit may further include a support frame coupled to the third power transmission member and configured to guide the rectilinear movement of the second power transmission member.

The fixing part casing may further include: a casing main body in which the third power transmission member is rectilinearly movably accommodated; and a shutter hole formed in the casing main body and configured to communicate with the fixing member entrance hole and allow the fixing member to reciprocatingly move through the shutter hole.

The fixing part casing may further include a casing cover coupled to the casing main body and having a guide hole for guiding a rectilinear movement of the third power transmission member.

The fixing part casing may include a hinge groove formed in the casing main body and hingedly coupled to the fixing member.

The fixing member may include: a sealing frame configured to move toward the dust bin from the outside of the dust bin; a hinge portion formed at one end of the sealing frame and rotatably coupled to the fixing part casing; a link coupling portion coupled to the sealing frame and configured to allow the fixing part link to be rotatably coupled thereto; and a first pressing portion disposed on a surface of the sealing frame directed toward the dust bin and formed to correspond to a shape of the dust bin.

The fixing member may include a second pressing portion connected to the first pressing portion and formed to correspond to a shape of a battery housing of the cleaner.

The fixing member may include a movable sealer configured to seal the dust bin and disposed on a surface of the first pressing portion directed toward the dust bin.

Advantageous Effect

According to the cleaner station according to the present disclosure, it is possible to eliminate the inconvenience caused because the user needs to empty the dust bin all the time. In addition, since the dust in the dust bin is sucked into the station when emptying the dust bin, it is possible to prevent the dust from scattering.

In addition, it is possible to open the dust passing hole by detecting coupling of the cleaner without the user's separate manipulation and remove the dust in the dust bin in accordance with the operation of the dust collecting motor, and as a result, it is possible to provide convenience for the user.

In addition, a stick cleaner and a robot cleaner may be coupled to the cleaner station at the same time, and as necessary, the dust in the dust bin of the stick cleaner and the dust in the dust bin of the robot cleaner may be selectively removed.

In addition, when the cleaner station detects the coupling of the dust bin, the lever is pulled to compress the dust bin, such that the residual dust does not remain in the dust bin, and as a result, it is possible to increase the suction force of the cleaner.

Further, it is possible to remove an offensive odor caused by the residual dust by preventing the residual dust from remaining in the dust bin.

In addition, the cleaner may be mounted on the cleaner station in the state in which the extension tube and the cleaning module are mounted.

In addition, it is possible to minimize an occupied space on a horizontal plane even in the state in which the cleaner is mounted on the cleaner station.

In addition, because the flow path, which communicates with the dust bin, is bent downward only once, it is possible to minimize a loss of flow force for collecting the dust.

In addition, the dust in the dust bin is invisible from the outside in the state in which the cleaner is mounted on the cleaner station.

In addition, it is possible to fix the dust bin by pressing the outer surface of the dust bin in the state in which the cleaner and the dust bin are coupled.

In addition, the cleaner station automatically detects the coupled state of the cleaner and fixes the dust bin of the cleaner at the time of coupling the cleaner to the station, which makes it possible to seal the cleaner without applying a separate force.

In addition, the cleaner station automatically detects the coupled state of the cleaner and seals the cleaner at the time of coupling the cleaner to the station, which makes it possible to improve the efficiency in preventing the dust from scattering.

In addition, it is possible to stably fix the dust bin by simultaneously pressing the two opposite sides of the dust bin of the cleaner.

In addition, it is possible to make the internal structure invisible from the outside by allowing the shutter to block the fixing member and the space, through which the fixing member moves inward or outward, in the state in which the cleaner is not coupled.

MODE FOR INVENTION

Figure 1:
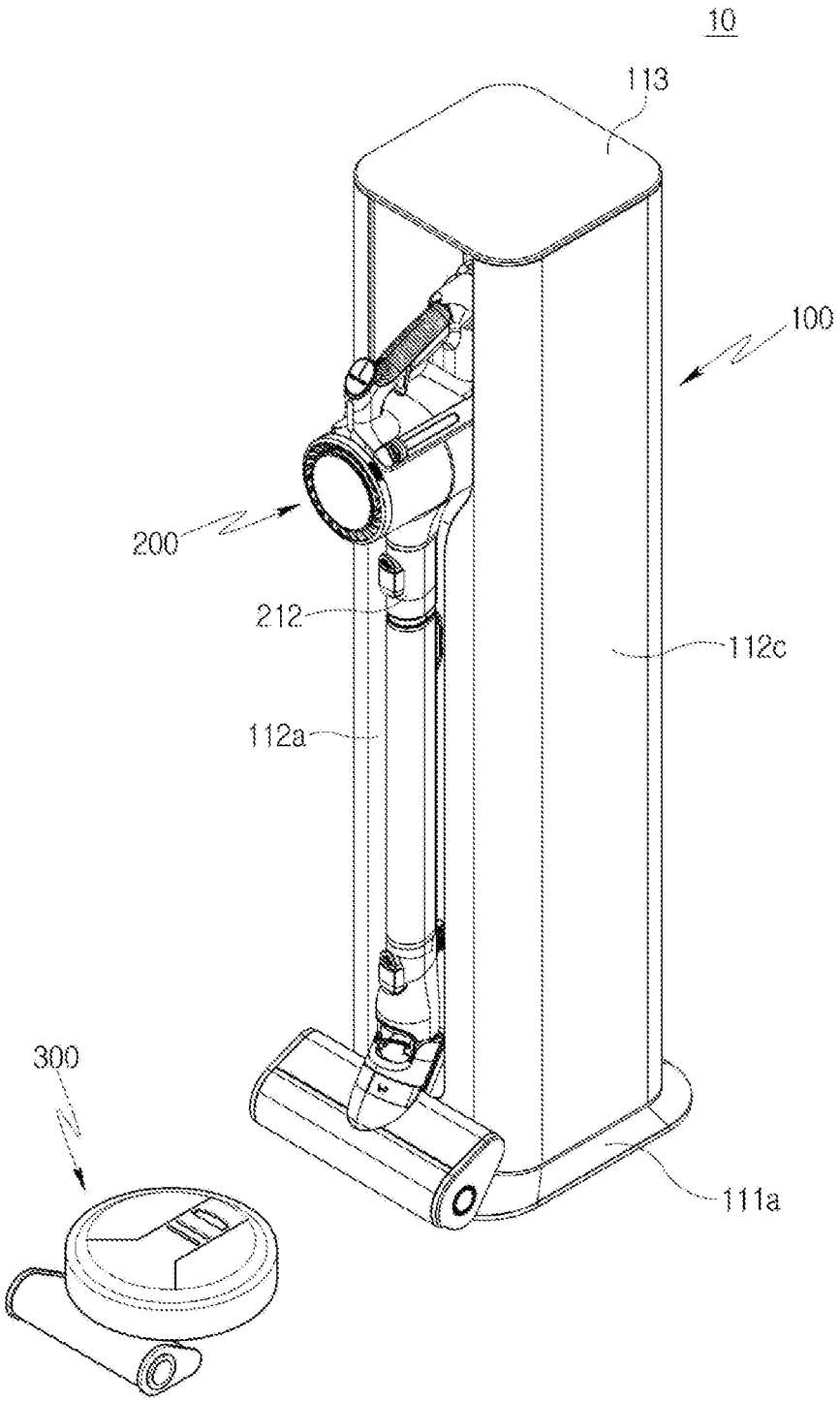
FIG. 1 is a perspective view illustrating a dust removing system including a cleaner station, a first cleaner, and a second cleaner according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terminology used herein is used for the purpose of describing particular embodiments only and is not intended to limit the present disclosure. Singular expressions may include plural expressions unless clearly described as different meanings in the context.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Figure 2:
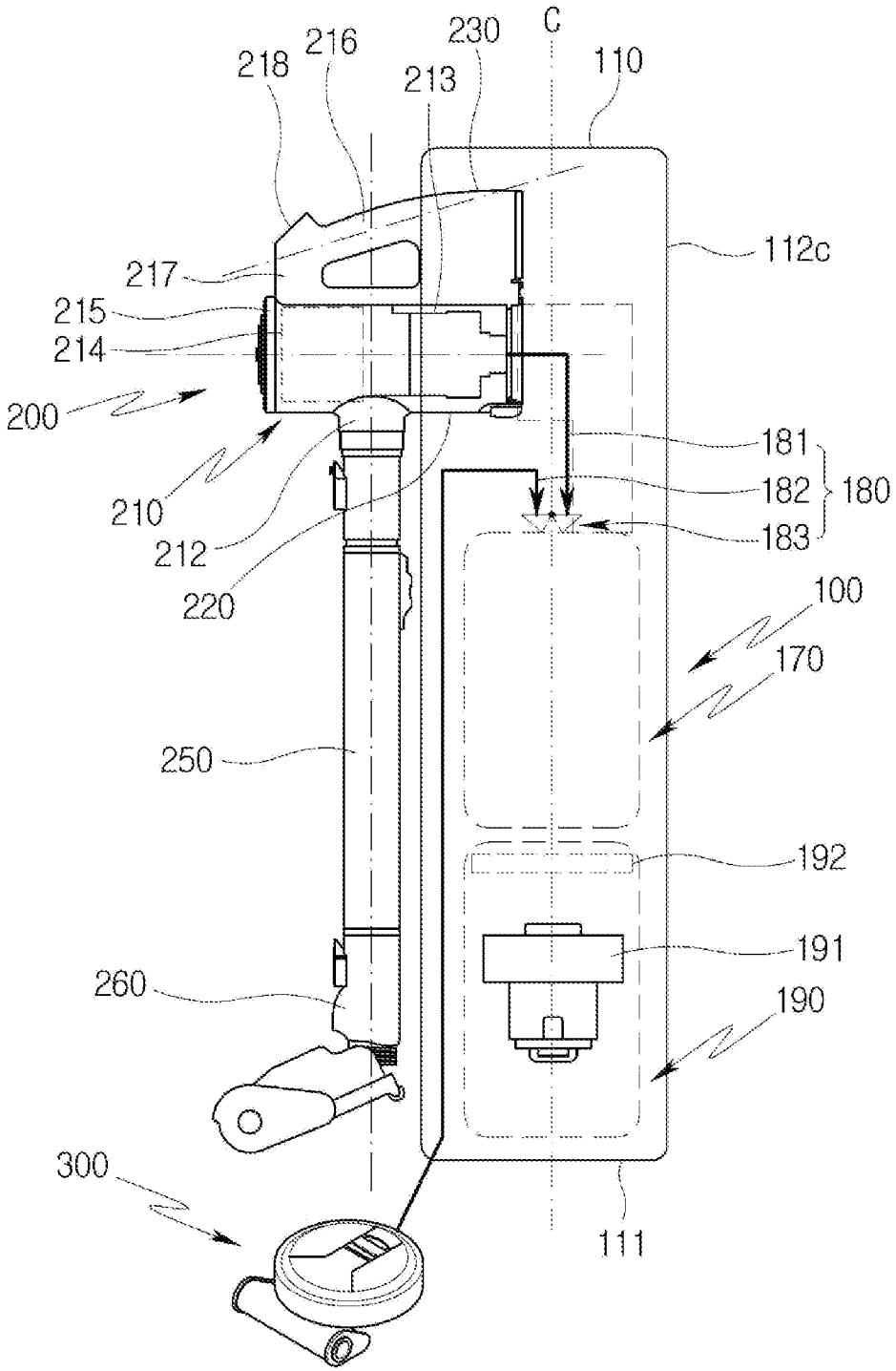
FIG. 2 is a schematic view illustrating a configuration of the dust removing system according to the embodiment of the present disclosure.

FIG. 1 is a perspective view illustrating a dust removing system that includes a cleaner station, a first cleaner, and a second cleaner according to an embodiment of the present disclosure, and FIG. 2 is a schematic view illustrating a configuration of the dust removing system according to the embodiment of the present disclosure.

Referring to FIGS. 1 and 2, a dust removing system 10 according to an embodiment of the present specification may include a cleaner station 100 and cleaners 200 and 300. In this case, the cleaners 200 and 300 may include a first cleaner 200 and a second cleaner 300. Meanwhile, the present embodiment may be carried out without some of the above-mentioned components and does not exclude additional components.

The first cleaner 200 and the second cleaner 300 may be disposed on the cleaner station 100. The first cleaner 200 may be coupled to a lateral surface of the cleaner station 100. Specifically, a main body of the first cleaner 200 may be coupled to the lateral surface of the cleaner station 100. The second cleaner 200 may be coupled to the lower portion of the cleaner station 100. The cleaner station 100 may remove dust from a dust bin 220 of the first cleaner 200. The cleaner station 100 may remove dust from a dust bin (not illustrated) of the second cleaner 300.

Figure 3:
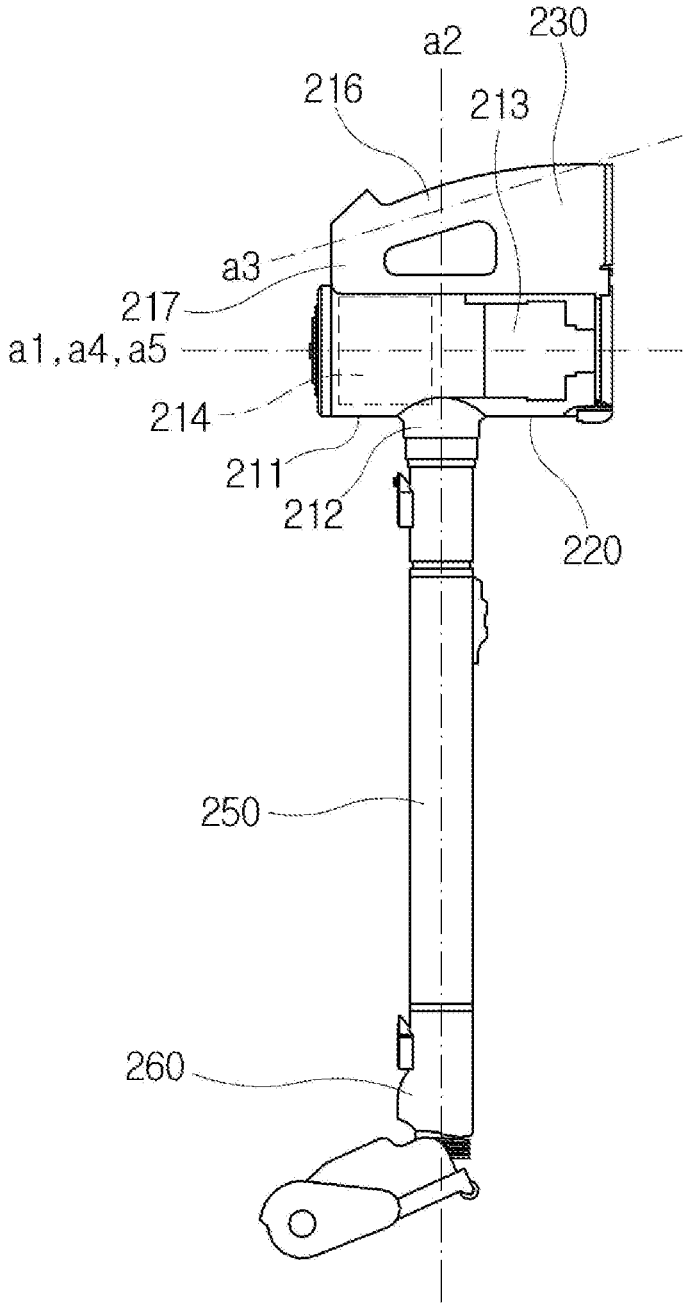
FIG. 3 is a view for explaining the first cleaner of the dust removing system according to the embodiment of the present disclosure.
Figure 4:
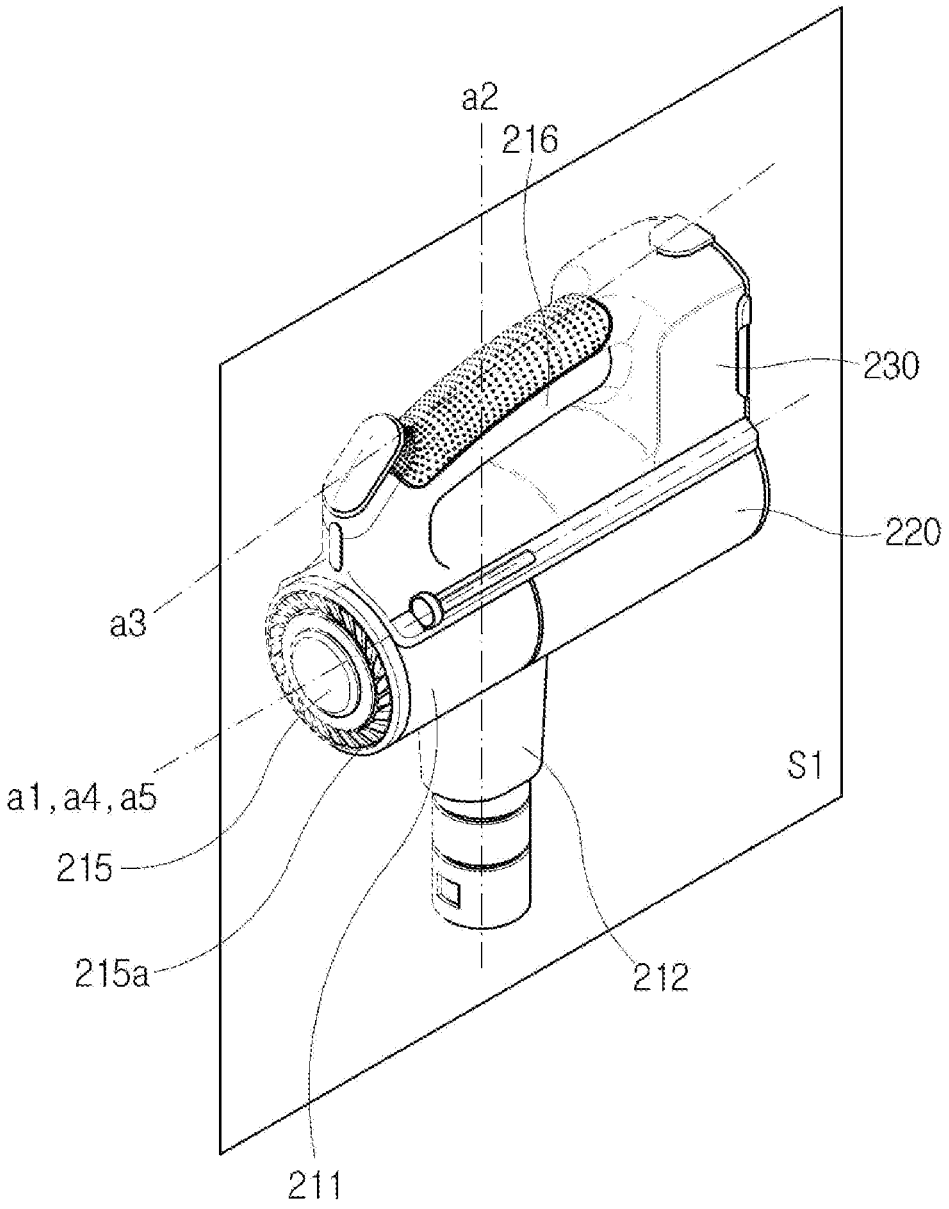
FIG. 4 is a view for explaining a center of gravity of the first cleaner according to the embodiment of the present disclosure.

Meanwhile, FIG. 3 is a view for explaining the first cleaner of the dust removing system according to the embodiment of the present disclosure, and FIG. 4 is a view for explaining a center of gravity of the first cleaner according to the embodiment of the present disclosure.

First, in order to assist in understanding the cleaner station 100 according to the present disclosure, a structure of the first cleaner 200 will be described below with reference to FIGS. 1 to 4.

The first cleaner 200 may mean a cleaner configured to be manually operated by a user. For example, the first cleaner 200 may mean a handy cleaner or a stick cleaner.

The first cleaner 200 may be mounted on the cleaner station 100. The first cleaner 200 may be supported by the cleaner station 100. The first cleaner 200 may be coupled to the cleaner station 100.

The first cleaner 200 may include a main body 210. The main body 210 may include a main body housing 211, a suction part 212, a dust separating part 213, a suction motor 214, an air discharge cover 215, a handle 216, an extension part 217, and an operating part 218.

The main body housing 211 may define an external appearance of the first cleaner 200. The main body housing 211 may provide a space that may accommodate therein the suction motor 214 and a filter (not illustrated). The main body housing 211 may be formed in a shape similar to a cylindrical shape.

The suction part 212 may protrude outward from the main body housing 211. For example, the suction part 212 may be formed in a cylindrical shape with an opened inside. The suction part 212 may communicate with an extension tube 280. The suction part 212 may be referred to as a flow path (hereinafter, referred to as a 'suction flow path') through which air containing dust may flow.

Meanwhile, in the present embodiment, an imaginary centerline may be defined to penetrate a center of the cylindrical suction part 212. That is, an imaginary suction flow path centerline a2 may be formed to pass through the center of the suction flow path.

The dust separating part 213 may communicate with the suction part 212. The dust separating part 213 may separate dust introduced into the dust separating part 213 through the suction part 212. The dust separating part 213 may communicate with the dust bin 220.

For example, the dust separating part 213 may be a cyclone part capable of separating dust using a cyclone flow. Further, the dust separating part 213 may communicate with the suction part 212. Therefore, the air and the dust, which are introduced through the suction part 212, spirally flow along an inner circumferential surface of the dust separating part 213. Therefore, the cyclone flow may be generated about a central axis of the dust separating part 213.

Meanwhile, in the present embodiment, the center axis of the cyclone part may be an imaginary cyclone center axis a4 extending in a vertical direction.

The suction motor 214 may generate a suction force for sucking air. The suction motor 214 may be accommodated in the main body housing 211. The suction motor 214 may generate the suction force by means of a rotation. For example, the suction motor 214 may be formed in a shape similar to a cylindrical shape.

Meanwhile, in the present embodiment, an imaginary motor axis a1 may be formed by extending a center axis of the suction motor 214.

The air discharge cover 215 may be disposed at one side in an axial direction of the main body housing 211. The air discharge cover 215 may accommodate a filter for filtering air. For example, an HEPA filter may be accommodated in the air discharge cover 215.

The air discharge cover 215 may have an air discharge port 215*a* for discharging the air introduced by the suction force of the suction motor 214.

A flow guide may be disposed on the air discharge cover 215. The flow guide may guide a flow of the air to be discharged through the air discharge port 215*a*.

The handle 216 may be grasped by the user. The handle 216 may be disposed at a rear side of the suction motor 214. For example, the handle 216 may be formed in a shape similar to a cylindrical shape. Alternatively, the handle 216 may be formed in a curved cylindrical shape. The handle 216 may be disposed at a predetermined angle with respect to the main body housing 211, the suction motor 214, or the dust separating part 213.

Meanwhile, in the present embodiment, an imaginary handle axis a3 may be formed by extending a center axis of the handle 216.

A shaft of the suction motor 214 may be disposed between the suction part 212 and the handle 216.

That is, the motor axis a1 may be disposed between the suction part 212 and the handle 216.

Further, the handle axis a3 may be disposed at a predetermined angle with respect to the motor axis a1 or the suction flow path centerline a2. Therefore, there may be an intersection point at which the handle axis a3 intersects the motor axis a1 or the suction flow path centerline a2.

Meanwhile, the motor axis a1, the suction flow path centerline a2, and the handle axis a3 may be disposed on the same plane S1.

With this configuration, the centers of gravity of the entire first cleaner 200 according to the present disclosure may be disposed symmetrically with respect to the plane S1.

Meanwhile, in the embodiment of the present disclosure, a forward direction may mean a direction in which the suction part 212 is disposed based on the suction motor 214, and a rear direction may mean a direction in which the handle 216 is disposed.

An upper surface of the handle 216 may define an external appearance of a part of an upper surface of the first cleaner 200. Therefore, it is possible to prevent a component of the first cleaner 200 from coming into contact with the user's arm when the user grasps the handle 216.

The extension part 217 may extend from the handle 216 toward the main body housing 211. At least a part of the extension part 217 may extend in a horizontal direction.

The operating part 218 may be disposed on the handle 216. The operating part 218 may be disposed on an inclined surface formed in an upper region of the handle 216. The user may input an instruction to operate or stop the first cleaner 200 through the operating part 218.

The first cleaner 200 may include the dust bin 220. The dust bin 220 may communicate with the dust separating part 213. The dust bin 220 may store the dust separated by the dust separating part 213.

The dust bin 220 may include a dust bin main body 221, a discharge cover 222, a dust bin compression lever 223, and a compression member 224.

The dust bin main body 221 may provide a space capable of storing the dust separated from the dust separating part 213. For example, the dust bin main body 221 may be formed in a shape similar to a cylindrical shape.

Meanwhile, in the present embodiment, an imaginary dust bin axis a5 may be formed by extending a center axis of the dust bin main body 221. For example, the dust bin axis a5 may be disposed coaxially with the motor axis a1. Therefore, the dust bin axis a5 may also be disposed on the plane S1 including the motor axis a1, the suction flow path centerline a2, and the handle axis a3.

A part of a lower side of the dust bin main body 221 may be opened. In addition, a lower extension portion 221*a* may be formed at the lower side of the dust bin main body 221. The lower extension portion 221*a* may be formed to block a part of the lower side of the dust bin main body 221.

The dust bin 220 may include the discharge cover 222. The discharge cover 222 may be disposed at a lower side of the dust bin 220. The discharge cover 222 may selectively open or close the lower side of the dust bin 220 which is opened downward.

The discharge cover 222 may include a cover main body 222*a*, a hinge part 222*b*, and a coupling lever 222*c*. The cover main body 222*a* may be formed to block a part of the lower side of the dust bin main body 221. The cover main body 222*a* may be rotated downward about the hinge part 222*b*. The hinge part 222*b* may be disposed adjacent to the battery housing 230. For example, the hinge part 222*b* may include a torsion spring 222*d*. Therefore, when the discharge cover 222 is separated from the dust bin main body 221, an elastic force of the torsion spring 222*d* may support the cover main body 222*a* in a state in which the cover main body 222*a* is rotated by a predetermined angle or more about the hinge part 222*b* with respect to the dust bin main body 221.

The discharge cover 222 may be coupled to the dust bin 220 by a hook engagement. Meanwhile, the discharge cover 222 may be separated from the dust bin 220 by means of the coupling lever 222*c*. The coupling lever 222*c* may be disposed at a front side of the dust bin. Specifically, the coupling lever 241 may be disposed on an outer surface at the front side of the dust bin 220. When external force is applied to the coupling lever 222*c*, the coupling lever 222*c* may elastically deform a hook extending from the cover main body 222*a* in order to release the hook engagement between the cover main body 222*a* and the dust bin main body 221.

When the discharge cover 222 is closed, the lower side of the dust bin 220 may be blocked (sealed) by the discharge cover 222 and the lower extension portion 221*a*.

The dust bin 220 may include the dust bin compression lever 223. The dust bin compression lever 223 may be disposed outside the dust bin 220 or the dust separating part 211. The dust bin compression lever 223 may be disposed outside the dust bin 220 or the dust separating part 211 so as to be movable upward and downward. The dust bin compression lever 223 may be connected to the compression member (not illustrated). When the dust bin compression lever 223 is moved downward by external force, the compression member (not illustrated) may also be moved downward. Therefore, it is possible to provide convenience for the user. The compression member (not illustrated) and the dust bin compression lever 223 may return back to original positions by an elastic member (not illustrated). Specifically, when the external force applied to the dust bin compression lever 223 is eliminated, the elastic member may move the dust bin compression lever 223 and the compression member (not illustrated) upward.

The compression member (not illustrated) may be disposed in the dust bin main body 221. The compression member may move in the internal space of the dust bin main body 221. Specifically, the compression member may move upward and downward in the dust bin main body 221. Therefore, the compression member may compress the dust in the dust bin main body 221. In addition, when the discharge cover 222 is separated from the dust bin main body 221 and thus the lower side of the dust bin 220 is opened, the compression member may move from an upper side of the dust bin 220 to the lower side of the of the dust bin 220, thereby removing foreign substances such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220.

The first cleaner 200 may include the battery housing 230. A battery 240 may be accommodated in the battery housing 230. The battery housing 230 may be disposed at a lower side of the handle 216. For example, the battery housing 230 may have a hexahedral shape opened at a lower side thereof. A rear surface of the battery housing 230 may be connected to the handle 216.

The battery housing 230 may include an accommodation portion opened at a lower side thereof. The battery 230 may be attached or detached through the accommodation portion of the battery housing 220.

The first cleaner 200 may include the battery 240.

For example, the battery 240 may be separably coupled to the first cleaner 200. The battery 240 may be separably coupled to the battery housing 230. For example, the battery 240 may be inserted into the battery housing 230 from the lower side of the battery housing 230.

Otherwise, the battery 240 may be integrally provided in the battery housing 230. In this case, a lower surface of the battery 240 is not exposed to the outside.

The battery 240 may supply power to the suction motor 214 of the first cleaner 200.

The battery 240 may be disposed on a lower portion of the handle 216. The battery 240 may be disposed at a rear side of the dust bin 220. That is, the suction motor 214 and the battery 240 may be disposed so as not to overlap each other in the upward/downward direction and disposed at different disposition heights. On the basis of the handle 216, the suction motor 214, which is heavy in weight, is disposed at a front side of the handle 216, and the battery 240, which is heavy in weight, is disposed at the lower side of the handle 216, such that an overall weight of the first cleaner 200 may be uniformly distributed. Therefore, it is possible to prevent stress from being applied to the user's wrist when the user grasps the handle 216 and performs a cleaning operation.

In a case in which the battery 240 is coupled to the battery housing 230 in accordance with the embodiment, the lower surface of the battery 240 may be exposed to the outside. Because the battery 240 may be placed on the floor when the first cleaner 200 is placed on the floor, the battery 240 may be immediately separated from the battery housing 230. In addition, because the lower surface of the battery 240 is exposed to the outside and thus in direct contact with air outside the battery 240, performance of cooling the battery 240 may be improved.

Meanwhile, in a case in which the battery 240 is fixed integrally to the battery housing 230, the number of structures for attaching or detaching the battery 240 and the battery housing 230 may be reduced, and as a result, it is possible to reduce an overall size of the first cleaner 200 and a weight of the first cleaner 200.

The first cleaner 200 may include the extension tube 250. The extension tube 300 may communicate with the cleaning module 260. The extension tube 250 may communicate with the main body 210. The extension tube 250 may communicate with the suction part 214 of the main body 210. The extension tube 250 may be formed in a long cylindrical shape.

The main body 210 may be connected to the extension tube 250. The main body 210 may be connected to the cleaning module 260 through the extension tube 250. The main body 210 may generate the suction force by means of the suction motor 214 and provide the suction force to the cleaning module 260 through the extension tube 250. The outside dust may be introduced into the main body 210 through the cleaning module 260 and the extension tube 250.

The first cleaner 200 may include the cleaning module 260. The cleaning module 260 may communicate with the extension tube 260. Therefore, the outside air may be introduced into the main body 210 of the first cleaner 200 via the cleaning module 260 and the extension tube 250 by the suction force in the main body 210 of the first cleaner 200.

The first cleaner 200 may be coupled to a lateral surface of a housing 110. Specifically, the main body 210 of the first cleaner 200 may be mounted on a coupling part 120. More specifically, the dust bin 220 and the battery housing 230 of the first cleaner 200 may be coupled to a coupling surface 121, an outer circumferential surface of the dust bin main body 221 may be coupled to a dust bin guide surface 122, and the suction part 212 may be coupled to a suction part guide surface 126 of the coupling part 120. In this case, a central axis of the dust bin 220 may be disposed in a direction parallel to the ground surface, and the extension tube 250 may be disposed in a direction perpendicular to the ground surface (see FIG. 2).

The dust in the dust bin 220 of the first cleaner 200 may be captured by a dust collecting part 170 of the cleaner station 100 by gravity and a suction force of a dust collecting motor 191. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

Meanwhile, in the present embodiment, an imaginary plane S1 may be defined and include at least two of the motor axis a1, the suction flow path centerline a2, the handle axis a3, the cyclone center axis a4, and the dust bin axis a5.

An overall weight of the first cleaner 200 may be set on the basis of the center of the imaginary plane S1.

The dust removing system 10 according to the embodiment of the present disclosure may include the second cleaner 300. The second cleaner 300 may mean a robot cleaner. The second cleaner 300 may automatically clean a zone to be cleaned by sucking foreign substances such as dust from the floor while autonomously traveling in the zone to be cleaned. The second cleaner 300, that is, the robot cleaner may include a distance sensor configured to detect a distance from an obstacle such as furniture, office supplies, or walls installed in the zone to be cleaned, and left and right wheels for moving the robot cleaner. The second cleaner 300 may be coupled to the cleaner station. The dust in the second cleaner 300 may be captured into the dust collecting part 170 through a second flow path 182.

As another example, the second cleaner 300 may automatically clean the floor by removing the foreign substances on the floor using a wet mop while autonomously traveling in the zone to be cleaned. The second cleaner 300, that is, the robot cleaner may include a distance sensor configured to detect a distance from an obstacle such as furniture, office supplies, or walls installed in the zone to be cleaned, and a pair of mops for moving the robot cleaner. The second cleaner 300 may be coupled to the cleaner station. In this case, the pair of mops of the second cleaner 300 may be dried by air discharged from the cleaner station.

Figure 5:
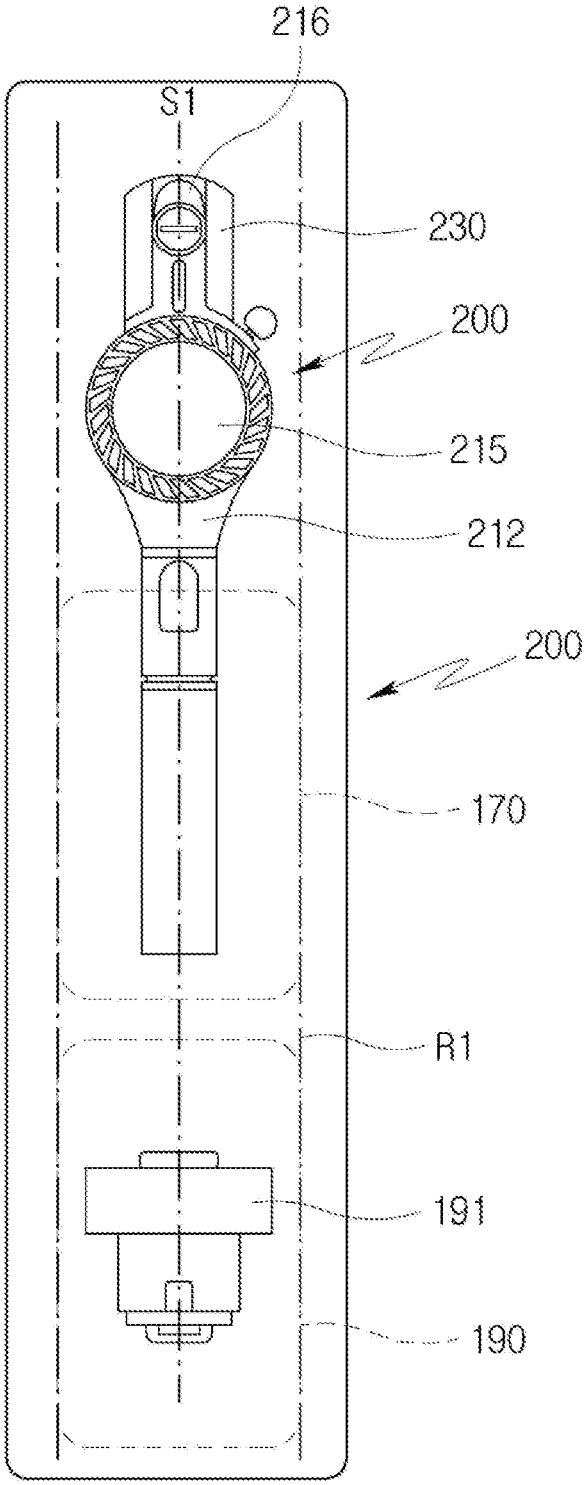
FIG. 5 is a view for explaining an arrangement relationship between the cleaner station and the center of gravity of the first cleaner according to the embodiment of the present disclosure.
Figure 6:
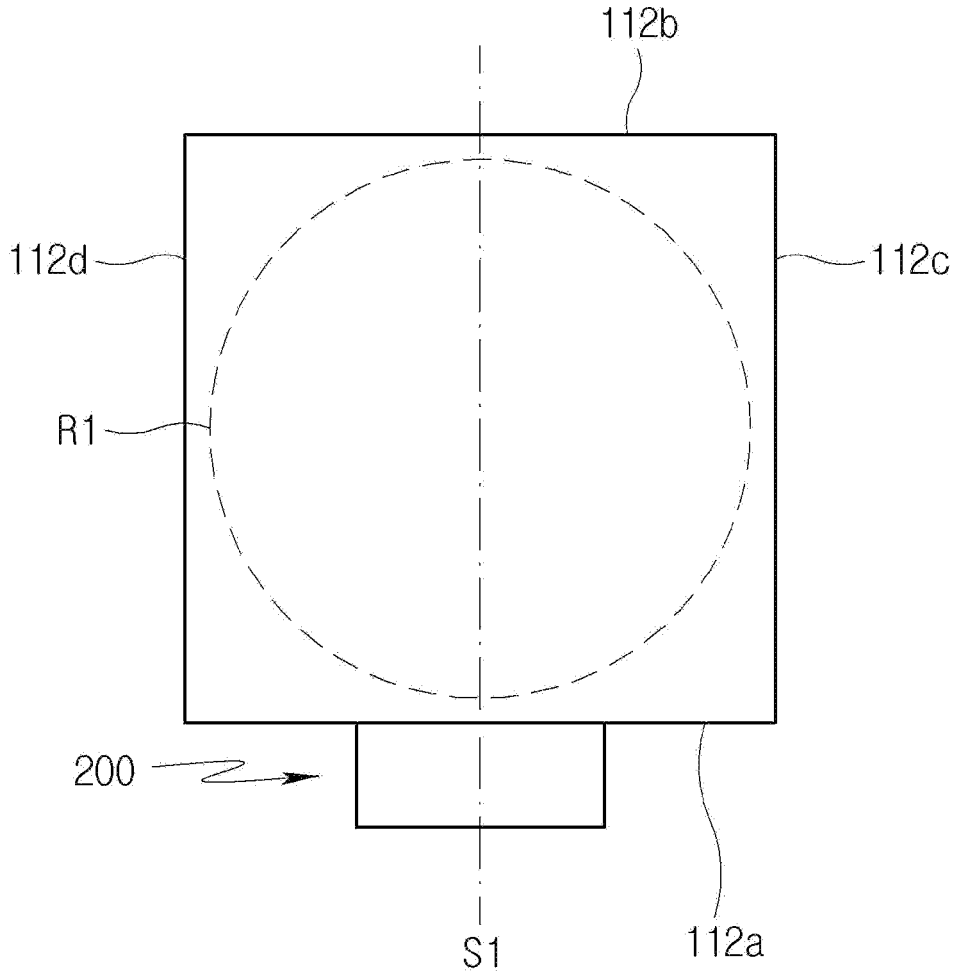
FIG. 6 is a schematic view when viewing FIG. 5 in another direction.

Meanwhile, FIG. 5 is a view for explaining an arrangement relationship between the cleaner station and the center of gravity of the first cleaner according to the embodiment of the present disclosure, and FIG. 6 is a view illustrating a schematic view when viewing FIG. 5 in another direction.

The cleaner station 100 according to the present disclosure will be described below with reference to FIGS. 1, 2, 5, and 6.

The first cleaner 200 and the second cleaner 300 may be disposed on the cleaner station 100. The first cleaner 200 may be coupled to a lateral surface of the cleaner station 100. Specifically, a main body of the first cleaner 200 may be coupled to the lateral surface of the cleaner station 100. The second cleaner 200 may be coupled to the lower portion of the cleaner station 100. The cleaner station 100 may remove dust from a dust bin 220 of the first cleaner 200. The cleaner station 100 may remove dust from a dust bin (not illustrated) of the second cleaner 300.

The cleaner station 100 may include the housing 110. The housing 110 may define an external appearance of the cleaner station 100. Specifically, the housing 110 may be formed in the form of a column including one or more outer wall surfaces. For example, the housing 110 may be formed in a shape similar to a quadrangular column.

The housing 110 may have a space capable of accommodating the dust collecting part 170 configured to store dust therein, and a dust suction module 190 configured to generate a flow force for collecting the dust from the dust collecting part 170.

The housing 110 may include a bottom surface 111, an outer wall surface 112, and an upper surface 113.

The bottom surface 111 may support a lower side in a gravitational direction of the dust suction module 190. That is, the bottom surface 111 may support a lower side of the dust collecting motor 191 of the dust suction module 190.

In this case, the bottom surface 111 may be disposed toward the ground surface. The bottom surface 111 may also be disposed in parallel with the ground surface or disposed to be inclined at a predetermined angle with respect to the ground surface. The above-mentioned configuration may be advantageous in stably supporting the dust collecting motor 191 and maintaining balance of an overall weight even in a case in which the first cleaner 200 is coupled.

Meanwhile, according to the embodiment, the bottom surface 111 may further include ground surface support portions 111*a* in order to prevent the cleaner station 100 from falling down and increase an area being in contact with the ground surface to maintain the balance. For example, the ground surface support portion may have a plate shape extending from the bottom surface 111, and one or more frames may protrude and extend from the bottom surface 111 in a direction of the ground surface. In this case, the ground surface support portions may be disposed to be linearly symmetrical in order to maintain the left and right balance and the front and rear balance on the basis of a front surface on which the first cleaner 200 is mounted.

The outer wall surface 112 may mean a surface formed in the gravitational direction or a surface connected to the bottom surface 111. For example, the outer wall surface 112 may mean a surface connected to the bottom surface 111 so as to be perpendicular to the bottom surface 111. As another embodiment, the outer wall surface 112 may be disposed to be inclined at a predetermined angle with respect to the bottom surface 111.

The outer wall surface 112 may include at least one surface. For example, the outer wall surface 112 may include a first outer wall surface 112*a*, a second outer wall surface 112*b*, a third outer wall surface 112*c*, and a fourth outer wall surface 112*d*.

In this case, in the present embodiment, the first outer wall surface 112*a* may be disposed at the front side of the cleaner station 100. In this case, the front side may mean a side at which the first cleaner 200 or the second cleaner 300 is coupled. Therefore, the first outer wall surface 112*a* may define an external appearance of the front surface of the cleaner station 100.

Meanwhile, the directions are defined as follows to understand the present embodiment. In the present embodiment, the directions may be defined in the state in which the first cleaner 200 is mounted on the cleaner station 100.

In this case, a surface including an extension line 212*a* of the suction part 212 may be referred to as the front surface (see FIG. 1). That is, in the state in which the first cleaner 200 is mounted on the cleaner station 100, a part of the suction part 212 may be in contact with and seated on the suction part guide surface 126, and the remaining part of the suction part 212, which is not seated on the suction part guide surface 126, may be disposed to be exposed to the outside from the first outer wall surface 112*a*. Therefore, the imaginary extension line 212*a* of the suction part 212 may be disposed on the first outer wall surface 112*a*, and the surface including the extension line 212*a* of the suction part 212 may be referred to as the front surface.

Further, in the state in which the first cleaner 200 is mounted on the cleaner station 100, a direction in which the first cleaner 200 is exposed to the outside of the cleaner station 100 may be referred to as a forward direction.

In addition, in another point of view, in the state in which the first cleaner 200 is mounted on the cleaner station 100, a direction in which the suction motor 214 of the first cleaner 200 is disposed may be referred to as the forward direction. Further, a direction opposite to the direction in which the suction motor 214 is disposed on the cleaner station 100 may be referred to as a rearward direction.

Further, on the basis of the internal space of the housing 110, a surface facing the front surface may be referred to as a rear surface of the cleaner station 100. That is, a direction, which is opposite to the forward direction based on the dust collecting motor 191, may be referred to as the rearward direction. Therefore, the rear surface may mean a direction in which the second outer wall surface 112*b* is formed.

Further, on the basis of the internal space of the housing 110, a left surface when viewing the front surface may be referred to as a left surface, and a right surface when viewing the front surface may be referred to as a right surface. Therefore, the left surface may mean a direction in which the third outer wall surface 112*c* is formed, and the right surface may mean a direction in which the fourth outer wall surface 112*d* is formed.

The first outer wall surface 112*a* may be formed in the form of a flat surface, or the first outer wall surface 112*a* may be formed in the form of a curved surface as a whole or formed to partially include a curved surface.

The first outer wall surface 112*a* may have an external appearance corresponding to the shape of the first cleaner 200. In detail, the coupling part 120 may be disposed on the first outer wall surface 112*a*. With this configuration, the first cleaner 200 may be coupled to the cleaner station 100 and supported by the cleaner station 100. The specific configuration of the coupling part 120 will be described below.

In addition, the structure to which the second cleaner 300 may be coupled may be additionally provided on the outer wall surface 112. Therefore, the structure corresponding to the shape of the second cleaner 300 may be additionally provided on the first outer wall surface 112*a*.

Further, a cleaner bottom plate (not illustrated) to which the lower surface of the second cleaner 300 may be coupled may be additionally coupled to the outer wall surface 112. Meanwhile, as another embodiment, the cleaner bottom plate (not illustrated) may be shaped to be connected to the bottom surface 111.

In the present embodiment, the second outer wall surface 112*b* may be a surface facing the first outer wall surface 112*a*. That is, the second outer wall surface 112*b* may be disposed on the rear surface of the cleaner station 100. In this case, the rear surface may be a surface facing the surface to which the first cleaner 200 or the second cleaner 300 is coupled. Therefore, the second outer wall surface 112*b* may define an external appearance of the rear surface of the cleaner station 100.

For example, the second outer wall surface 112*b* may be formed in the form of a flat surface. With this configuration, the cleaner station 100 may be in close contact with a wall in a room, and the cleaner station 100 may be stably supported.

Meanwhile, at least a part of the second outer wall surface 112*b* may be separated by the user. For example, a handle may be disposed on the second outer wall surface 11*b*. When the user pulls the handle, the second outer wall surface 11*b* may be separated so that an internal space thereof is exposed. In this case, a structure for mounting various types of cleaning modules 260 used for the first cleaner 200 may be disposed in the internal space.

In addition, the structure to which the second cleaner 300 may be coupled may be additionally provided on the second outer wall surface 112*b*. Therefore, the structure corresponding to the shape of the second cleaner 300 may be additionally provided on the second outer wall surface 112*b*.

In the present embodiment, the third outer wall surface 112*c* and the fourth outer wall surface 112*d* may mean surfaces that connect the first outer wall surface 112*a* and the second outer wall surface 112*b*. In this case, the third outer wall surface 112*c* may be disposed on the left surface of the station 100, and the fourth outer wall surface 112*d* may be disposed on the right surface of the cleaner station 100. Otherwise, the third outer wall surface 112*c* may be disposed on the right surface of the cleaner station 100, and the fourth outer wall surface 112*d* may be disposed on the left surface of the cleaner station 100.

The third outer wall surface 112*c* or the fourth outer wall surface 112*d* may be formed in the form of a flat surface, or the third outer wall surface 112*c* or the fourth outer wall surface 112*d* may be formed in the form of a curved surface as a whole or formed to partially include a curved surface.

Meanwhile, the third outer wall surface 112*c* and/or the fourth outer wall surface 112*d* may be integrated with the second outer wall surface 112*b* and separated while rotating together. For example, a structure capable of mounting various types of cleaning modules 260 used for the first cleaner 200 may be disposed in the internal space of the cleaner station 100 which is exposed as the third outer wall surface 112*c* and/or the fourth outer wall surface 112*d* is separated.

In addition, the structure to which the second cleaner 300 may be coupled may be additionally provided on the third outer wall surface 112*c* or the fourth outer wall surface 112*d*. Therefore, the structure corresponding to the shape of the second cleaner 300 may be additionally provided on the third outer wall surface 112*c* or the fourth outer wall surface 112*d*. Further, a cleaner bottom plate (not illustrated) to which the lower surface of the second cleaner 300 may be coupled may be additionally provided on the third outer wall surface 112*c* or the fourth outer wall surface 112*d*. Meanwhile, as another embodiment, the cleaner bottom plate (not illustrated) may be shaped to be connected to the bottom surface 111.

The upper surface 113 may define an upper external appearance of the cleaner station. That is, the upper surface 113 may mean a surface disposed at an outermost side of the cleaner station in the gravitational direction and exposed to the outside.

For reference, in the present embodiment, the terms 'upper side' and 'lower side' may mean the upper and lower sides in the gravitational direction (a direction perpendicular to the ground surface) in the state in which the cleaner station 100 is installed on the ground surface.

In this case, the upper surface 113 may also be disposed in parallel with the ground surface or disposed to be inclined at a predetermined angle with respect to the ground surface.

A display unit 500 may be disposed on the upper surface 113. For example, the display unit 500 may display a state of the cleaner station 100, a state of the first cleaner 200, and a state of the second cleaner 300. The display unit 500 may further display information such as a cleaning process situation, a map of the cleaning zone, and the like.

Meanwhile, according to the embodiment, the upper surface 113 may be separable from the outer wall surface 112. In this case, when the upper surface 113 is separated, the battery separated from the cleaner 200 or 300 may be accommodated in the internal space surrounded by the outer wall surface 112, and a terminal (not illustrated) capable of charging the separated battery.

Figure 7:
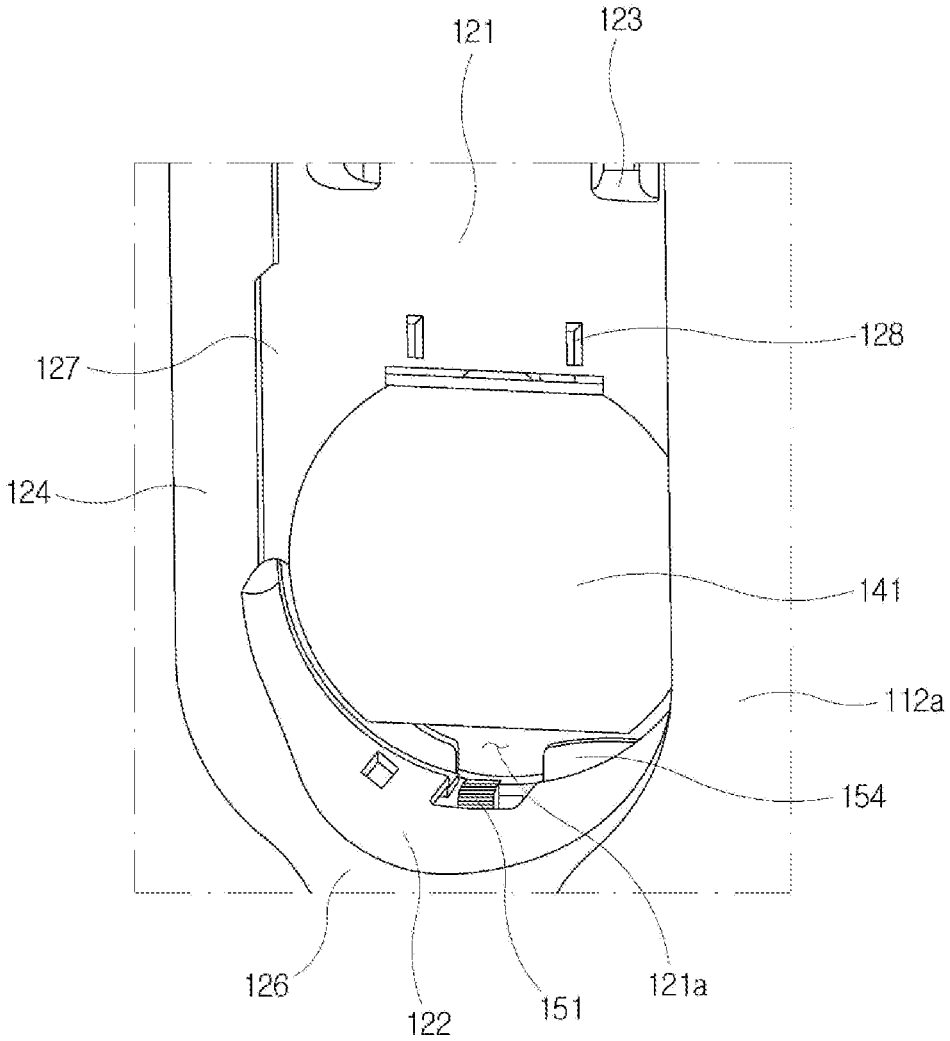
FIG. 7 is a view for explaining a coupling part of the cleaner station according to the embodiment of the present disclosure.

FIG. 7 is a view for explaining the coupling part of the cleaner station according to the embodiment of the present disclosure.

The coupling part 120 of the cleaner station 100 according to the present disclosure will be described below with reference to FIGS. 2 and 7.

The cleaner station 100 may include the coupling part 120 to which the first cleaner 200 is coupled. Specifically, the coupling part 120 may be disposed in the first outer wall surface 112*a*, and the main body 210, the dust bin 220, and the battery housing 230 of the first cleaner 200 may be coupled to the coupling part 120.

The coupling part 120 may include the coupling surface 121. The coupling surface 121 may be disposed on the lateral surface of the housing 110. For example, the coupling surface 121 may mean a surface formed in the form of a groove which is concave toward the inside of the cleaner station 100 from the first outer wall surface 112*a*. That is, the coupling surface 121 may mean a surface formed to have a stepped portion with respect to the first outer wall surface 112*a*.

The first cleaner 200 may be coupled to the coupling surface 121. For example, the coupling surface 121 may be in contact with the lower surface of the dust bin 220 and the lower surface of the battery housing 230 of the first cleaner 200. In this case, the lower surface may mean a surface directed toward the ground surface when the user uses the first cleaner 200 or places the first cleaner 200 on the ground surface.

In this case, the coupling between the coupling surface 121 and the dust bin 220 of the first cleaner 200 may mean physical coupling by which the first cleaner 200 and the cleaner station 100 are coupled and fixed to each other. This may be a premise of coupling of a flow path through which the dust bin 220 and a flow path part 180 communicate with each other and a fluid may flow.

Further, the coupling between the coupling surface 121 and the battery housing 230 of the first cleaner 200 may mean physical coupling by which the first cleaner 200 and the cleaner station 100 are coupled and fixed to each other. This may be a premise of electrical coupling by which the battery 240 and a charging part 128 are electrically connected to each other.

For example, an angle of the coupling surface 121 with respect to the ground surface may be a right angle. Therefore, it is possible to minimize a space of the cleaner station 100 when the first cleaner 200 is coupled to the coupling surface 121.

As another example, the coupling surface 121 may be disposed to be inclined at a predetermined angle with respect to the ground surface. Therefore, the cleaner station 100 may be stably supported when the first cleaner 200 is coupled to the coupling surface 121.

The coupling surface 121 may have a dust passage hole 121*a* through which air outside the housing 110 may be introduced into the housing 110. The dust passage hole 121*a* may be formed in the form of a hole corresponding to the shape of the dust bin 220 so that the dust in the dust bin 220 may be introduced into the dust collecting part 170. Specifically, the dust passage hole 121*a* may correspond to a shape of the discharge cover 222 so that the discharge cover 222 may pass through the dust passage hole 121*a* when the discharge cover 222 of the dust bin 220 is opened. The dust passage hole 121*a* may be formed to communicate with a first flow path 181 to be described below.

The coupling part 120 may include the dust bin guide surface 122. The dust bin guide surface 122 may be disposed on the first outer wall surface 112*a*. The dust bin guide surface 122 may be connected to the first outer wall surface 112*a*. In addition, the dust bin guide surface 122 may be connected to the coupling surface 121.

The dust bin guide surface 122 may be formed in a shape corresponding to the outer surface of the dust bin 220. A front outer surface of the dust bin 220 may be coupled to the dust bin guide surface 122. Therefore, it is possible to provide convenience when coupling the first cleaner 200 to the coupling surface 121.

In addition, the dust bin guide surface 122 may support the dust bin 220 when the first cleaner 200 is coupled to the cleaner station 100.

The coupling part 120 may include guide protrusions 123. The guide protrusions 123 may be disposed on the coupling surface 121. The guide protrusions 123 may protrude from the coupling surface 121. Two guide protrusions 123 may be disposed to be spaced apart from each other. A distance between the two guide protrusions 123, which are spaced apart from each other, may correspond to a width of the battery housing 230 of the first cleaner 200. Therefore, it is possible to provide convenience when coupling the first cleaner 200 to the coupling surface 121.

The coupling part 120 may include sidewalls 124. The sidewalls 124 may mean wall surfaces disposed at two opposite sides of the coupling surface 121 and may be perpendicularly connected to the coupling surface 121. The sidewalls 124 may be connected to the first outer wall surface 112*a*. In addition, the sidewalls 124 may be connected to the dust bin guide surface 122. That is, the sidewalls 124 may define surfaces connected to the dust bin guide surface 122. Therefore, it is possible to prevent the first cleaner 200 from swaying in a leftward/rightward direction. The cleaner station 100 may stably accommodate the first cleaner 200.

The coupling part 120 may include a coupling sensor 125. The coupling sensor 125 may detect whether the first cleaner 200 is coupled to the coupling part 120.

The coupling sensor 125 may include a contact sensor. For example, the coupling sensor 125 may include a microswitch. In this case, the coupling sensor 125 may be disposed on the guide protrusion 123. Therefore, when the battery housing 230 or the battery 240 of the first cleaner 200 is coupled between the pair of guide protrusions 123, the coupling sensor 125 may detect that the first cleaner 200 is physically coupled to the cleaner station 100.

Meanwhile, the coupling sensor 125 may include a non-contact sensor. For example, the coupling sensor 125 may include an infrared ray (IR) sensor. In this case, the coupling sensor 125 may be disposed on the sidewall 124 and face the battery housing 230 or the dust bin 220 of the first cleaner 200. The coupling sensor 125 may detect the presence of the dust bin 220 or the main body 210 and detect that the first cleaner 200 is physically coupled to the cleaner station 100.

The coupling sensor 125 may be a mean for determining whether the first cleaner 200 is coupled and power is applied to the battery 240 of the first cleaner 200.

The coupling part 120 may include the suction part guide surface 126. The suction part guide surface 126 may be disposed on the first outer wall surface 112*a*. The suction part guide surface 126 may be connected to the dust bin guide surface 122. The suction part guide surface 126 may be formed in a shape corresponding to the shape of the suction part 212. Therefore, the suction part 212 may be coupled to the suction part guide surface 126.

The coupling part 120 may include fixing member entrance holes 127. The fixing member entrance hole 127 may be formed in the form of a long hole along the sidewall 124 so that fixing members 131 may enter and exit the fixing member entrance hole 127. For example, the fixing member entrance hole 127 may be a rectangular hole formed along the sidewall 124. The fixing members 131 will be described below in detail.

With this configuration, when the user couples the first cleaner 200 to the coupling part 120, the battery housing 230 and the dust bin 220 of the first cleaner 200 may be conveniently and stably coupled and supported.

Figure 8:
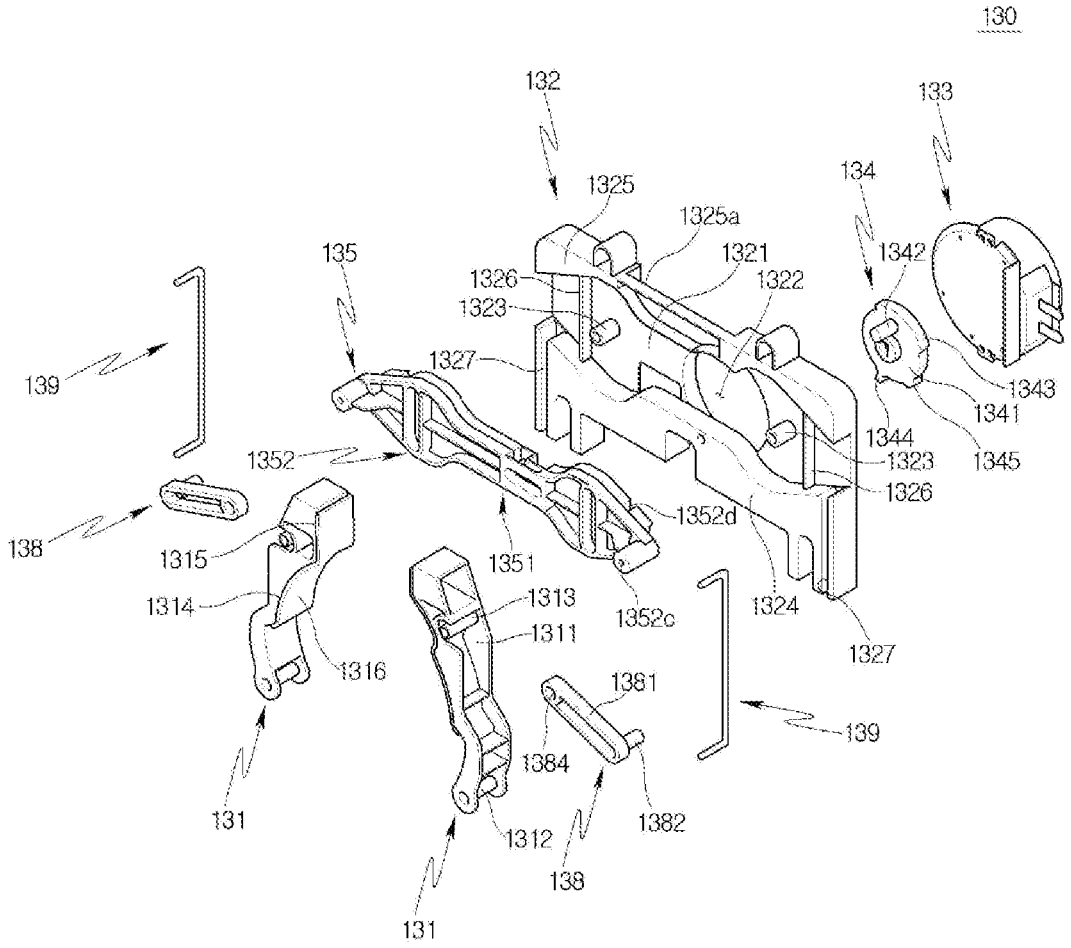
FIG. 8 is an exploded perspective view for explaining the fixing unit of the cleaner station according to the embodiment of the present disclosure.
Figure 9:
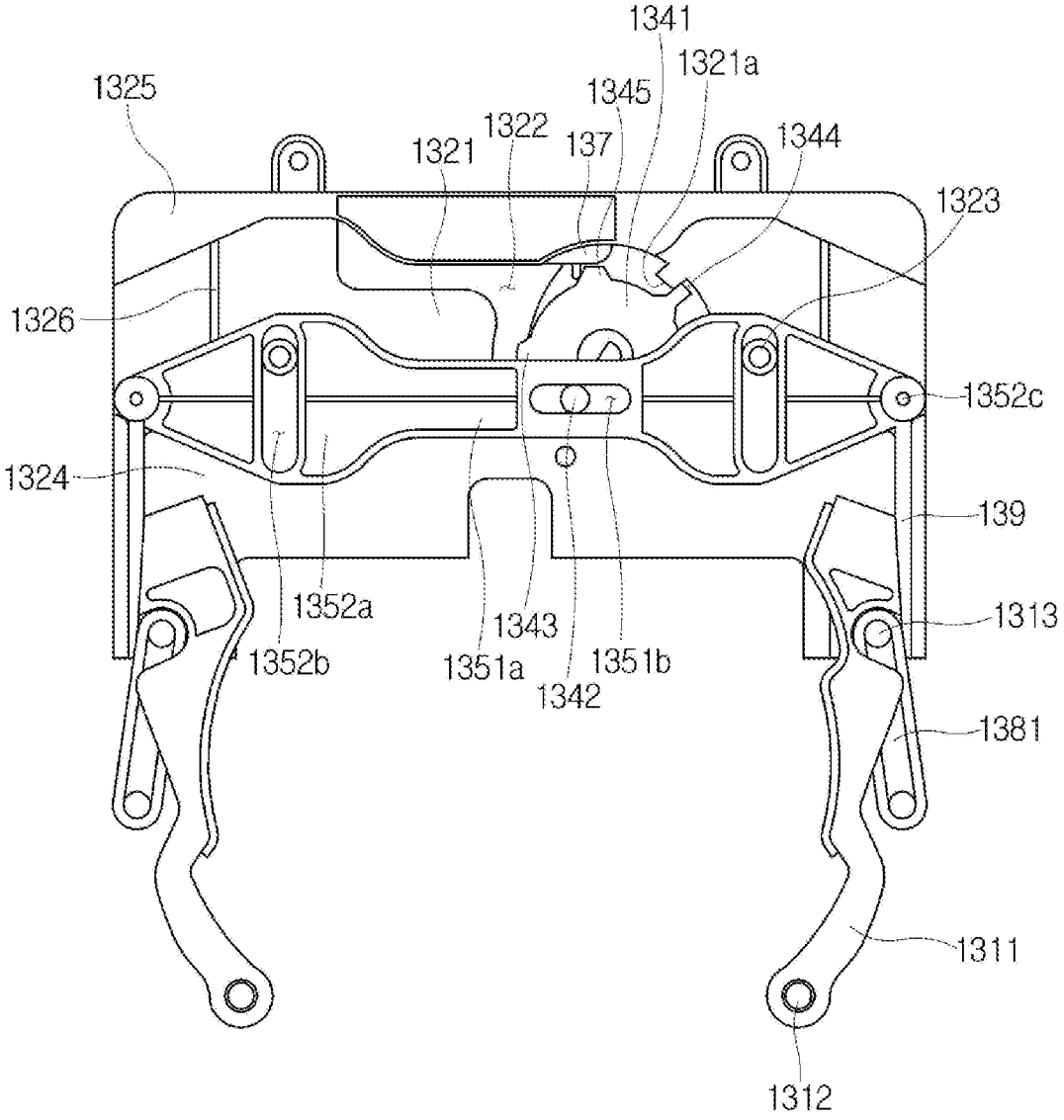
FIG. 9 is a view for explaining a state before the fixing unit according to the embodiment of the present disclosure operates.
Figure 10:
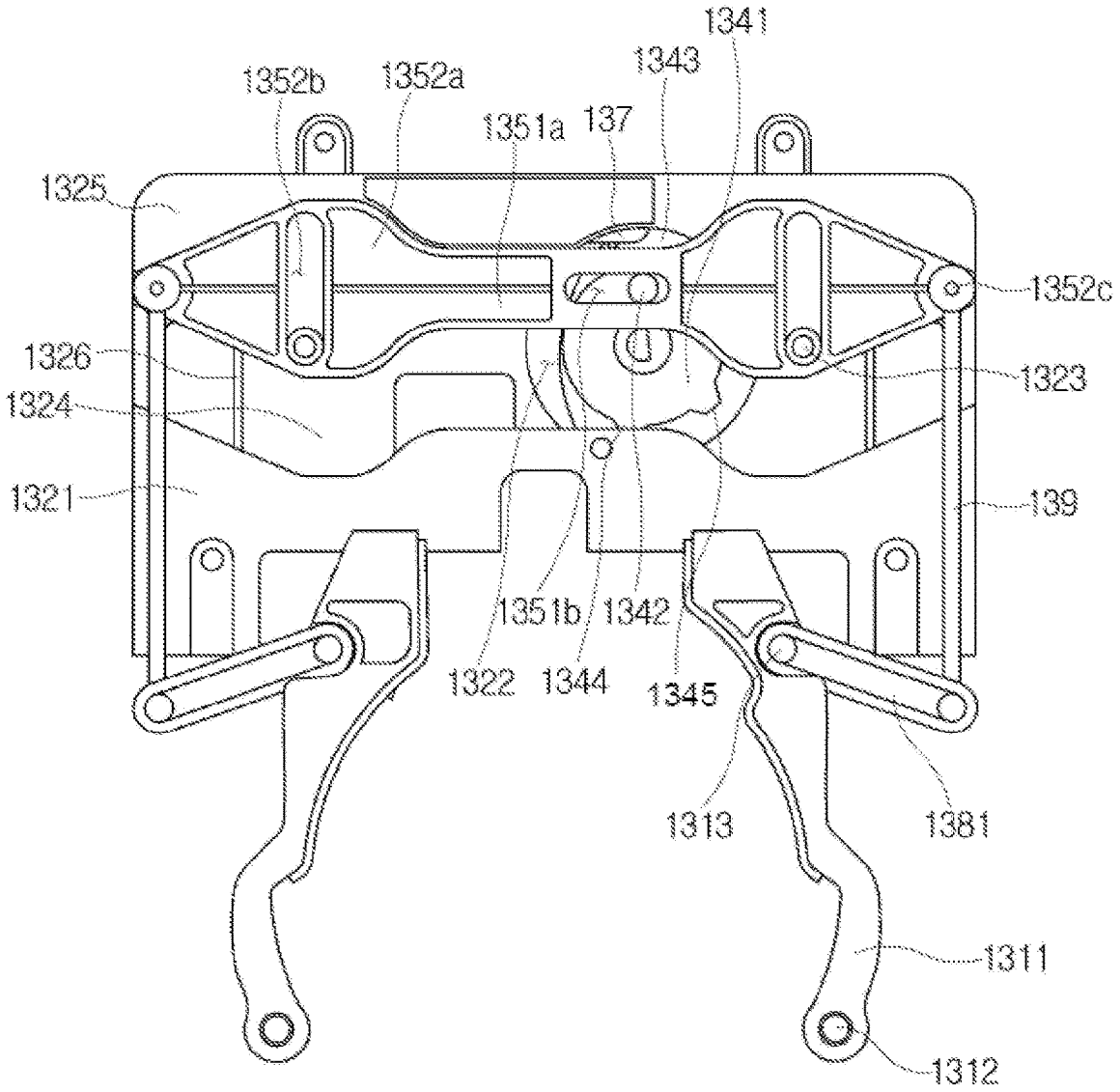
FIG. 10 is a view for explaining a state after the fixing unit according to the embodiment of the present disclosure operates.
Figure 11:
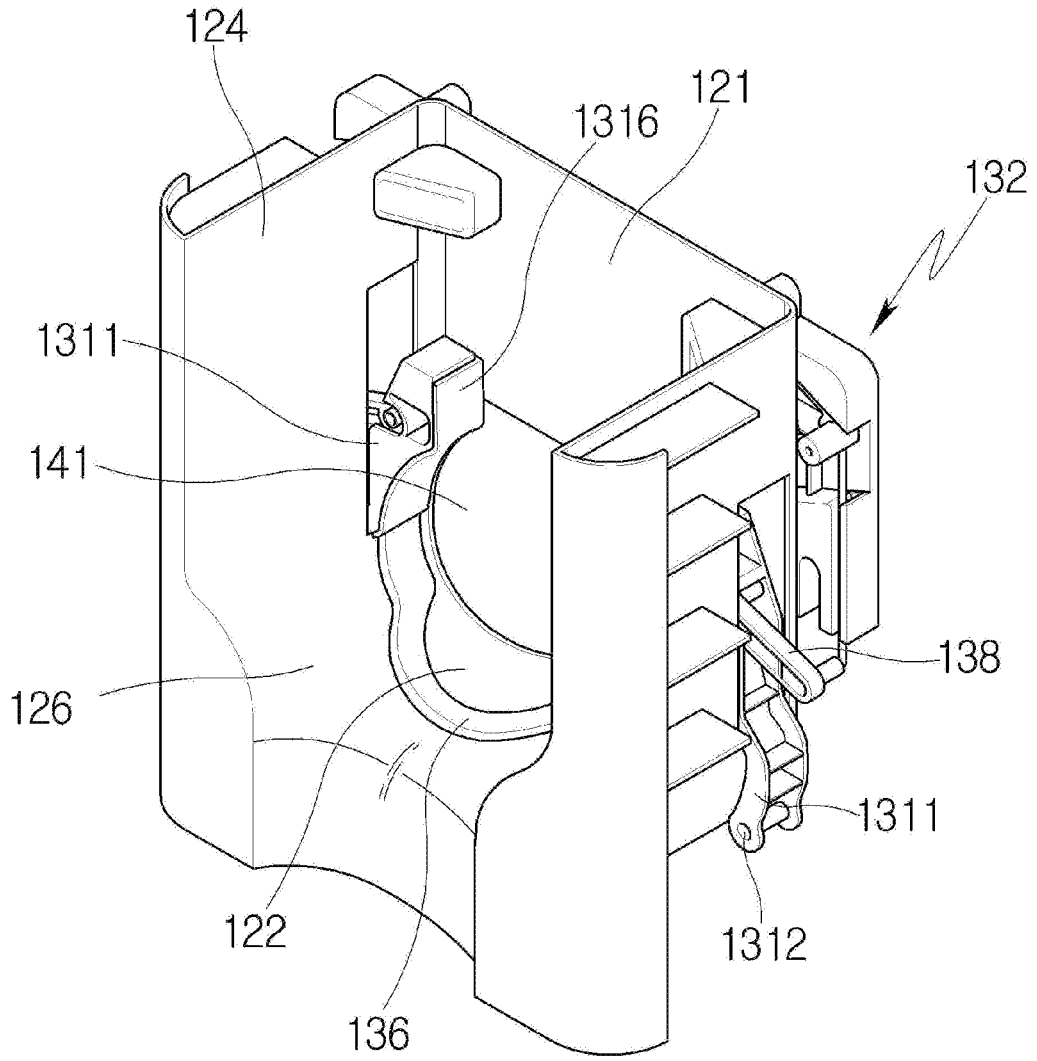
FIG. 11 is a view for explaining a state in which the fixing unit according to the embodiment of the present disclosure is mounted on the coupling part.
Figure 12:
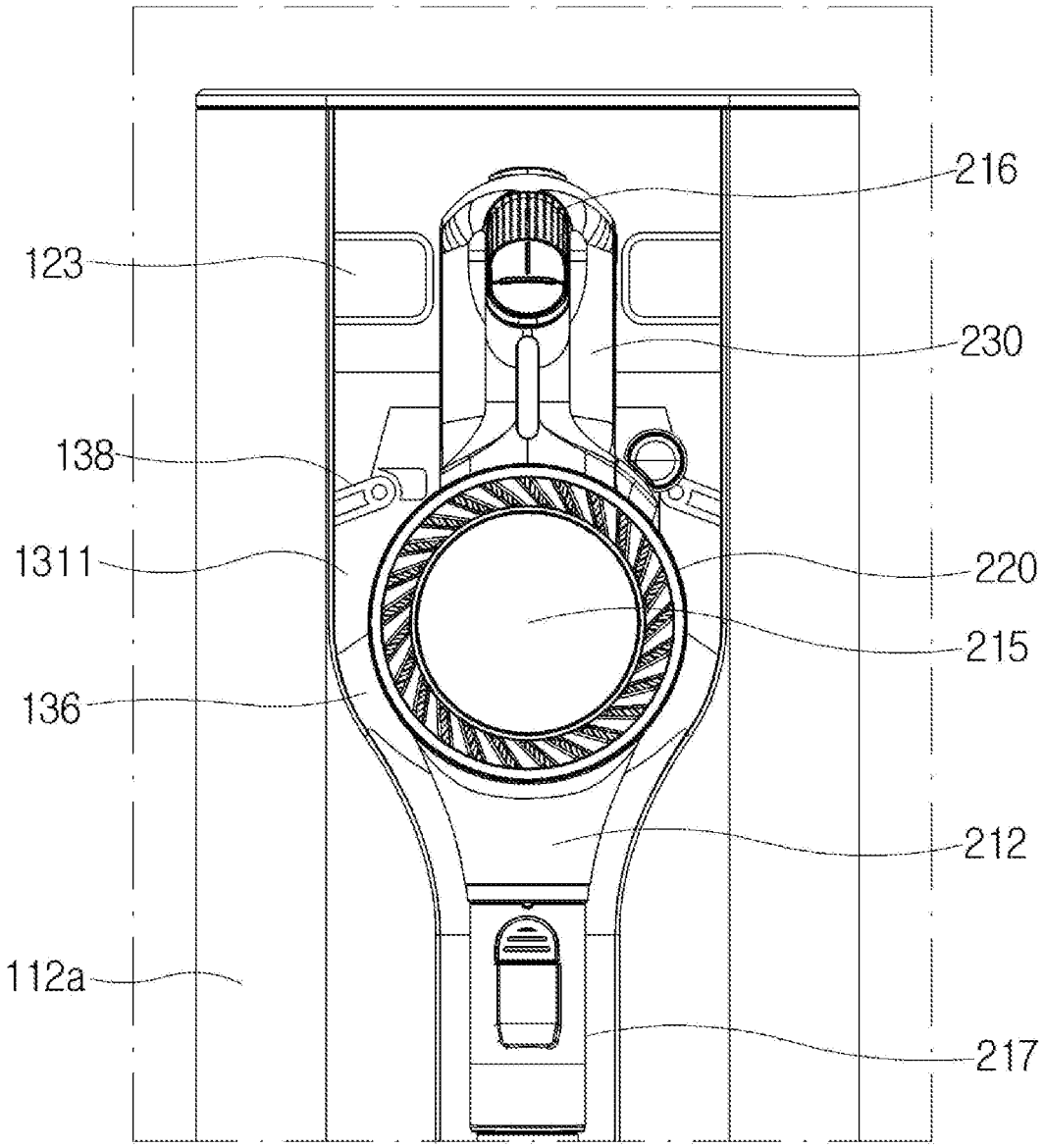
FIG. 12 is a view for explaining a state in which the first cleaner is fixed to the cleaner station according to the embodiment of the present disclosure.

Meanwhile, FIG. 8 is an exploded perspective view for explaining the fixing unit of the cleaner station according to the embodiment of the present disclosure, FIG. 9 is a view for explaining a state before the fixing unit according to the embodiment of the present disclosure operates, FIG. 10 is a view for explaining a state after the fixing unit according to the embodiment of the present disclosure operates, FIG. 11 is a view for explaining a state in which the fixing unit according to the embodiment of the present disclosure is mounted on the coupling part, and FIG. 12 is a view for explaining a state in which the first cleaner is fixed to the cleaner station according to the embodiment of the present disclosure.

A fixing unit 130 according to the present disclosure will be described below with reference to FIGS. 5 to 12.

The cleaner station 100 according to the present disclosure may include the fixing unit 130. A part of the fixing unit 130 may be disposed on the sidewall 124. In addition, a part of the fixing unit 130 may be disposed on a back surface to the coupling surface 121.

The fixing unit 130 may fix the first cleaner 200 coupled to the coupling surface 121. Specifically, the fixing unit 130 may fix the dust bin 220 and the battery housing 230 of the first cleaner 200 coupled to the coupling surface 121.

The fixing unit 130 may include the fixing members 131, a fixing part casing 132, a fixing part motor 133, a first power transmission member 134, a second power transmission member 135, a stationary sealer 136, a fixing detecting part 137, link arms 138, and connection pins 139.

The fixing unit 130 may include the fixing members 131 that move toward the dust bin 220 from the outside of the dust bin 220 to fix the dust bin 220 in conjunction with the rectilinear movement of the second power transmission member 135 when the first cleaner 200 is coupled to the coupling part 110. That is, a rotational force applied from the fixing part motor 133 is converted into a rectilinear motion by the first power transmission member 134 and the second power transmission member 135, and the rectilinear motion may move the fixing members 131.

The fixing member 131 may include a sealing frame 1311, a hinge portion 1312, an arm coupling portion 1313, a first pressing portion 1314, a second pressing portion 1315, and a movable sealer 1316.

The sealing frame 1311 may mean a frame or plate that rotates toward the dust bin 220 from the outside of the dust bin 220 by power of the fixing part motor 133 when the dust bin 220 of the first cleaner 200 is coupled to the coupling part 120.

For example, the sealing frame 1311 may have, but not limited to, a structure in which a pair of facing flat plates and a connection plate for connecting the pair of facing flat plates are integrated. That is, the sealing frame 1311 may include various shapes capable of surrounding the dust bin 220.

Meanwhile, the hinge portion 1312 may be provided at one end of the sealing frame 1311 so that the sealing frame 1311 is rotated by the power transmitted from the fixing part motor 133. The arm coupling portion 1313 may be provided at the other side of the sealing frame 1311.

The hinge portion 1312 may be provided at one end of the sealing frame 1311 and rotatably coupled to the housing 110.

For example, the hinge portion 1312 may be provided in a cylindrical shape on the sealing frame 1311 and coupled to the housing 110.

With this configuration, the hinge portion 1312 may serve as a rotation axis about which the fixing member 131 is rotated by the power transmitted from the fixing part motor 133.

The arm coupling portion 1313 may protrude from the sealing frame 1311, and the link arm 138 may be rotatably coupled to the arm coupling portion 1313.

For example, the arm coupling portion 1313 may protrude in a cylindrical shape from the sealing frame 1311. In this case, the arm coupling portion 1313 may be disposed at a position spaced apart from the hinge portion 1312 at a predetermined interval. That is, when the hinge portion 1312 is disposed at one side based on a middle point of a length in a major axis direction of the sealing frame 1311, the arm coupling portion 1313 may be disposed at the other side based on the middle point.

Meanwhile, the sealing frame 1311 may have a space in which the link arm 138 may be coupled, and the space may be formed in a portion corresponding to the position of the arm coupling portion 1313. That is, the arm coupling portion 1313 may protrude from one of the pair of facing plates of the sealing frame 1311, and a hole may be formed in the other of the pair of facing plates.

With this configuration, it is possible to increase a force for pressing the dust bin 220 using the power transmitted from the fixing part motor 133 and effectively press the dust bin 220.

The fixing member 131 is provided on the sidewall 124 of the coupling part 120 so as to reciprocatingly move toward the dust bin 220. The fixing member 131 may include the first pressing portion 1314 formed to correspond to the shape of the dust bin 220.

For example, the first pressing portion 1314 may be a surface of the sealing frame 1311 disposed toward the dust bin 220. In addition, the first pressing portion 1314 may be a surface having a predetermined curvature corresponding to the shape of the dust bin 220.

In addition, the fixing member 131 may include the second pressing portion 1315 connected to the first pressing portion 1314 and formed to correspond to the shape of the battery housing 230 of the first cleaner 200.

For example, the second pressing portion 1315 may be a surface of the sealing frame 1311 disposed toward the dust bin 220 and connected to the first pressing portion 1314. In addition, the second pressing portion 1315 may be provided in the form of a rectangular flat surface corresponding to the shape of the battery housing 230.

The fixing member 131 may include the movable sealer 1316 disposed on the surface of the first pressing portion 1314 directed toward the dust bin 220, and the movable sealer 1316 may seal the dust bin 220. In this case, the movable sealer 1316 may be provided not only on the first pressing portion 1314, but also on the second pressing portion 1315.

This configuration may prevent a space from being formed between the dust bin 220 and the fixing member 131 when the fixing members 131 rotate and surround the dust bin 220. Further, this configuration may prevent the dust in the dust bin 220 from scattering to the outside of the cleaner station 100 when the dust is sucked by the dust collecting motor 191.

The fixing unit 130 may include the fixing part casing 132 coupled to the second power transmission member 135 and configured to guide the rectilinear movement of the second power transmission member 135.

The fixing part casing 132 may include a casing main body 1321. The casing main body 1321 is provided in the form of a flat plate. The casing main body 1321 may accommodate the first power transmission member 134 and the second power transmission member 135 and guide the movement of the second power transmission member 135. For example, the casing main body 1321 may be provided in the form of a flat plate.

The casing main body 1321 may have a cam accommodation hole 1322, guide rods 1323, and guide rails 1327. In addition, the fixing part motor 133 may be fixedly coupled to the casing main body 1321.

The cam accommodation hole 1322 may be formed in the casing main body 1321 and accommodate at least a part of the first power transmission member 134. For example, the cam accommodation hole 1322 may be a hole having a radius larger than a maximum radius of the first power transmission member 134.

The guide rod 1323 may protrude from the casing main body 1321 and be inserted into and coupled to the second power transmission member 135.

For example, the guide rod 1323 may protrude in a circular column shape or a cylindrical shape from the casing main body 1321. The pair of guide rods 1323 may be disposed at a predetermined interval on the casing main body 1321. The guide rods 1323 may be respectively accommodated in guide rod coupling holes 1352*b*.

With this configuration, when the guide rods 1323 are coupled to the second power transmission member 135, it is possible to prevent the second power transmission member 135 from swaying in the leftward/rightward direction of the fixing part casing 132 (a direction parallel to the ground surface). In addition, the guide rods 1323 may guide the rectilinear movement of the second power transmission member 135.

The fixing part casing 132 may include a lower stopper 1324 protruding with a level difference from the casing main body 1321 and disposed below the second power transmission member 135 in the gravitational direction.

The lower stopper 1324 is formed with a level difference from the stepped portion from the casing main body 1321. The lower stopper 1324 may support the lower side of the second power transmission member 135 coupled to the fixing part casing 132 and prevent the second power transmission member 135 from separating downward in the gravitational direction.

In addition, the fixing part casing 132 may include an upper stopper 1325 protruding with a level difference from the casing main body 1321 and disposed above the second power transmission member 135 in the gravitational direction.

The upper stopper 1325 may be formed with a level difference from the casing main body 1321 and prevent the second power transmission member 135 from separating upward in the gravitational direction.

The upper stopper 1325 may have a sensor mounting groove 1325*a* that accommodates the fixing detecting part 137. With this configuration, the fixing detecting part 137 may be fixedly coupled to the fixing part casing 132.

A plurality of assembly holes may be formed in the lower stopper 1324 and the upper stopper 1325 so that the lower stopper 1324 and the upper stopper 1325 are coupled to the housing 110.

The fixing part casing 132 may include guide ribs 1326 protruding from the casing main body 1321 and configured to connect the lower stopper 1324 and the upper stopper 1325.

For example, the guide rib 1326 may protrude in the form of a straight rib from the casing main body 1321. In addition, the pair of guide ribs 1326 may be provided in parallel with each other at a predetermined interval.

When the second power transmission member 135 is coupled to the fixing part casing 132, the guide ribs 1326 may be respectively accommodated in rib coupling grooves 1352*d* of the second power transmission member 135. Further, the second power transmission member 135 may rectilinearly move along the guide ribs 1326.

With this configuration, the second power transmission member 135 may transmit the power to the fixing member 131 while stably and rectilinearly moving.

The fixing part casing 132 may include the guide rails 1327 formed in the lower stopper 1324 and configured to accommodate the connection pins 139.

For example, the guide rail 1327 may be provided in the form of a straight groove in the lower stopper 1324. In addition, the pair of guide rails 1327 may be provided in parallel with each other at a predetermined interval.

With this configuration, the connection pins 139 may be accommodated in the guide rails 1327. Further, the connection pins 139 may rectilinearly move along the guide rails 1327.

The fixing part motor 133 may provide power for moving the fixing members 131. Specifically, the fixing part motor 133 may rotate the first power transmission member 134 in a forward direction or a reverse direction. In this case, the forward direction may mean a direction in which the fixing member 131 is moved from the inside of the sidewall 124 to press the dust bin 220. In addition, the reverse direction may mean a direction in which the fixing member 131 is moved to the inside of the sidewall 124 from a position at which the fixing member 131 presses the dust bin 220. The forward direction may be opposite to the reverse direction.

The fixing unit 130 may include the first power transmission member 134 coupled to the fixing part motor 133 and configured to rotate using the power of the fixing part motor 133. For example, the first power transmission member 134 may be provided in the form of a cam.

The first power transmission member 134 may include the cam main body 1341 to which a shaft of the fixing part motor 133 is coupled.

For example, the cam main body 1341 may be provided in the form of a disc having a predetermined thickness. In this case, a hole into which the shaft of the fixing part motor 133 is inserted may be formed at a center of the cam main body 1341. In this case, the hole into which the shaft is inserted may have, but not limited to, a D-cut shape and be formed to correspond to a shape of the shaft of the fixing part motor 133.

One surface of the cam main body 134 may be disposed to face the fixing part motor 133, and the other surface of the cam main body 134 may be disposed to face the second power transmission member 135. In this case, a connection rod 1342 may protrude from the other surface of the cam main body 134. Further, a first cam 1343, a second cam 1344, and a third cam 1345 may protrude from an outer peripheral surface of the cam main body 134.

For example, the connection rod 1342 may protrude in a cylindrical shape from the cam main body 1341 and be disposed to be eccentric from a rotation axis of the cam main body 1341.

With this configuration, when the fixing part motor 133 operates, the shaft of the fixing part motor 133 rotates the cam main body 1341 while rotating, and the rotation of the cam main body 1341 rotates the connection rod 1342 about the rotation axis of the cam main body 1341.

The first cam 1343 may protrude from the outer peripheral surface of the cam main body 1341 by a predetermined angle in a circumferential direction.

The rotation of the first power transmission member 134 may bring the first cam 1343 into contact with the fixing detecting part 137. Therefore, based on the contact between the fixing detecting part 137 and the first cam 1343, the fixing detecting part 137 may detect whether the fixing unit 130 fixes the dust bin 220.

In addition, the rotation of the first power transmission member 134 may bring the first cam 1343 into contact with a protrusion 1321*a* protruding from the casing main body 1321. Specifically, when the first power transmission member 134 rotates in the forward direction, the first cam 1343 and the protrusion 1321*a* may be supported by being brought into contact with each other at a maximum rotation position of the first power transmission member 134. In this case, the protrusion 1321*a* may serve as a kind of stopper and thus prevent the first cam 1343 from excessively rotating.

The second cam 1344 may protrude and extend radially outward from the outer peripheral surface of the cam main body 1341 and be disposed opposite to the connection rod 1342 based on the rotation axis of the cam main body 1341. That is, the second cam 1344 may be disposed to be spaced apart from the first cam 1343 at a predetermined interval in the circumferential direction based on the rotation axis of the cam main body 1341.

The second cam 1344 may be in contact with the protrusion 1321*a* protruding from the casing main body 1321. Specifically, when the first power transmission member 134 is positioned at an initial position or when the first power transmission member 134 rotates in the reverse direction, the second cam 1344 may be supported by being brought into contact with the protrusion 1321*a* protruding from the casing main body 1321.

Therefore, a rotation range of the first power transmission member 134 may be restricted by the protrusion 1321*a*, and the operation of the fixing unit 130 may be maintained constantly.

The third cam 1345 may protrude and extend radially outward from the outer peripheral surface of the cam main body 1341. The third cam 1345 may be disposed between the first cam 1343 and the second cam 1344 and provided at a position at which the third cam 1345 may come into contact with the fixing detecting part 137.

Specifically, when the first power transmission member 134 is positioned at the initial position or when the first power transmission member 134 rotates in the reverse direction, the third cam 1345 comes into contact with the fixing detecting part 137, and the fixing detecting part 137 may detect that the fixing unit is positioned at the initial position (the position before the operation).

The fixing unit 130 may include the second power transmission member 135 into which the connection rod 1342 is inserted and coupled. The second power transmission member 135 rectilinearly moves in conjunction with the rotation of the first power transmission member 134 and converts the rotational force of the fixing part motor 133 into the rectilinear motion. For example, the second power transmission member 135 may be provided in the form of a block.

The second power transmission member 135 may include the cam coupling portion 1351 into which the connection rod 1342 is inserted and coupled.

The cam coupling portion 1351 may include a coupling portion main body 1351*a* and a connection rod coupling hole 1351*b*. For example, the coupling portion main body 1351*a* may be a frame formed in a direction parallel to the ground surface. Further, the connection rod coupling hole 1351*b* may be formed in a long hole shape in a major axis direction of the coupling portion main body 1351*a*.

The connection rod 1342 may be inserted into the connection rod coupling hole 1351*b*. Further, the connection rod 1342 may move along the connection rod coupling hole 1351*b*.

The second power transmission member 135 may include a guide portion 1352 extending from the cam coupling portion 1351 and coupled to the fixing part casing 132.

The guide portion 1352 may include a guide portion main body 1352*a*, the guide rod coupling holes 1352*b*, pin coupling holes 1352*c*, and the rib coupling groove 1352*d*.

The guide portion main body 1352*a* may extend from two opposite ends of the cam coupling portion 1351. For example, the guide portion main body 1352*a* may extend from the two opposite sides of the cam coupling portion 1351 in a direction parallel to the ground surface. Further, a width of the guide portion main body 1352*a* gradually increases from the cam coupling portion 1351 and then decreases again.

The guide rod coupling hole 1352*b* may have a long hole shape in a minor axis direction of the guide portion main body 1352*a*, and the guide rod 1323 of the fixing part casing 132 may be inserted into and coupled to the guide rod coupling hole 1352*b*. For example, the guide rod coupling hole 1352*b* may be formed in a direction perpendicular to the ground surface. For example, the pair of guide rod coupling holes 1352*b* may be disposed at a predetermined interval in the guide portion main body 1352*a*.

The guide rod 1323 may be inserted into the guide rod coupling hole 1352*b*. Further, the guide rod 1323 may relatively move in the direction perpendicular to the ground surface along the guide rod coupling hole 1352*b*.

The pin coupling hole 1352*c* may be formed in the guide portion main body 1352*a*, and one end of the connection pin 139 may be inserted into and coupled to the pin coupling hole 1352*c*.

For example, the pin coupling holes 1352*c* may mean a pair of holes disposed at ends of the guide portion main body 1352 opposite to the cam coupling portion 1351.

Therefore, the connection pins 139 may be respectively inserted into the pin coupling holes 1352*c*.

The guide portion 1352 may include the rib coupling grooves 1352*d* that accommodate the guide ribs 1326. For example, the rib coupling groove 1352*d* may be formed in a surface of the guide portion main body 1352*a* directed toward the fixing part casing 132. The rib coupling groove 1352*d* may be provided in the form of a straight groove capable of accommodating the guide rib 1326. In addition, the pair of rib coupling grooves 1352*d* may be disposed at a predetermined interval.

With this configuration, the rib coupling grooves 1352*d* may guide the rectilinear movement of the second power transmission member 135 and stably move the second power transmission member 135.

The stationary sealer 136 may be disposed on the dust bin guide surface 122 so as to seal the dust bin 220 when the first cleaner 200 is coupled. With this configuration, when the dust bin 220 of the cleaner 200 is coupled, the cleaner 200 may press the stationary sealer 136 by its own weight, such that the dust bin 220 and the dust bin guide surface 122 may be sealed.

The stationary sealer 136 may be disposed in imaginary extension lines of the movable sealers 1316. With this configuration, when the fixing part motor 133 operates and the fixing members 131 press the dust bin 220, a circumference of the dust bin 220 at the same height may be sealed. That is, the stationary sealer 136 and the movable sealers 1316 may seal the outer circumferential surfaces of the dust bin 220 disposed on concentric circles.

According to the embodiment, the stationary sealer 136 may be disposed on the dust bin guide surface 122 and formed in the form of a bent line or a curved line corresponding to an arrangement of a cover opening unit 150 to be described below.

The fixing unit 130 may further include the fixing detecting part 137. The fixing detecting part 137 may be provided in the housing 100 and may detect whether the fixing members 131 fix the first cleaner 200.

For example, the fixing detecting part 137 may be coupled to the fixing part casing 132 and detect the rotation of the first power transmission member 134.

Therefore, when the first power transmission member 134 rotates to a predetermined fixing position FP1, the fixing detecting part 137 may detect the contact with the first cam 1343 and thus detect that the first cleaner 200 is fixed. In addition, when the first power transmission member 134 rotates to a predetermined releasing position FP2, the fixing detecting part 137 may detect the contact with the third cam 1343 and thus detect that the first cleaner 200 is released.

The fixing detecting part 137 may include a contact sensor. For example, the fixing detecting part 137 may include a micro-switch.

The fixing unit 130 may include the link arms 138 configured to link the second power transmission member 135 and the fixing member 131.

The link arm 138 may include an arm main body 1381 configured to transmit the power, transmitted from the second power transmission member 135, to the fixing member 131.

For example, the arm main body 1381 may be provided in the form of a straight frame. In this case, a protruding portion 1382 may be formed at one end in the major axis direction of the arm main body 1381, and a sealer coupling portion 1384 may be formed at the other end in the major axis direction of the arm main body 1381.

The protruding portion 1382 may protrude from one end of the arm main body 1381. For example, the protruding portion 1382 may protrude in a cylindrical shape from one end of the arm main body 1381. Therefore, a pin coupling portion 1383 may be formed at a center of the protruding portion 1382, and the connection pin 139 may be coupled to the pin coupling portion 1383. In this case, the pin coupling portion 1383 may be a circular hole formed on a central axis of the protruding portion 1382.

Therefore, the connection pin 139 may be inserted into and coupled to the pin coupling portion 1383, and the pin coupling portion 1383 and the connection pin 139 may relatively rotate in conjunction with the operation of the fixing part motor 133.

The sealer coupling portion 1384 may be formed at the other end of the arm main body 1381 and coupled to the fixing member 131.

For example, the sealer coupling portion 1384 may be a circular hole into which the arm coupling portion 1313 of the fixing member 131 may be inserted into and coupled.

Therefore, the arm coupling portion 1313 of the fixing member 131 may be inserted into and coupled to the sealer coupling portion 1384, and the sealer coupling portion 1384 and the fixing member 131 may relatively rotate in conjunction with the operation of the fixing part motor 133.

The fixing unit 130 may include the connection pins 139 configured to connect the second power transmission member 135 and the link arms 138.

For example, the connection pin 139 may be provided in the form of a pin bent at two opposite ends thereof. In this case, one end of the connection pin 139, which is bent, may be inserted into and coupled to the pin coupling hole 1352*c* of the second power transmission member 135, and the other end of the connection pin 139, which is bent, may be inserted into and coupled to the pin coupling portion 1383 of the link arm 138. Further, the connection pins 139 may be respectively accommodated in the guide rails 1327 of the fixing part casing 132.

With this configuration, the connection pin 139 may transmit the power of the second power transmission member 135 to the link arm 138.

A process of operating the fixing unit 130 according to the present disclosure will be described below with reference to FIGS. 9 and 10.

In a state in which the first cleaner 200 is not coupled to the coupling part 110, the second power transmission member 135 is supported in a state of being in contact with the lower stopper 1324 of the fixing part casing 132, and the second cam 1344 of the first power transmission member 134 is supported by being in contact with the protrusion 1321*a* of the casing main body. In this case, the connection pins 139 pull the link arms 138 downward in the gravitational direction. Therefore, the fixing members 131 are pulled in a direction in which the fixing members 131 are moved away from the dust bin 220. The fixing members 131 are positioned in the space surrounded by the sidewall 124 and the housing 110.

When the first cleaner 200 is coupled to the coupling part 120, the fixing part motor 133 operates in the forward direction, and the first power transmission member 134 is also rotated by the rotation of the fixing part motor 133. The connection rod 1342 is also rotated about the rotation axis of the first power transmission member 134 by the rotation of the first power transmission member 134. In this case, the connection rod 1342 moves in a direction in which a height thereof from the ground surface gradually increases (upward in the gravitational direction) while rotating, and the second power transmission member 135 to which the connection rod 1342 is inserted into and coupled is also moved upward in the gravitational direction. Meanwhile, the rectilinear movement of the second power transmission member 135 is guided by the guide ribs 1326 and the guide rods 1323. Therefore, the rotational motion of the first power transmission member 134 is converted into the rectilinear movement of the second power transmission member 135.

Meanwhile, as the second power transmission member 135 is moved upward in the gravitational direction, the connection pins 139 are also moved upward in the gravitational direction. In this case, since the leftward and rightward movements of the connection pins 139 are restricted by the guide rails 1327, the connection pins 139 press the link arms 138 toward the dust bin 220 while moving upward in the gravitational direction. Therefore, the sealing frames 1311 fix the dust bin while moving about the hinge portions 1312 toward the dust bin 220 from the outside of the dust bin 220.

Meanwhile, when the second power transmission member 135 moves to a maximum height, the first cam 1341 of the first power transmission member 134 comes into contact with the fixing detecting part 137. The fixing detecting part 137 may detect that the dust bin 220 is completely fixed, such that the forward operation of the fixing part motor 133 is stopped. In this case, the protrusion 1321*a* of the casing main body 1321 is supported by being in contact with the first cam 1343, thereby restricting a further rotation of the first power transmission member 134.

Meanwhile, after a process of emptying the dust bin 220 is ended, the fixing part motor 133 operates in the reverse direction, and the first power transmission member 134 also rotates in the reverse direction. Therefore, the connection rod 1342 rotates in a direction in which a height thereof from the ground surface decreases. In this case, the second power transmission member 135 coupled to the connection rod 1342 is also moved downward in the gravitational direction, and the connection pins 139 are also moved downward in the gravitational direction. In this case, the connection pins 139 pull the link arms 138 downward in the gravitational direction, and the link arms 138 pulls the sealing frames 1311 in a direction in which the sealing frames 1311 are moved away from the dust bin 220. Therefore, the sealing frames 1311 release the dust bin 220 while moving about the hinge portions 1312 in the direction in which the sealing frames 1311 are moved away from the dust bin 220.

Meanwhile, when the second power transmission member 135 is moved downward in the gravitational direction and supported by the lower stopper 1324, the third cam 1345 comes into contact with the fixing detecting part 137. The fixing detecting part 137 may detect that the dust bin 220 is released, and the reverse operation of the fixing part motor 133 is stopped. In this case, the protrusion 1321*a* is supported by being in contact with the second cam 1344, thereby restricting a further rotation of the first power transmission member 134.

Therefore, according to the present disclosure, the first cleaner 200 may automatically detect the coupled state of the first cleaner 200 and fix the dust bin 220 of the first cleaner at the time of coupling the first cleaner 200 to the cleaner station 100, which makes it possible to allow the user to seal the first cleaner 200 without applying a separate force.

In addition, the first cleaner 200 may automatically detect the coupled state of the first cleaner 200 and seal the first cleaner 200 at the time of coupling the first cleaner 200 to the cleaner station 100, which makes it possible to improve the efficiency in preventing dust from scattering.

In addition, according to the present disclosure, the two fixing members 131 move in conjunction with the rectilinear movement of the single second power transmission member 135, which makes it possible to stably fix the dust bin 220 by simultaneously pressing the two opposite sides of the dust bin 220 of the cleaner.

Figure 13:
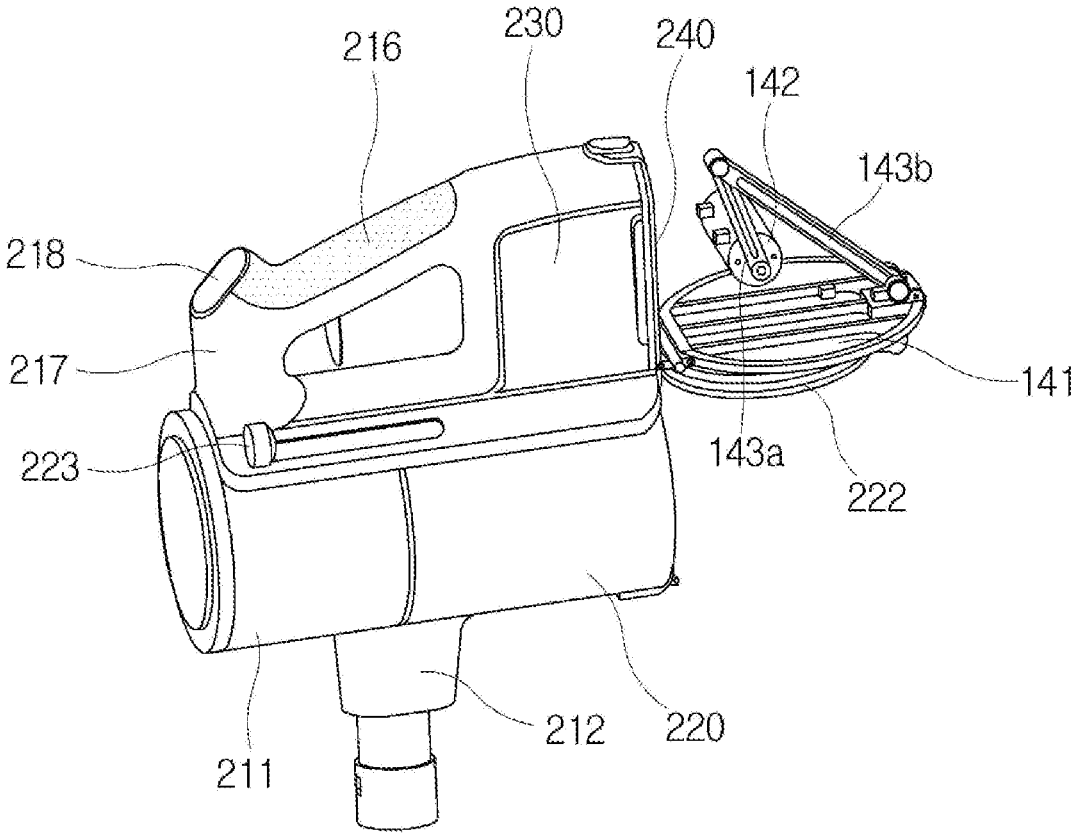
FIG. 13 is a view for explaining a relationship between the first cleaner and a door unit in the cleaner station according to the embodiment of the present disclosure.

Meanwhile, FIG. 13 is a view for explaining a relationship between the first cleaner and the door unit in the cleaner station according to the embodiment of the present disclosure.

A door unit 140 according to the present disclosure will be described below with reference to FIGS. 2, 7, and 13.

The cleaner station 100 according to the present disclosure may include the door unit 140. The door unit 140 may be configured to open or close the dust passage hole 121*a*.

The door unit 140 may include a door 141, a door motor 142, and a door arm 143.

The door 141 may be hingedly coupled to the coupling surface 121 and may open or close the dust passage hole 121*a*.

The door main body 141 may be formed in a shape capable of blocking the dust passage hole 121*a*. The door main body 141 may be formed in a shape capable of sealing the dust passage hole 121*a*.

With this configuration, when the door arm 143 pulls the door main body 141 in the state in which the door 141 closes the dust passage hole 121*a*, the door 141 is rotated toward the inside of the cleaner station 100, such that the dust passage hole 121*a* may be opened.

The door motor 142 may provide power for rotating the door 141. Specifically, the door motor 142 may rotate the door arm 143 in a forward direction or a reverse direction. In this case, the forward direction may mean a direction in which the door arm 143 pulls the door 141. Therefore, when the door arm 143 is rotated in the forward direction, the dust passage hole 121*a* may be opened. In addition, the reverse direction may mean a direction in which the door arm 143 pushes the door 141. Therefore, when the door arm 143 is rotated in the reverse direction, at least a part of the dust passage hole 121*a* may be closed. The forward direction may be opposite to the reverse direction.

The door arm 143 may connect the door 141 and the door motor 142 and open or close the door 141 using the power generated from the door motor 142.

For example, the door arm 143 may include a first door arm 143*a* and a second door arm 143*b*. One end of the first door arm 143*a* may be coupled to the door motor 142. The first door arm 143*a* may be rotated by the power of the door motor 142. The other end of the first door arm 143*a* may be rotatably coupled to the second door arm 143*b*. The first door arm 143*a* may transmit a force transmitted from the door motor 142 to the second door arm 143*b*. One end of the second door arm 143*b* may be coupled to the first door arm 143*a*. The other end of the second door arm 143*b* may be coupled to the door 141. The second door arm 143*b* may open or close the dust passage hole 121*a* by pushing or pulling the door 141.

The door unit 140 may further include door opening/closing detecting parts 144. The door opening/closing detecting parts 144 may be provided in the housing 100 and may detect whether the door 141 is in an opened state.

For example, the door opening/closing detecting parts 144 may be disposed at both ends in a rotational region of the door arm 143, respectively. As another example, the door opening/closing detecting parts 144 may be disposed at both ends in a movement region of the door 141, respectively.

Therefore, when the door arm 143 is moved to a predetermined opened position DP1 or when the door 141 is opened to a predetermined position, the door opening/closing detecting parts 144 may detect that the door is opened. In addition, when the door arm 143 is moved to a predetermined closed position DP2 or when the door 141 is opened to a predetermined position, the door opening/closing detecting parts 144 may detect that the door is opened.

The door opening/closing detecting part 144 may include a contact sensor. For example, the door opening/closing detecting part 144 may include a micro-switch.

Meanwhile, the door opening/closing detecting part 144 may also include a non-contact sensor. For example, the door opening/closing detecting part 144 may include an infrared ray (IR) sensor.

With this configuration, the door unit 140 may selectively open or close at least a part of the coupling surface 121, thereby allowing the outside of the first outer wall surface 112*a* to communicate with the first flow path 181 and/or the dust collecting part 170.

The door unit 140 may be opened when the discharge cover 222 of the first cleaner 200 is opened. In addition, when the door unit 140 is closed, the discharge cover 222 of the first cleaner 200 may also be closed.

When the dust in the dust bin 220 of the first cleaner 200 is removed, the door motor 142 may rotate the door 141, thereby coupling the discharge cover 222 to the dust bin main body 221. Specifically, the door motor 142 may rotate the door 141 to rotate the door 142 about the hinge part 141*b*, and the door 142 rotated about the hinge part 141*b* may push the discharge cover 222 toward the dust bin main body 221.

Figure 14:
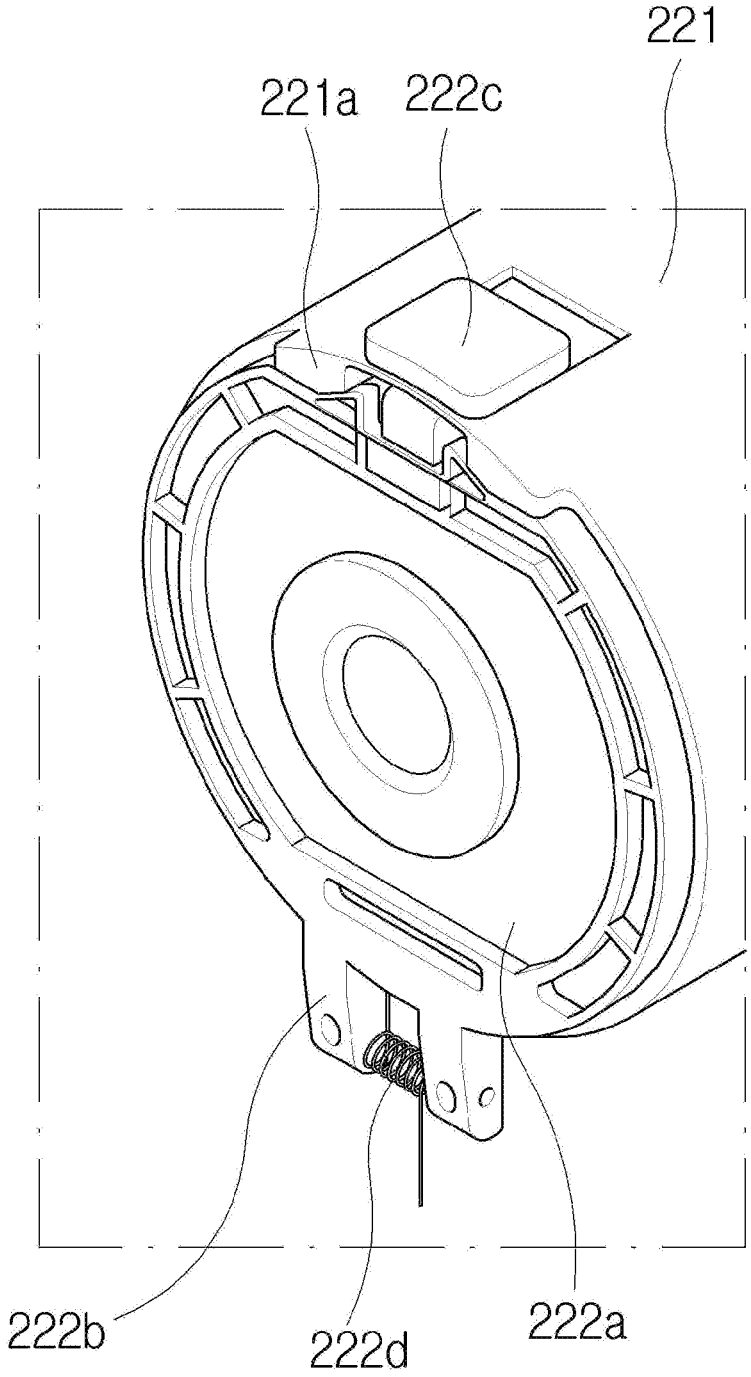
FIG. 14 is a view for explaining a lower side of a dust bin of the first cleaner according to the embodiment of the present disclosure.
Figure 15:
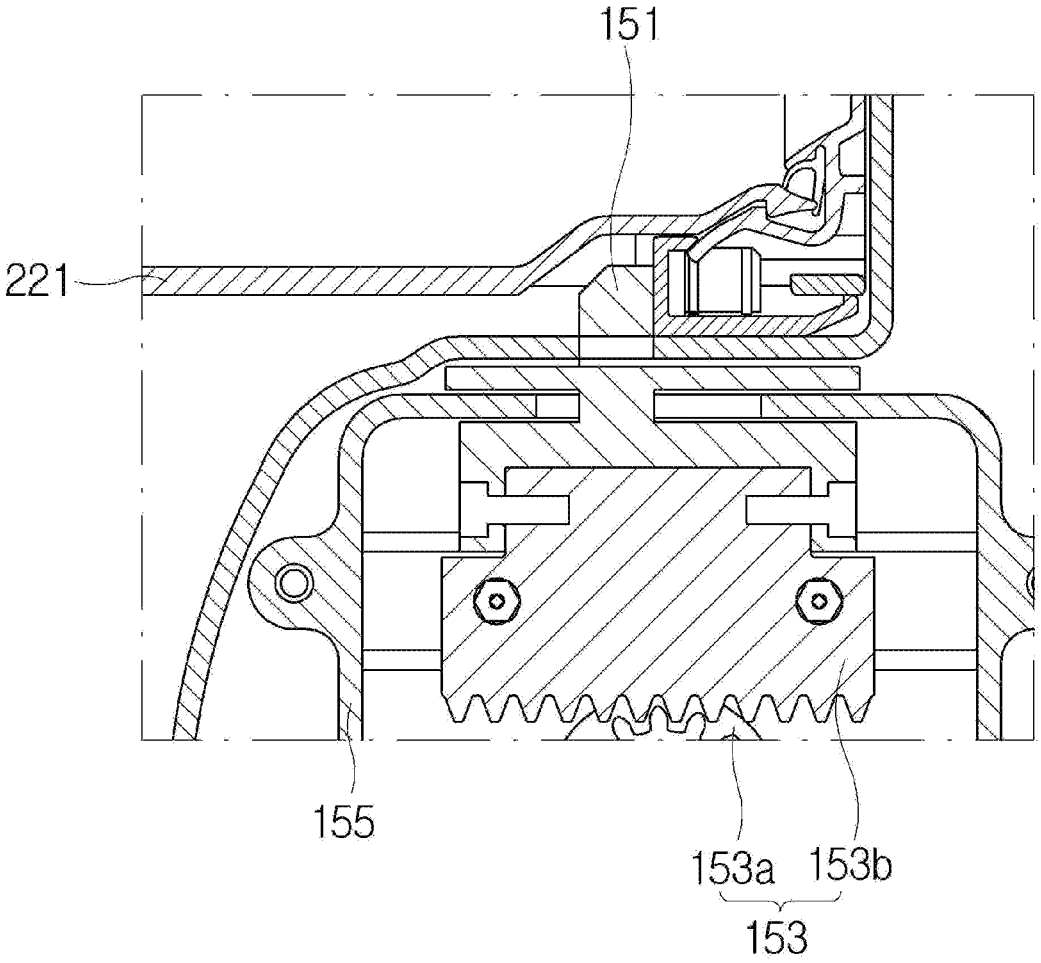
FIG. 15 is a view for explaining a relationship between the first cleaner and a cover opening unit in the cleaner station according to the embodiment of the present disclosure.

FIG. 14 is a view for explaining the lower surface of the dust bin of the first cleaner according to the embodiment of the present disclosure, and FIG. 15 is a view for explaining a relationship between the first cleaner and the cover opening unit in the cleaner station according to the embodiment of the present disclosure.

The cover opening unit 150 according to the present disclosure will be described below with reference to FIGS. 7, 14, and 15.

The cleaner station 100 according to the present disclosure may include a cover opening unit 150. The cover opening unit 150 may be disposed on the coupling part 120 and may open the discharge cover 222 of the first cleaner 200.

The cover opening unit 150 may include a push protrusion 151, a cover opening motor 152, cover opening gears 153, a support plate 154, and a gear box 155.

The push protrusion 151 may move to press the coupling lever 222*c* when the first cleaner 200 is coupled.

The push protrusion 151 may be disposed on the dust bin guide surface 122. Specifically, a protrusion moving hole may be formed in the dust bin guide surface 122, and the push protrusion 151 may be exposed to the outside by passing through the protrusion moving hole.

When the first cleaner 100 is coupled, the push protrusion 151 may be disposed at a position at which the push protrusion 3151 may push the coupling lever 222*c*. That is, the coupling lever 222*c* may be disposed on the protrusion moving hole. In addition, the coupling lever 222*c* may be disposed in a movement region of the push protrusion 151.

The push protrusion 151 may rectilinearly reciprocate to press the coupling lever 222*c*. Specifically, the push protrusion 151 may be coupled to the gear box 155, such that the rectilinear movement of the push protrusion 151 may be guided. The push protrusion 151 may be coupled to the cover opening gears 153 and moved together with the cover opening gears 153 by the movements of the cover opening gears 153.

The cover opening motor 152 may provide power for moving the push protrusion 151. Specifically, the cover opening motor 152 may rotate a motor shaft (not illustrated) in a forward direction or a reverse direction. In this case, the forward direction may mean a direction in which the push protrusion 151 pushes the coupling lever 222*c*. In addition, the reverse direction may mean a direction in which the push protrusion 151, which has pushed the coupling lever 222*c*, returns back to an original position. The forward direction may be opposite to the reverse direction.

The cover opening gears 153 may be coupled to the cover opening motor 152 and may move the push protrusion 151 using the power from the cover opening motor 152. Specifically, the cover opening gears 153 may be accommodated in the gear box 155. A driving gear 153*a* of the cover opening gears 153 may be coupled to the motor shaft of the cover opening motor 152 and supplied with the power. A driven gear 153*b* of the cover opening gears 153 may be coupled to the push protrusion 151 to move the push protrusion 151. For example, the driven gear 153*b* may be provided in the form of a rack gear, engage with the driving gear 153*a*, and receive power from the driving gear 153*a*.

The support plate 154 may be provided to support one surface of the dust bin 220. Specifically, the support plate 154 may extend from the coupling surface 121. The support plate 154 may protrude and extend toward a center of the dust passage hole 121*a* from the coupling surface 121.

The support plate 154 may protrude and extend symmetrically from the coupling surface 121, but the present disclosure is not limited thereto, and the support plate 154 may have various shapes capable of supporting the lower extension portion 221*a* of the first cleaner 200 or the lower surface of the dust bin 220.

Meanwhile, the discharge cover 222 may be openably and closably provided at the lower side of the dust bin 220 (i.e., a direction opposite to a direction in which the suction motor 214 is disposed based on the axial direction of the dust bin), and the dust bin 220 may include the cylindrical dust bin main body 221 and the extending lower extension portion 221*a*. In this case, the support plate 154 may be in contact with the lower extension portion 221*a* and may support the lower extension portion 221*a*.

With this configuration, the push protrusion 151 may push the coupling lever 222*c* of the discharge cover 222 in the state in which the support plate 154 supports the lower extension portion 221*a*.

In this case, the discharge cover 222 may have the torsion spring 222*d*. The discharge cover 222 may be rotated by a predetermined angle or more and supported in the rotated position by an elastic force of the torsion spring 222*d*. Therefore, the discharge cover 222 may be opened, and the dust passage hole 121*a* and the inside of the dust bin 220 may communicate with each other. That is, as the discharge cover 222 is opened, the flow path part 180 and the inside of the dust bin 220 may communicate with each other, and the cleaner station 100 and the first cleaner 200 may be coupled to each other to enable a flow of a fluid (coupling of the flow path).

The gear box 155 may be disposed in the housing 110 and disposed at the lower side of the coupling part 120 in the gravitational direction, and the cover opening gears 153 may be accommodated in the gear box 155.

Cover opening detecting parts 155*f* may be disposed on the gear box 155. In this case, the cover opening detecting part 155*f* may include a contact sensor. For example, the cover opening detecting part 155*f* may include a microswitch. Meanwhile, the cover opening detecting part 155*f* may also include a non-contact sensor. For example, the cover opening detecting part 155*f* may include an infrared (IR) sensor.

The cover opening detecting part 155*f* may be disposed on at least one of inner and outer walls of the gear box 155. For example, the single cover opening detecting part 155*f* may be disposed on the inner surface of the gear box 155. In this case, the cover opening detecting part 155*f* may detect that the push protrusion 151 is positioned at the initial position.

As another example, the two cover opening detecting parts 155*f* may be disposed on the outer surface of the gear box 155. In this case, the cover opening detecting part 155*f* may detect the initial position and the cover opening position of the push protrusion 151.

Accordingly, according to the present disclosure, the cover opening unit 150 may open the dust bin 220 even though the user separately opens the discharge cover 222 of the first cleaner, and as a result, it is possible to improve convenience.

In addition, since the discharge cover 222 is opened in the state in which the first cleaner 200 is coupled to the cleaner station 100, it is possible to prevent the dust from scattering.

Meanwhile, referring to FIG. 2, the cleaner station 100 according to the present disclosure may include the dust collecting part 170. The dust collecting part 170 may be disposed in the housing 110. The dust collecting part 170 may be disposed at a lower side in the gravitational direction of the coupling part 120. In addition, the dust collecting part 170 may be disposed at a lower side in the gravitational direction of the cover opening unit 150.

For example, the dust collecting part 170 may mean a dust bag for collecting dust sucked from the inside of the dust bin 220 of the first cleaner 200 by the dust collecting motor 200.

The dust collecting part 170 may be detachably coupled to the housing 110.

Therefore, the dust collecting part 170 may be separated from the housing 110 and discarded, a new dust collecting part 170 may be coupled to the housing 110. That is, the dust collecting part 170 may be defined as a consumable component.

When the suction force is generated by the dust collecting motor 200, a volume of the dust bag 310 is increased, such that the dust may be accommodated in the dust bag 310. To this end, the dust bag 310 may be made of a material that transmits air but does not transmit foreign substances such as dust. For example, the dust bag 310 may be made of a non-woven fabric material and have a hexahedral shape when the dust bag 310 has an increased volume.

Therefore, it is not necessary for the user to separately bind a bag in which the dust is captured, and as a result, it is possible to improve convenience for the user.

Meanwhile, the flow path part 180 will be described below with reference to FIGS. 2 and 16.

The cleaner station 100 may include the flow path part 180. The flow path part 180 may connect the first cleaner 200 or the second cleaner 300 to the dust collecting part 170.

The flow path part 180 may include the first flow path 181, a second flow path 182, and a flow path switching valve 183.

The first flow path 181 may connect the dust bin 220 of the first cleaner 200 to the dust collecting part 170. The first flow path 181 may mean a space between the dust bin 220 of the first cleaner 200 and the dust collecting part 170. The first flow path 181 may be a space formed at a rear side of the dust passage hole 121*a*. The first flow path 181 may be a flow path bent downward from the dust passage hole 121*a*, and the dust and the air may flow through the first flow path 181. The dust in the dust bin 220 of the first cleaner 200 may move to the dust collecting part 170 through the first flow path 181.

The second flow path 182 may connect the second cleaner 300 to the dust collecting part 170. The dust in the second cleaner 300 may move to the dust collecting part 170 through the second flow path 182.

The flow path switching valve 183 may be disposed between the dust collecting part 170, the first flow path 181, and the second flow path 182. The flow path switching valve 183 may selectively open or close the first flow path 181 and the second flow path 182 connected to the dust collecting part 170. Therefore, it is possible to prevent a decrease in suction force caused when the plurality of flow paths 181 and 182 is opened.

Meanwhile, the dust suction module 190 will be described below with reference to FIGS. 2 and 16.

The cleaner station 100 may include the dust suction module 190. The dust suction module 190 may include the dust collecting motor 191, a first filter 192, and a second filter (not illustrated).

The dust collecting motor 191 may be disposed below the dust collecting part 170. The dust collecting motor 191 may generate the suction force in the first flow path 181 and the second flow path 182. Therefore, the dust collecting motor 191 may provide the suction force capable of sucking the dust in the dust bin 220 of the first cleaner 200 and the dust in the second cleaner 300.

The dust collecting motor 191 may generate the suction force by means of the rotation. For example, the dust collecting motor 191 may be formed in a shape similar to a cylindrical shape.

The first filter 192 may be disposed between the dust collecting part 170 and the dust collecting motor 191. The first filter 192 may be a prefilter.

The second filter (not illustrated) may be disposed between the dust collecting part 170 and the dust collecting motor 191. The second filter 193 may be an HEPA filter. Alternatively, the second filter (not illustrated) may be disposed between the dust collecting motor 191 and the outer wall surface 112 or between the dust collecting motor 191 and the bottom surface 111.

Meanwhile, in the present embodiment, an imaginary balance maintaining space R1 may perpendicularly extend from the ground surface and penetrate the dust collecting part 170 and the dust suction module 190. For example, the balance maintaining space R1 may be an imaginary space perpendicularly extending from the ground surface, and the dust collecting motor 191 at least may be accommodated in the balance maintaining space R1. That is, the balance maintaining space R1 may be an imaginary cylindrical shape space that accommodates the dust collecting motor 191 therein.

In this case, in the present disclosure, the imaginary extension surface of the imaginary plane S1 penetrates the balance maintaining space R1. With this configuration, the cleaner station 100 may stably maintain the balance in the state in which the first cleaner 200 is mounted on the cleaner station 100 according to the present disclosure.

Meanwhile, the arrangement of the first cleaner 200, the first flow path 181, the dust collecting part 170, and the dust suction module 190 in the state in which the first cleaner 200 is coupled to the cleaner station 100 will be described below with reference to FIGS. 2 to 6. When the first cleaner 200 is mounted on the cleaner station 100, the axis of the dust bin 220 having a cylindrical shape may be disposed in parallel with the ground surface. Further, the dust bin 220 may be disposed to be perpendicular to the first outer wall surface 112*a* and the coupling surface 121. That is, the dust bin axis a5 may be disposed to be perpendicular to the first outer wall surface 112*a* and the coupling surface 121 and disposed in parallel with the ground surface. In addition, the dust bin axis a5 may be disposed to be perpendicular to the axis of the balance maintaining space R1.

Further, when the first cleaner 200 is mounted on the cleaner station 100, the extension tube 250 may be disposed in the direction perpendicular to the ground surface. Further, the extension tube 250 may be disposed in parallel with the first outer wall surface 112*a*. That is, the suction flow path centerline a2 may be disposed in parallel with the first outer wall surface 112*a* and disposed to be perpendicular to the ground surface. In addition, the suction flow path centerline a2 may be disposed in parallel with the axis of the balance maintaining space R1.

Meanwhile, when the first cleaner 200 is mounted on the cleaner station 100, at least a part of the outer circumferential surface of the dust bin 220 may be surrounded by the dust bin guide surface 122. The first flow path 181 may be disposed at the rear side of the dust bin 220 and communicate with the first flow path 181 when the dust bin 220 is opened. Further, the first flow path 181 may be bent downward from the dust bin 220. In addition, the dust collecting part 170 may be disposed at the lower side of the first flow path 181. Further, the dust suction module 190 may be disposed at the lower side of the dust collecting part 170.

Therefore, according to the present disclosure, the first cleaner 200 may be mounted on the cleaner station 100 in the state in which the extension tube 250 and the cleaning module 260 are mounted. Further, it is possible to minimize an occupied space on the horizontal plane even in the state in which the first cleaner 200 is mounted on the cleaner station 100.

In addition, according to the present disclosure, since the first flow path 181, which communicates with the dust bin 220, is bent downward only once, it is possible to minimize a loss of flow force for collecting the dust.

Further, according to the present disclosure, in the state in which the first cleaner 200 is mounted on the cleaner station 100, the outer circumferential surface of the dust bin 220 is surrounded by the dust bin guide surface 122, and the dust bin 220 is accommodated in the coupling part 120. As a result, the dust in the dust bin is invisible from the outside.

The cleaner station 100 may include the charging part 128. The charging part 128 may be disposed on the coupling part 120. Specifically, the charging part 128 may be disposed on the coupling surface 121. In this case, the charging part 128 may be positioned at a position facing a charging terminal provided on the battery 240 of the first cleaner 200. The charging part 128 may be electrically connected to the first cleaner 200 coupled to the coupling part 120. The charging part 128 may supply power to the battery 240 of the first cleaner 200 coupled to the coupling part 120. That is, when the first cleaner 200 is physically coupled to the coupling surface 121, the charging part 128 may be electrically coupled to the first cleaner 200.

In addition, the charging part 128 may include a lower charging part (not illustrated) disposed in a lower region of the housing 110. The lower charging part may be electrically connected to the second cleaner 300 coupled to the lower region of the housing 110. A second charger may supply power to the battery of the second cleaner 300 coupled to the lower region of the housing 110.

The cleaner station 100 may include a dust collecting part door (not illustrated). The dust collecting part door may be disposed in the housing 110. Therefore, the user may easily remove the dust collecting part 170 from the cleaner station 100.

Figure 16:
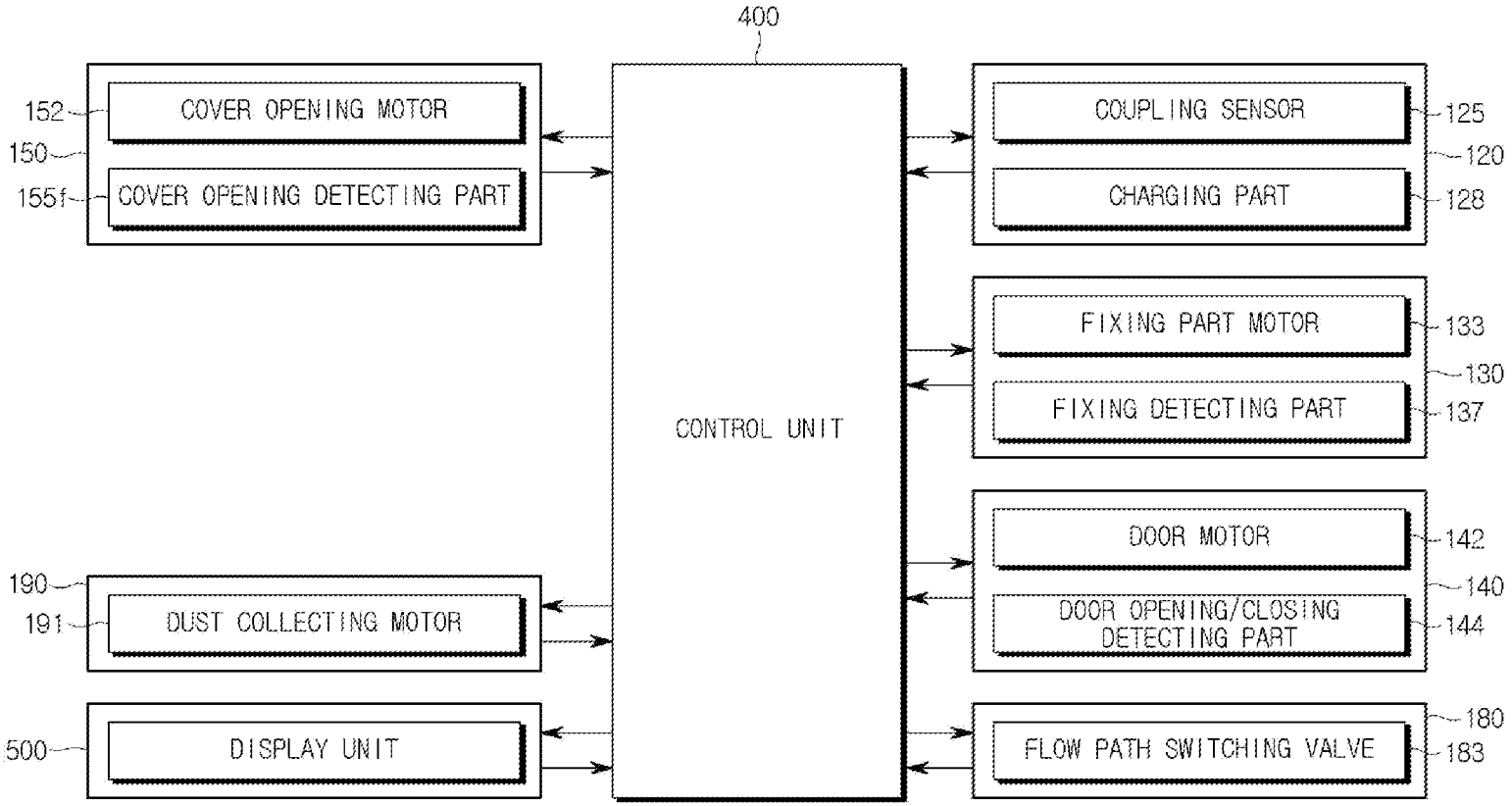
FIG. 16 is a block diagram for explaining a control configuration of the cleaner station according to the embodiment of the present disclosure.

Meanwhile, FIG. 16 is a block diagram for explaining a control configuration of the cleaner station according to the embodiment of the present disclosure.

The control configuration according to the present disclosure will be described below with reference to FIG. 16.

The cleaner station 100 according to the embodiment of the present disclosure may further include the control unit 400 configured to control the coupling part 120, the fixing unit 130, the door unit 140, the cover opening unit 150, the dust collecting part 170, the flow path part 180, the dust suction module 190, and the display unit 500.

The control unit 400 may include a printed circuit board and elements mounted on the printed circuit board.

When the coupling sensor 125 detects the coupling of the first cleaner 200, the coupling sensor 125 may transmit a signal indicating that the first cleaner 200 is coupled to the coupling part 120. In this case, the control unit 400 may receive the signal from the coupling sensor 125 and determine that the first cleaner 200 is physically coupled to the coupling part 120.

In addition, when the charging part 128 supplies power to the battery 240 of the first cleaner 200, the control unit 400 may determine that the first cleaner 200 is electrically coupled to the coupling part 120.

Therefore, when the control unit 400 determines that the first cleaner 200 is physically and electrically coupled to the coupling part 120, the control unit 400 may determine that the first cleaner 200 is coupled to the cleaner station 120.

When the control unit 400 determines that the first cleaner 200 is coupled to the coupling part 120, the control unit 400 may operate the fixing part motor 133 to fix the first cleaner 200.

The control unit 400 may receive the signal, which indicates that the first cleaner 200 is fixed, from the fixing detecting part 137, and determine that the first cleaner 200 is fixed. When the control unit 400 determines that the first cleaner 200 is fixed, the control unit 400 may stop the operation of the fixing part motor 133.

Meanwhile, when the operation of emptying the dust bin 200 is ended, the control unit 400 may rotate the fixing part motor 133 in the reverse direction to release the first cleaner 200.

When the control unit 400 determines that the first cleaner 200 is fixed to the coupling part 120, the control unit 400 may operate the door motor 142 to open the door 141 of the cleaner station 100.

When the door 141 or the door arm 143 reaches the predetermined opened position DP1, the door opening/closing detecting part 144 may transmit a signal indicating that the door 141 is opened. The control unit 400 may receive the signal, which indicates that the door 141 is opened, from the door opening/closing detecting part 137 and determine that the door 141 is opened. When the control unit 400 determines that the door 141 is opened, the control unit 400 may stop the operation of the door motor 142.

Meanwhile, when the operation of emptying the dust bin 200 is ended, the control unit 400 may rotate the door motor 142 in the reverse direction to close the door 141.

When the control unit 400 determines that the door 141 is opened, the control unit 400 may operate the cover opening motor 152 to open the discharge cover 222 of the first cleaner 200. As a result, the dust passage hole 121*a* may communicate with the inside of the dust bin 220. Therefore, the cleaner station 100 and the first cleaner 200 may be coupled to each other to enable a flow of a fluid (coupling of the flow path).

The control unit 400 may control the flow path switching valve 183 of the flow path part 180. For example, the control unit 400 may selectively open or close the first flow path 181 and the second flow path 182.

The control unit 400 may operate the dust collecting motor 191 to suck the dust in the dust bin 220.

The control unit 400 may operate a display unit 500 to display a dust bin emptied situation and a charged situation of the first cleaner 200 or the second cleaner 300.

Meanwhile, the cleaner station 100 according to the present disclosure may include the display unit 500.

The display unit 500 may be disposed on the housing 110. For example, the display unit 500 may be disposed on the upper surface 113. Meanwhile, the display unit 500 may be disposed on a separate display device or a terminal such as a mobile phone.

The display unit 500 may be configured to include at least any one of a display panel capable of outputting letters and/or figures and a speaker capable of outputting voice signals and sound. The user may easily ascertain the current operation, a state of charge of the cleaner, a degree to which a dust bag is filled with dust, and the like on the basis of information outputted through the display unit 500.

Figure 17:
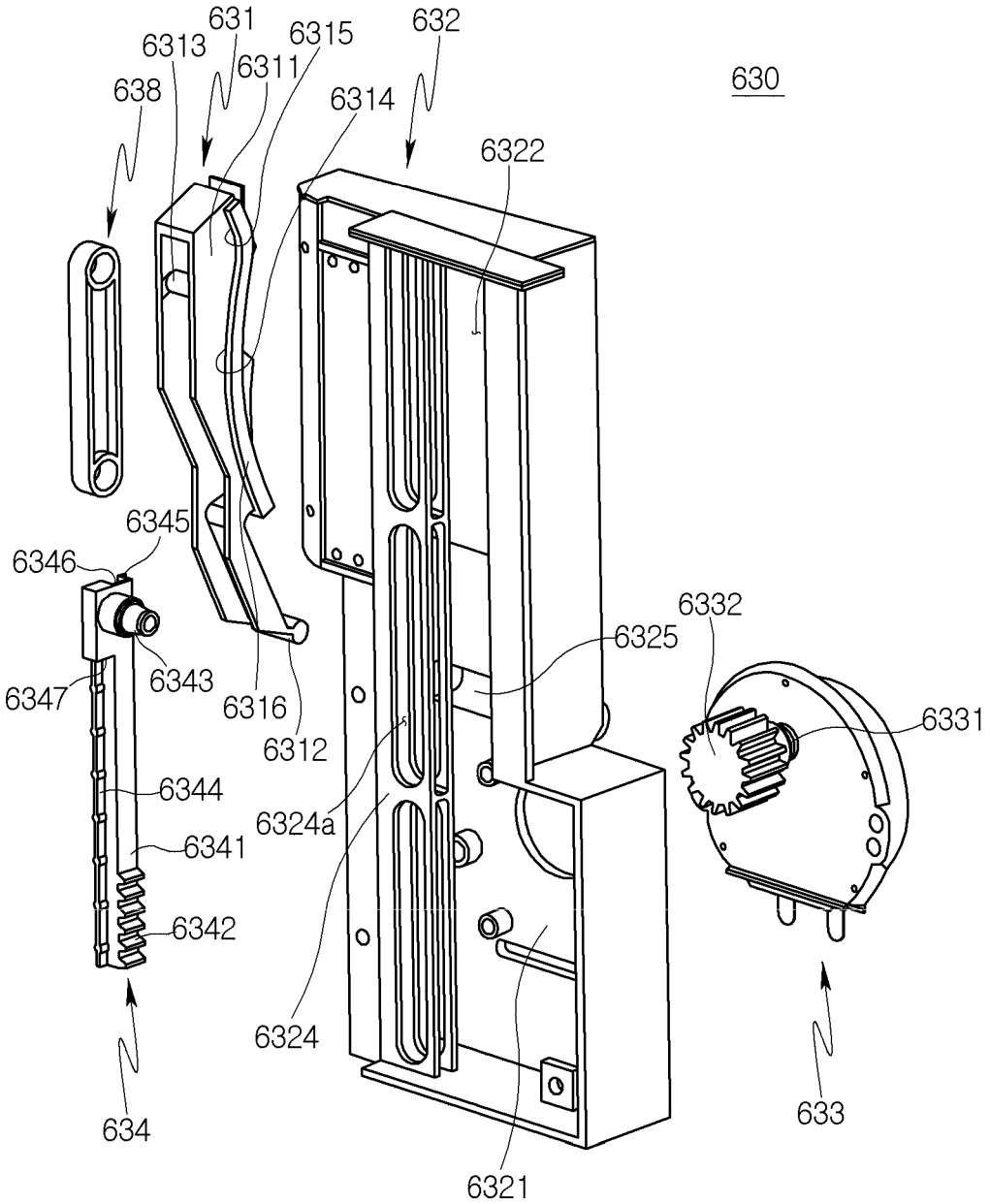
FIG. 17 is an exploded perspective view for explaining a fixing unit of a cleaner station according to a second embodiment of the present disclosure.
Figure 18:
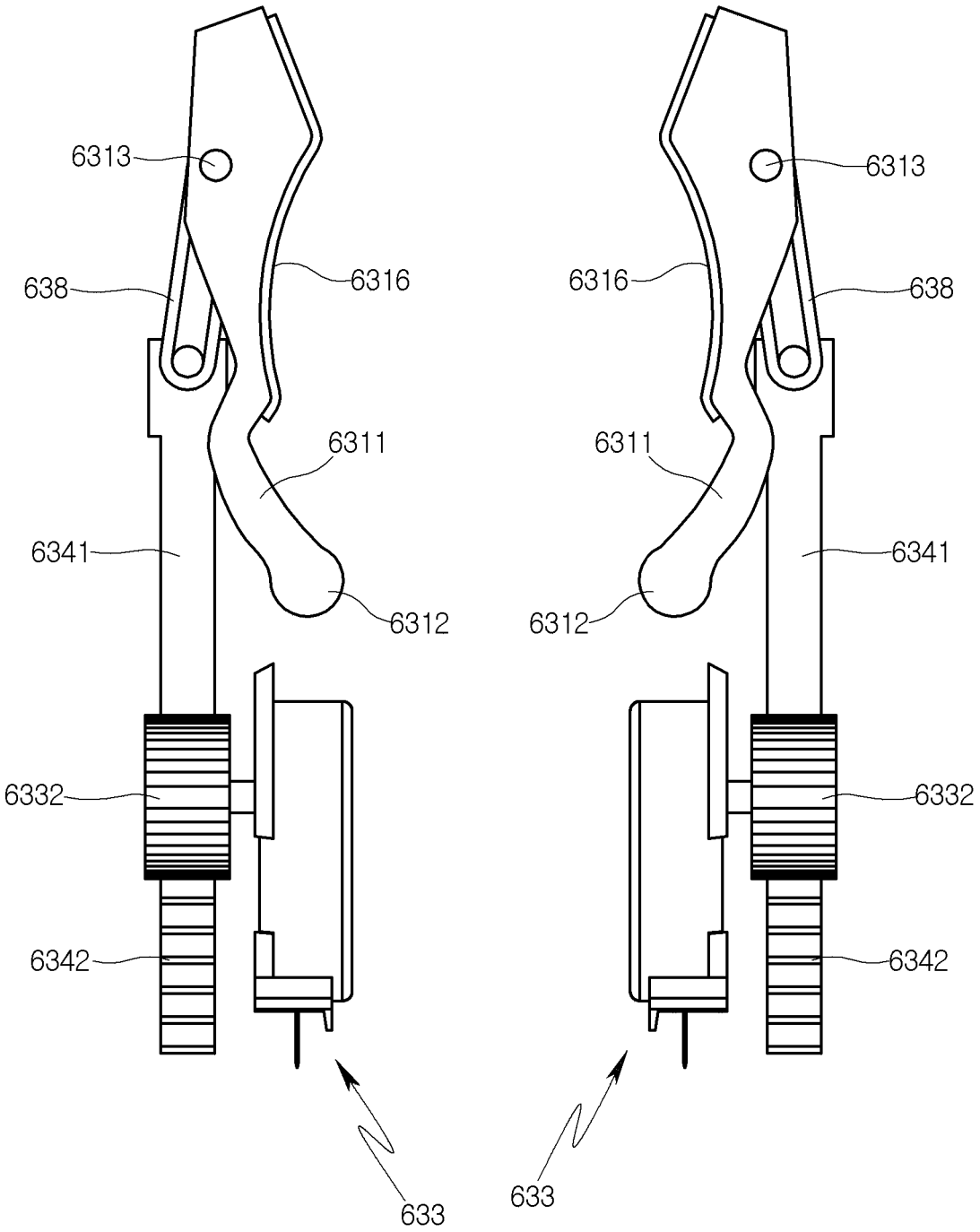
FIG. 18 is a view for explaining a state before the fixing unit in the cleaner station according to the second embodiment of the present disclosure.
Figure 19:
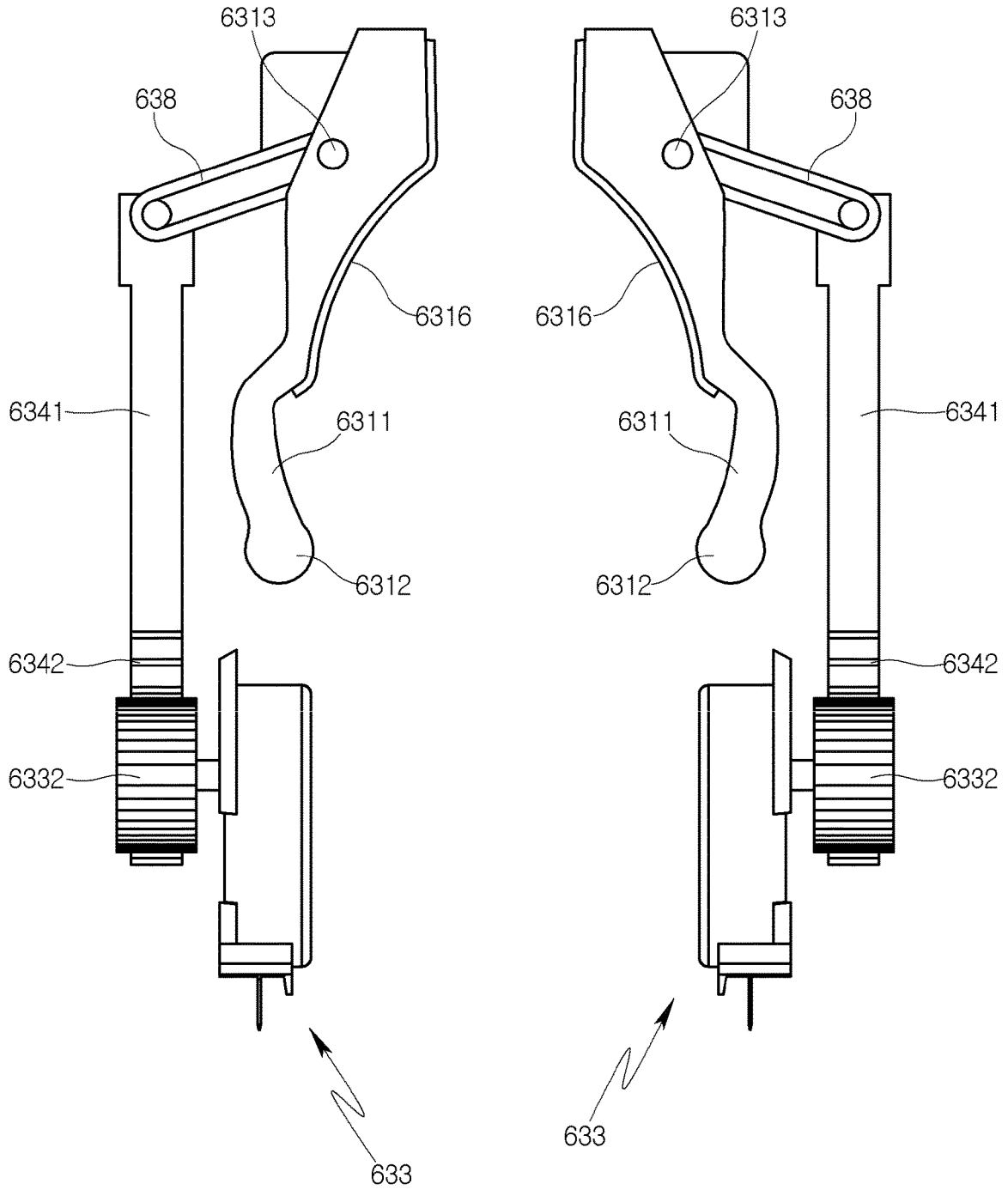
FIG. 19 is a view for explaining a state in which a second power transmission member is moved in the cleaner station according to the second embodiment of the present disclosure.
Figure 20:
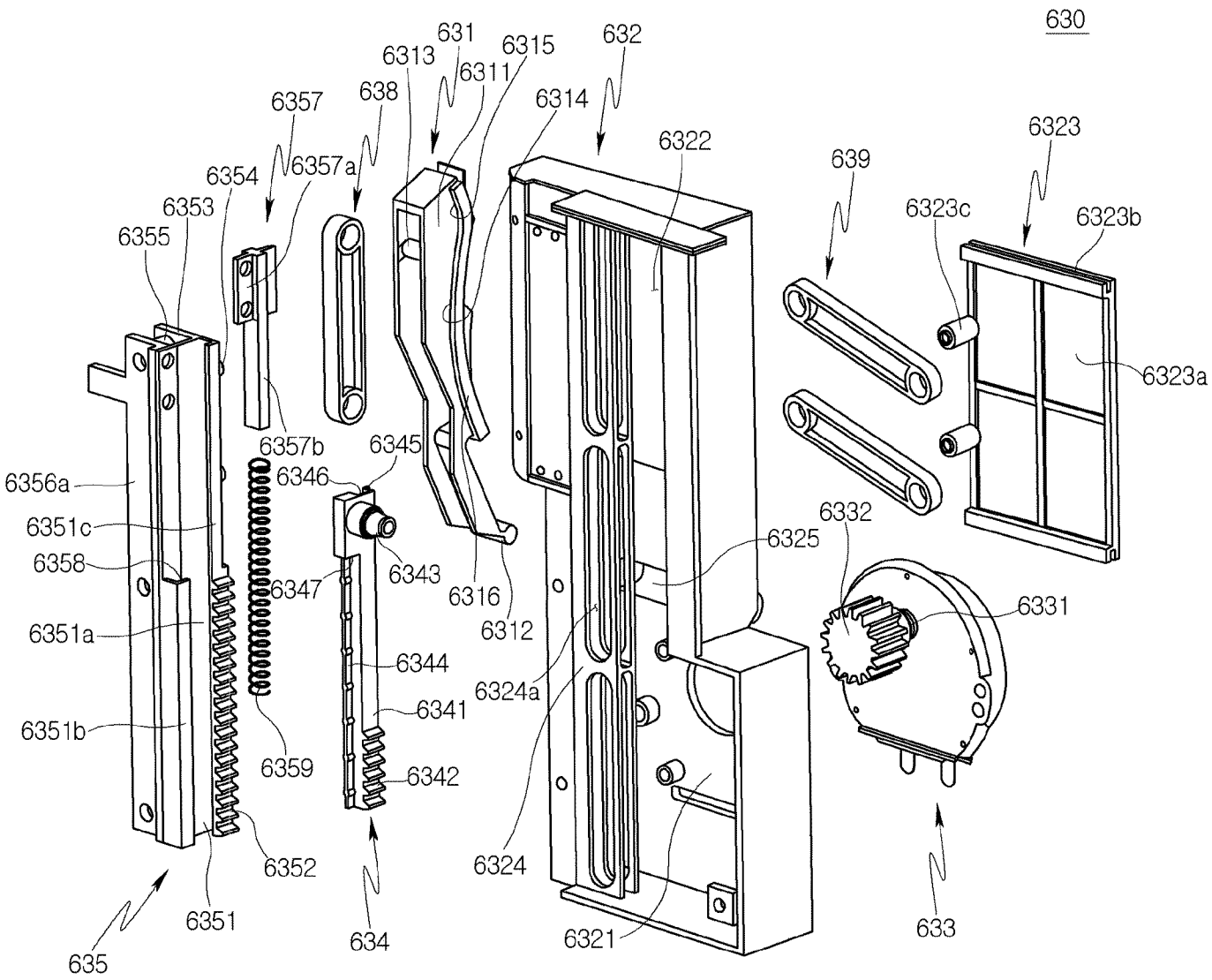
FIG. 20 is an exploded perspective view for explaining a fixing unit of a cleaner station according to a third embodiment of the present disclosure.
Figure 21:
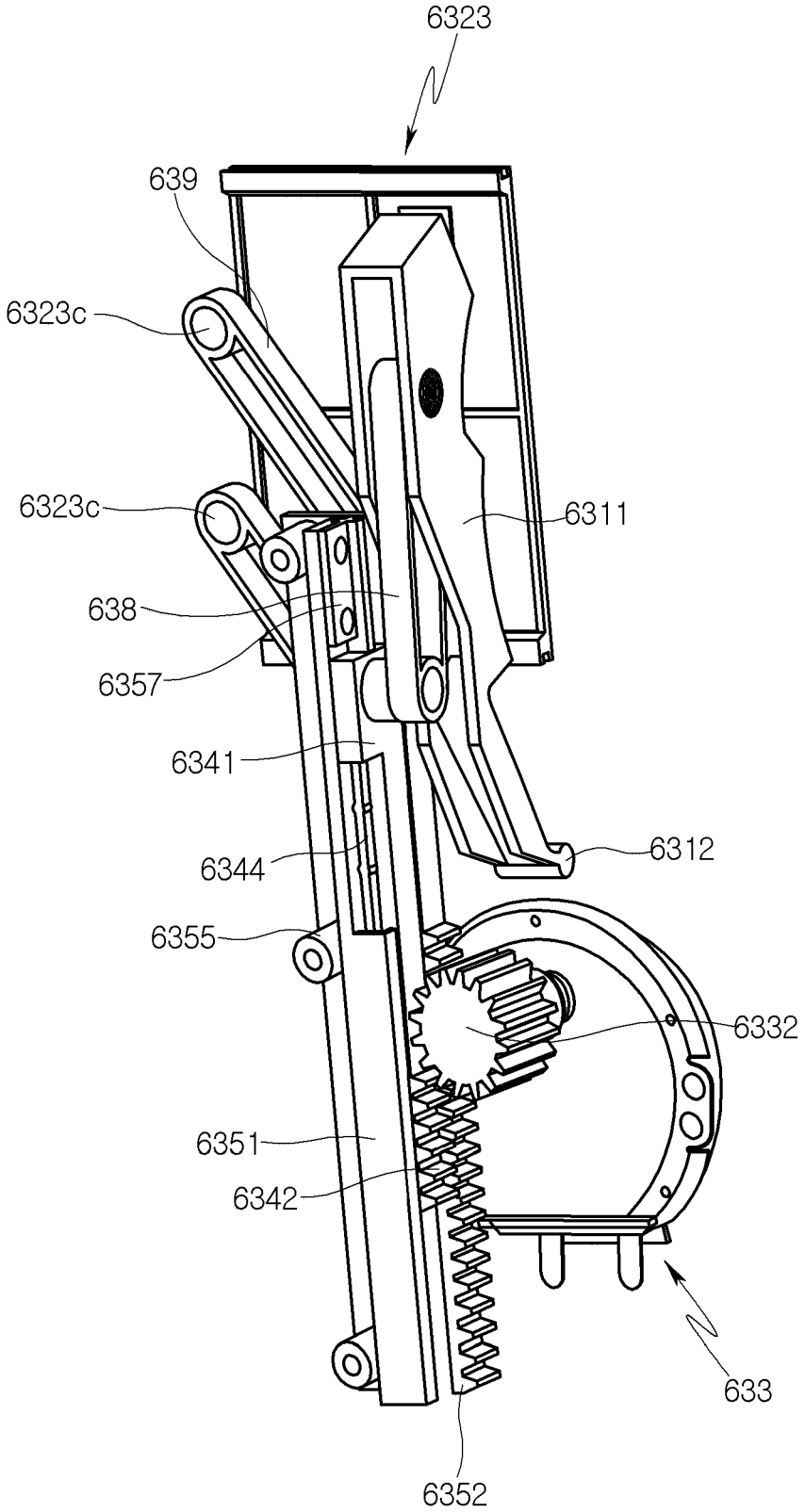
FIG. 21 is a view for explaining a state before the fixing unit according to the third embodiment of the present disclosure operates.
Figure 22:
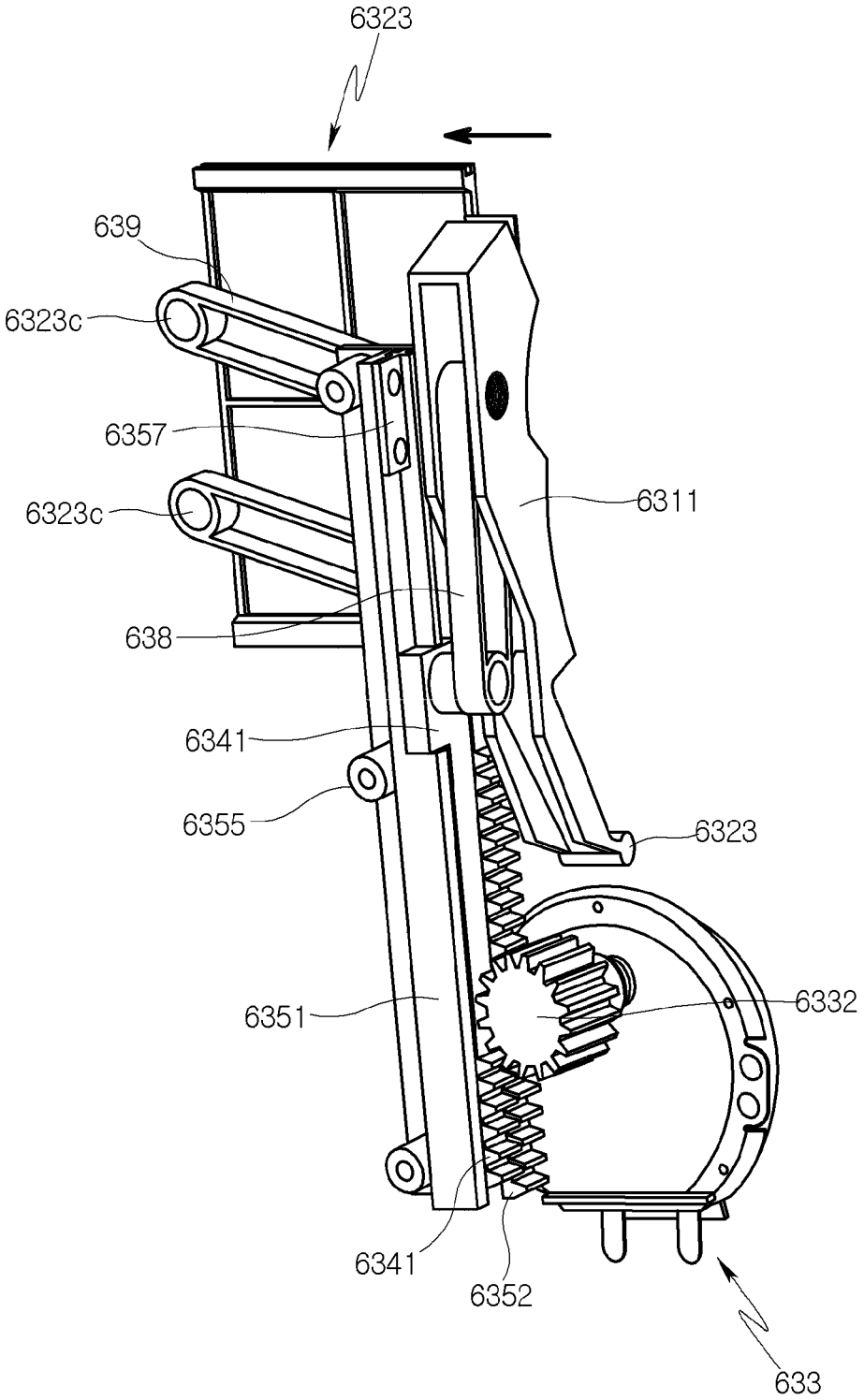
FIG. 22 is a view for explaining a state in which only a third power transmission member of the fixing unit according to the third embodiment of the present disclosure is moved.
Figure 23:
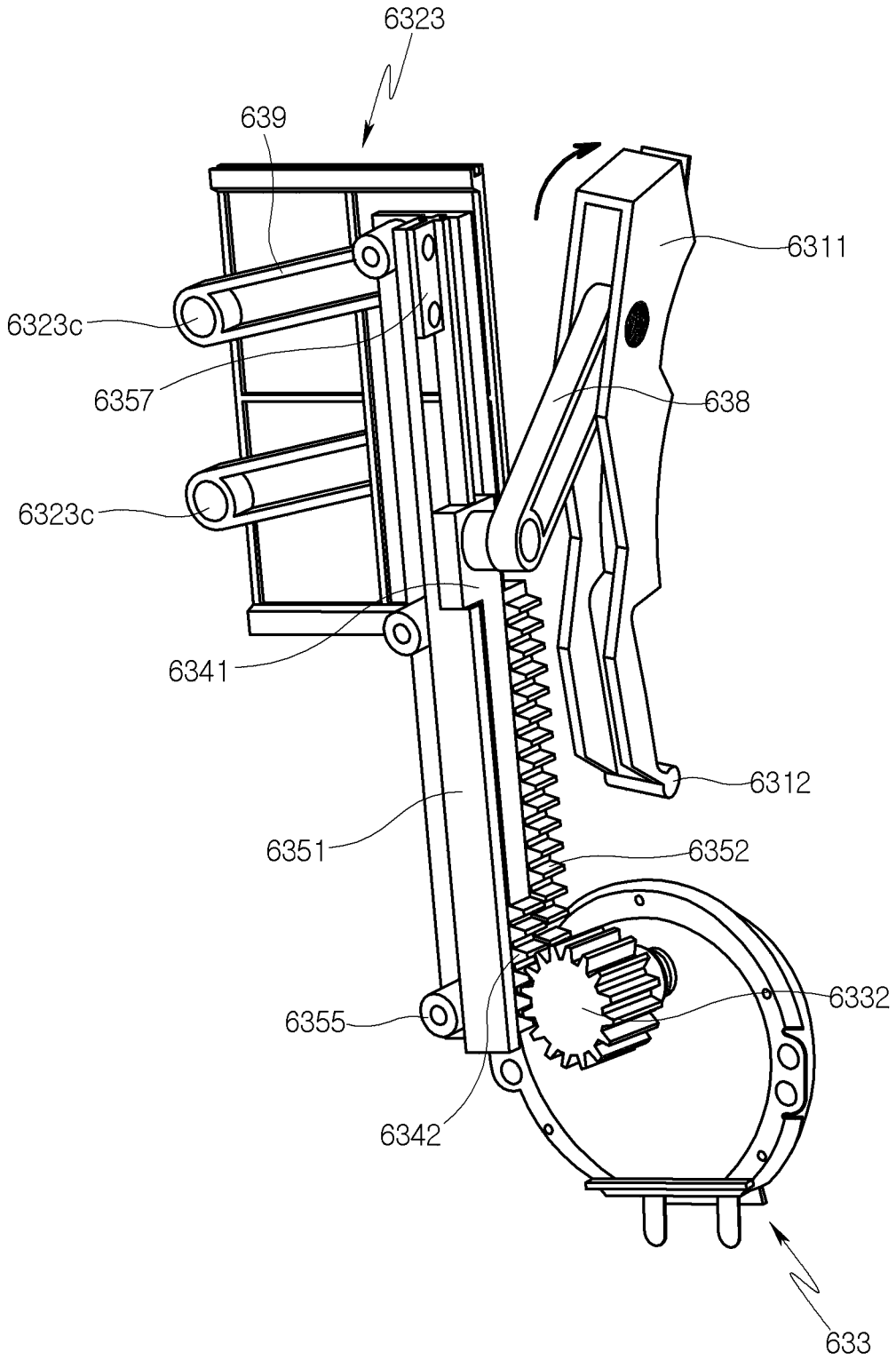
FIG. 23 is a view for explaining a state in which both the second power transmission member and the third power transmission member of the fixing unit according to the third embodiment of the present disclosure are moved.
Figure 24:
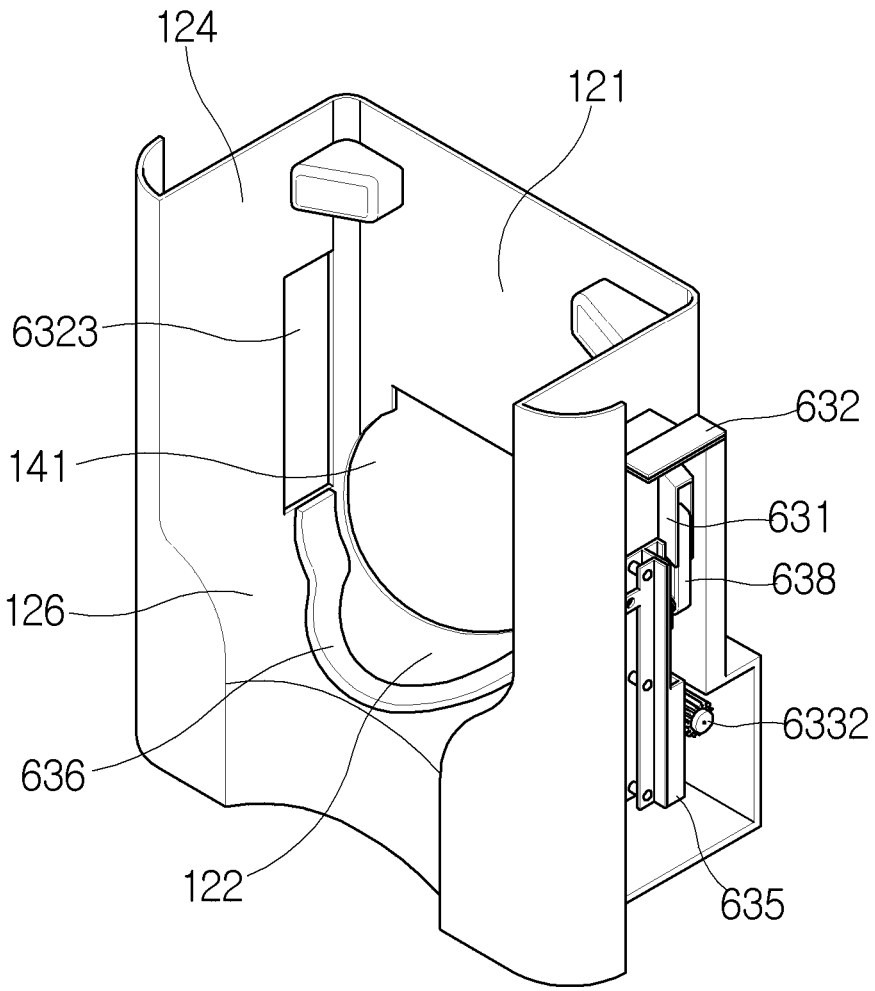
FIG. 24 is a view for explaining a state in which the fixing unit according to the second and third embodiments of the present disclosure is mounted on the coupling part.
Figure 25:
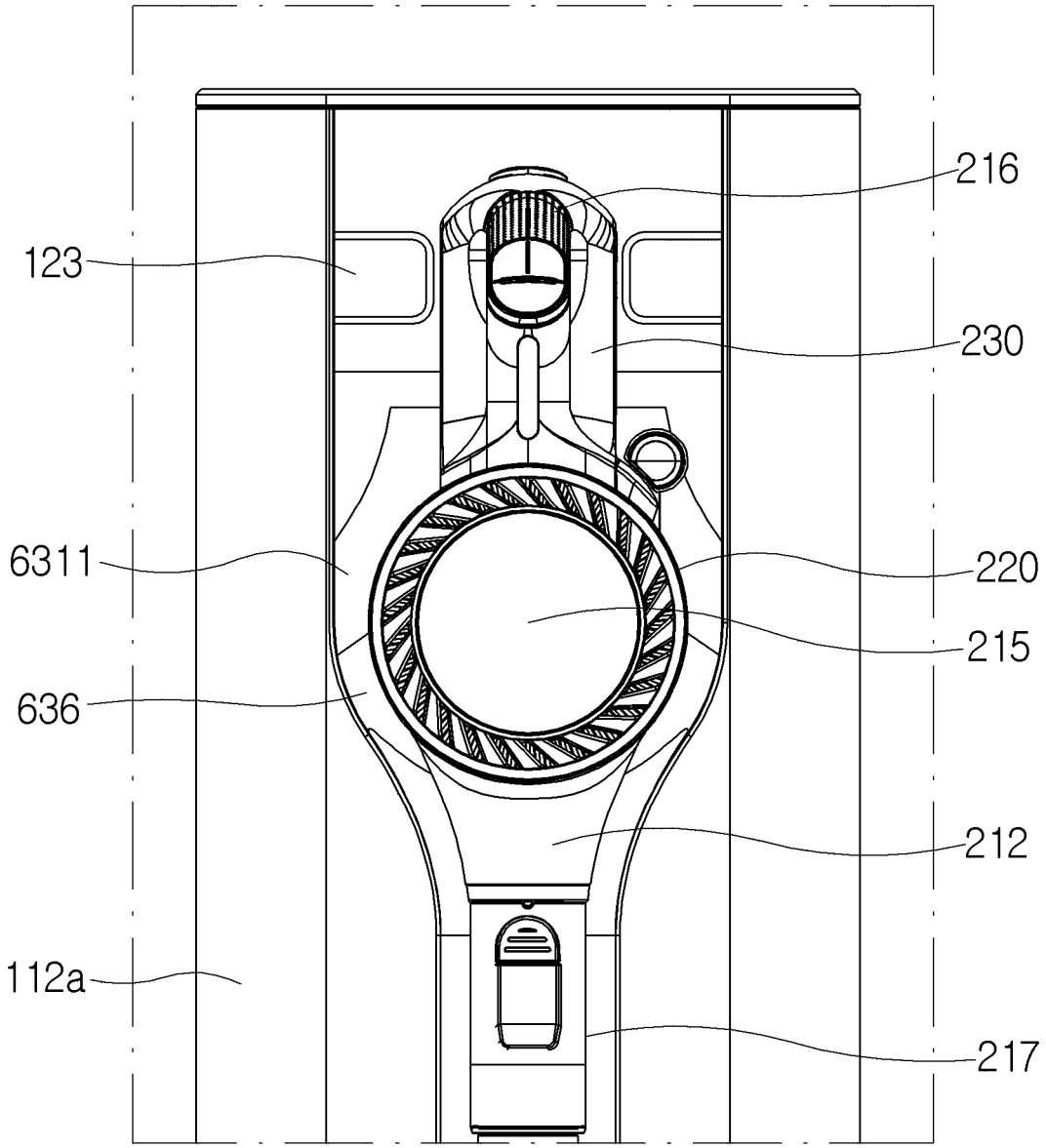
FIG. 25 is a view for explaining a state in which the first cleaner is fixed to the cleaner station according to the second and third embodiments of the present disclosure.
Figure 26:
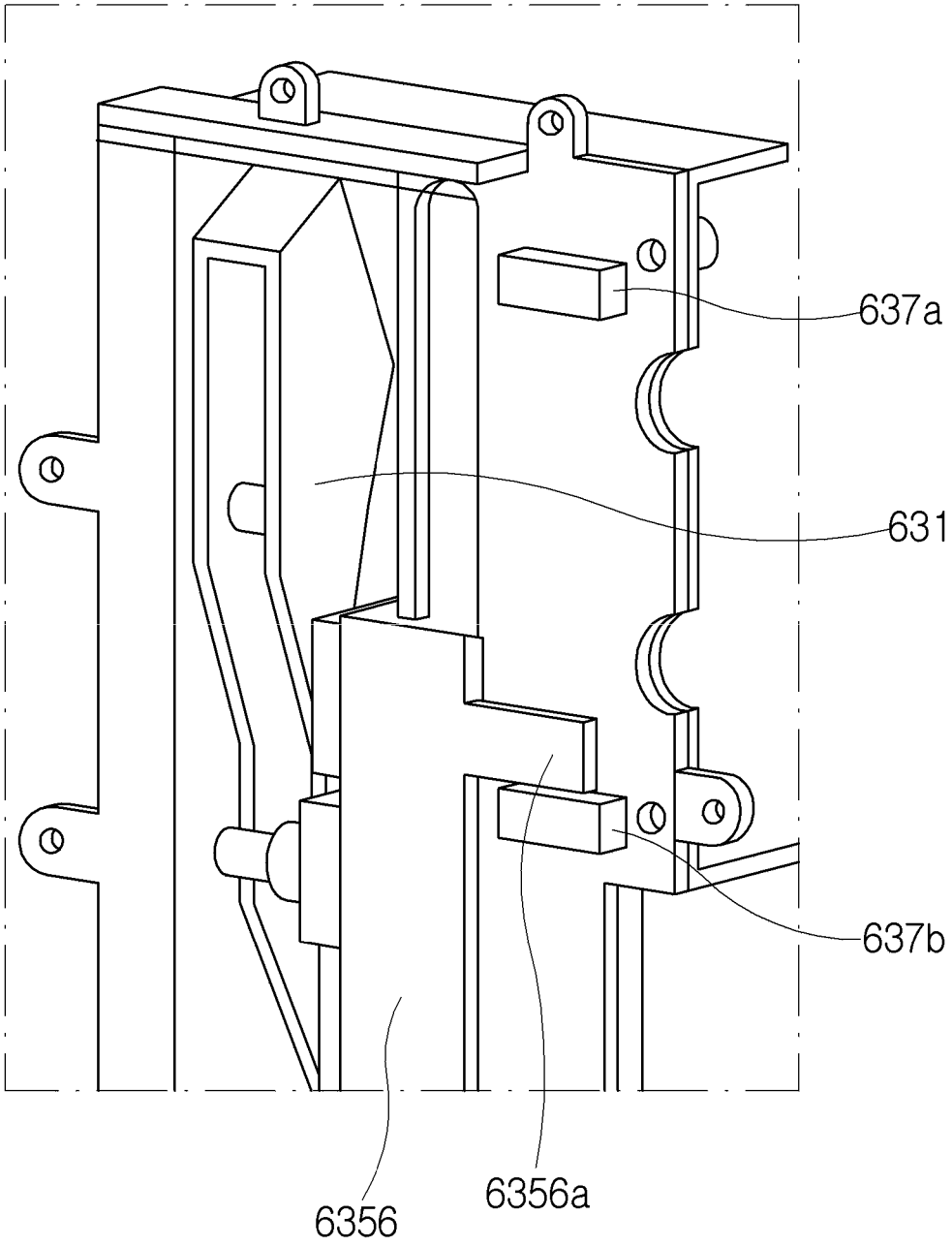
FIG. 26 is a view for explaining a position of a fixing detecting part of the cleaner station according to the second and third embodiments of the present disclosure.

Meanwhile, FIG. 17 is an exploded perspective view for explaining a fixing unit of a cleaner station according to a second embodiment of the present disclosure, FIGS. 18 and 19 are views for explaining a process of operating the fixing unit of the cleaner station according to the second embodiment of the present disclosure, FIG. 20 is an exploded perspective view for explaining the fixing unit of the cleaner station according to a third embodiment of the present disclosure, FIGS. 21 to 23 are views for explaining a process of operating the fixing unit according to the third embodiment of the present disclosure, FIG. 24 is a view for explaining a state in which the fixing unit according to the second and third embodiment of the present disclosure is mounted on the coupling part, FIG. 25 is a view for explaining a state in which the first cleaner is fixed to the cleaner station according to the second and third embodiments of the present disclosure, and FIG. 26 is a view for explaining a position of the fixing detecting part in the cleaner station according to the second and third embodiments of the present disclosure.

A fixing unit 630 according to a second embodiment of the present disclosure will be described below with reference to FIGS. 17 to 26.

The cleaner station 100 according to the present disclosure may include the fixing unit 630. The fixing unit 630 may be coupled to the sidewall 124. For example, the fixing units 630 may be respectively coupled to the sidewalls 124 that face each other. In this case, the fixing units 630 may be disposed to be symmetric to each other.

The fixing unit 630 may fix the first cleaner 200 coupled to the coupling surface 121. Specifically, the fixing unit 630 may fix the dust bin 220 and the battery housing 230 of the first cleaner 200 coupled to the coupling surface 121.

The fixing unit 630 according to the first embodiment of the present disclosure will be described below.

The fixing unit 630 may include fixing members 631, fixing part casings 632, fixing part motors 633, second power transmission members 634, a stationary sealer 636, fixing detecting parts 637, and fixing part links 638.

The fixing unit 630 may include the fixing members 631 that move toward the dust bin 220 from the outside of the dust bin 220 to fix the dust bin 220 when the first cleaner 200 is coupled to the coupling part 110.

The fixing member 631 may include a sealing frame 6311, a hinge portion 6312, a link coupling portion 6313, a first pressing portion 6314, a second pressing portion 6315, and a movable sealer 6316.

The sealing frame 6311 may mean a frame or plate that rotates toward the dust bin 220 from the outside of the dust bin 220 by power of the fixing part motor 633 when the dust bin 220 of the first cleaner 200 is coupled to the coupling part 120.

For example, the sealing frame 6311 may have, but not limited to, a structure in which a pair of facing flat plates and a connection plate for connecting the pair of facing flat plates are integrated. That is, the sealing frame 6311 may include various shapes capable of surrounding the dust bin 220.

Meanwhile, the hinge portion 6312 may be provided at one end of the sealing frame 6311 so that the sealing frame 6311 is rotated by the power transmitted from the fixing part motor 633. The link coupling portion 6313 may be provided at the other side of the sealing frame 6311.

The hinge portion 6312 may be provided at one end of the sealing frame 6311 and rotatably coupled to the fixing part casing 632.

For example, the hinge portion 6312 may be provided in the form of a circular rod on the sealing frame 6311 and fitted with and coupled to a hinge groove 6325 of the fixing part casing 632.

With this configuration, the hinge portion 6312 may serve as a rotation axis about which the fixing member 631 is rotated by the power transmitted from the fixing part motor 633.

The link coupling portion 6313 may be coupled to the sealing frame 6311, and the fixing part link 638 may be rotatably coupled to the link coupling portion 6313.

For example, the link coupling portion 6313 may have a cylindrical shape and be fitted with and coupled to the sealing frame 6311. In this case, the link coupling portion 6313 may be disposed at a position spaced apart from the hinge portion 6312 at a predetermined interval. That is, when the hinge portion 6312 is disposed at one side based on a middle point of a length in a major axis direction of the sealing frame 6311, the link coupling portion 6313 may be disposed at the other side based on the middle point.

With this configuration, it is possible to increase a force for pressing the dust bin 220 using the power transmitted from the fixing part motor 633 and effectively press the dust bin 220.

The fixing member 631 is provided on the sidewall 124 of the coupling part 120 so as to reciprocatingly move toward the dust bin 220. The fixing member 631 may include the first pressing portion 6314 formed to correspond to the shape of the dust bin 220.

For example, the first pressing portion 6314 may be a surface of the sealing frame 6311 disposed toward the dust bin 220. In addition, the first pressing portion 6314 may be a surface having a predetermined curvature corresponding to the shape of the dust bin 220.

In addition, the fixing member 631 may include the second pressing portion 6315 connected to the first pressing portion 6314 and formed to correspond to the shape of the battery housing 230 of the first cleaner 200.

For example, the second pressing portion 6315 may be a surface of the sealing frame 6311 disposed toward the dust bin 220 and connected to the first pressing portion 6314. In addition, the second pressing portion 6315 may be provided in the form of a rectangular flat surface corresponding to the shape of the battery housing 230.

The fixing member 631 may include the movable sealer 6316 disposed on the surface of the first pressing portion 6314 directed toward the dust bin 220, and the movable sealer 6316 may seal the dust bin 220. In this case, the movable sealer 6316 may be provided not only on the first pressing portion 6314, but also on the second pressing portion 6315.

This configuration may prevent a space from being formed between the dust bin 220 and the fixing member 631 when the fixing members 631 rotate and surround the dust bin 220. Further, this configuration may prevent the dust in the dust bin 220 from scattering to the outside of the cleaner station 100 when the dust is sucked by the dust collecting motor 191.

The fixing unit 630 may include the fixing part casing 632 coupled to the sidewall 124, and the fixing member 631 may be rotatably coupled to the fixing part casing 632.

The fixing part casing 632 may include a casing main body 6321 capable of accommodating the fixing member 631 therein.

For example, the casing main body 6321 may be provided in the form of a polygonal basket capable of accommodating the fixing member 631 therein. In this case, the casing main body 6321 may be provided in the form of a basket opened at a side thereof in a direction opposite to the direction in which the sidewall 124 is disposed.

The fixing part casing 632 may include a shutter hole 6322 formed in the casing main body 6321 and configured to communicate with the fixing member entrance hole 127 and allow the fixing member 631 to pass therethrough while reciprocatingly moving.

For example, the shutter hole 6322 may be a quadrangular hole. In addition, at least a part of the shutter hole 6322 may communicate with the fixing member entrance hole 127.

That is, an area of the shutter hole 6322 may be larger than an area of the fixing member entrance hole 127. A part of a space of the shutter hole 6322 may overlap a space of the fixing member entrance hole 127.

With this configuration, the fixing member 631 may be positioned in the internal space of the cleaner station 100, which is surrounded by the sidewall 124 and the housing 110, before the first cleaner 200 is coupled to the coupling part 120. After the first cleaner 200 is coupled to the coupling part 120, the fixing member 631 may pass through the shutter hole 6322 and the fixing member entrance hole 127 and move to the position at which the fixing member 631 may press the dust bin 220.

The fixing part casing 632 may include a casing cover 6324 coupled to the casing main body 6321 and configured to guide the rectilinear movement of the second power transmission member 634.

For example, although not illustrated, the casing cover 6324 may have grooves each provided in the form of a rail, and guide ribs 6344 and 6345 of the second power transmission member 634 may be rectilinearly movably coupled to the grooves.

The fixing part casing 632 may include a hinge groove 6325 formed in the casing main body 6321 and hingedly coupled to the fixing member 631.

For example, the hinge groove 6325 may be formed by recessing a part of a surface of the casing main body 6321 in a direction toward the sidewall 124. In this case, a width of an opening of the hinge groove 6325 may be smaller than a diameter of the hinge portion 6312, and an inner diameter of the recessed hinge groove 6325 may be equal to or larger than a diameter of the hinge portion 6312.

With this configuration, the rod-shaped hinge portion 6312 may be fitted with the hinge groove 6325 and rotated. The fixing member 631 may fix the dust bin 220 by rotating about the hinge portion 6312.

The fixing part motor 633 may provide power for moving the fixing member 631. Specifically, the fixing part motor 633 may rotate a first power transmission member 6332 in a forward direction or a reverse direction. In this case, the forward direction may mean a direction in which the fixing member 631 is moved from the inside of the sidewall 124 to press the dust bin 220. In addition, the reverse direction may mean a direction in which the fixing member 631 is moved to the inside of the sidewall 124 from a position at which the fixing member 631 presses the dust bin 220. The forward direction may be opposite to the reverse direction.

The fixing part motor 633 may be coupled to the first power transmission member 6332 through a shaft 6331, and the power of the fixing part motor 633 may be transmitted to the first power transmission member 6332. That is, the first power transmission member 6332 may rotate using the power of the fixing part motor 633. For example, the first power transmission member 6332 may be a kind of pinion gear coupled to the fixing part motor 633.

The second power transmission member 634 may engage with the first power transmission member 6332 and convert a rotational force of the fixing part motor 633 into a rectilinear movement. For example, the second power transmission member 634 may be a rack gear.

The second power transmission member 634 may include a gear frame 6341 which is rectilinearly moved by the rotational force of the fixing part motor 633.

The gear frame 6341 may be a frame formed in a direction (gravitational direction) perpendicular to the ground surface. First gear teeth 6342 are formed at one side (a lower side) in the gravitational direction of the gear frame 6341, and a second power transmission member pin 6343 may protrude at the other side (an upper side) in the gravitational direction of the gear frame 6341. In addition, the first guide rib 6344 and the second guide rib 6345 may protrude and extend from the gear frame 6341. Further, a spring accommodation groove 6346 may be formed in a back surface of the gear frame 6341 opposite to the surface on which the second power transmission member pin 6343 is formed. In addition, at the upper side of the gear frame 6341, a catching projection 6347 may be formed with a level difference from the first guide rib 6344.

The first gear teeth 6342 may be formed on the gear frame 6341 and engage with the first power transmission member 6332.

For example, the first gear teeth 6342 may be formed in an area corresponding to a predetermined length from a lower end in the gravitational direction of the gear frame 6341 in a major axis direction of the gear frame 6341.

The second power transmission member pin 6343 may protrude from the gear frame 6341 and be rotatably coupled to the fixing part link 638.

For example, the second power transmission member pin 6343 may have a cylindrical shape and be formed at the upper side in the gravitational direction of the gear frame 6341. In this case, the second power transmission member pin 6343 and the first gear teeth 6342 may be formed on the same plane on the gear frame 6341.

The guide ribs 6344 and 6345 may extend from the gear frame 6341 and slidably coupled to the fixing part casing 632.

Meanwhile, in the present embodiment, the guide ribs 6344 and 6345 are slidably coupled directly to the fixing part casing 632, but the present disclosure is not limited thereto. As another embodiment, the guide ribs 6344 and 6345 may be slidably coupled to a third power transmission member 635 to be described below, and the third power transmission member 635 may be slidably coupled to the fixing part casing 632.

The guide ribs 6344 and 6345 may include a first guide rib 6344 and a second guide rib 6345. For example, the first guide rib 6344 and the second guide rib 6345 may protrude from two lateral surfaces of the gear frame 6341 in the direction perpendicular to the ground surface, and a length along which the second guide rib 6345 is formed may be longer than a length along which the first guide rib 6344 is formed. In this case, an upper end in the gravitational direction of the first guide rib 6344 may be connected to the catching projection 6347.

With this configuration, when the fixing part motor 633 operates, the second power transmission member 634 rectilinearly moves, and the second power transmission member pin 6343 may rotate the fixing part link 638.

The stationary sealer 636 may be disposed on the dust bin guide surface 122 so as to seal the dust bin 220 when the first cleaner 200 is coupled. With this configuration, when the dust bin 220 of the cleaner 200 is coupled, the cleaner 200 may press the stationary sealer 636 by its own weight, such that the dust bin 220 and the dust bin guide surface 122 may be sealed.

The stationary sealer 636 may be disposed in imaginary extension lines of the movable sealers 6316. With this configuration, when the fixing part motor 633 operates and the fixing members 631 press the dust bin 220, a circumference of the dust bin 220 at the same height may be sealed. That is, the stationary sealer 636 and the movable sealers 6316 may seal the outer circumferential surfaces of the dust bin 220 disposed on concentric circles.

According to the embodiment, the stationary sealer 636 may be disposed on the dust bin guide surface 122 and formed in the form of a bent line or a curved line corresponding to an arrangement of the cover opening unit 150 to be described below.

The fixing unit 630 may further include the fixing detecting parts 637. The fixing detecting parts 637 may be provided in the housing 100 and may detect whether the fixing members 631 fix the first cleaner 200.

For example, the fixing detecting parts 637 may be coupled to the fixing part casing 632 and disposed at two opposite ends within a range in which the second power transmission member 634 rectilinearly moves.

Therefore, when the second power transmission member 634 moves to the predetermined fixing position FP1, the fixing detecting part 637 may detect that the first cleaner 200 is fixed. In addition, when the second power transmission member 634 moves to the predetermined releasing position FP2, the fixing detecting part 637 may detect that the first cleaner 200 is released.

The fixing detecting part 637 may include a contact sensor. For example, the fixing detecting part 637 may include a micro-switch.

The fixing unit 630 may include the fixing part link 638 linked to the second power transmission member 634 and the fixing member 631.

Specifically, the fixing part link 638 may be provided in the form of an elongated flat plate or frame. Circular holes are formed at two opposite sides in the major axis direction of the fixing part link 638, such that the second power transmission member pin 6343 and the link coupling portion 6313 may be penetratively coupled to the circular holes, respectively.

With this configuration, when the fixing part motor 633 operates and the second power transmission member 634 rectilinearly moves, the second power transmission member pin 6343 pushes (or pulls) the fixing part link 638 while rectilinearly moving, and the fixing part link 638 pushes (or pulls) the link coupling portion 6313. In this case, the sealing frame 6311 coupled to the fixing part link 638 rotates about the hinge portion 6312.

Therefore, the fixing part link 638 may convert the rectilinear movement of the second power transmission member 634 into a rotational motion of the sealing frame 6311.

A process of operating the fixing unit 630 according to the second embodiment will be described below.

When the first cleaner 200 is coupled to the coupling part 120, the fixing part motor 633 operates in the forward direction, and the first power transmission member 6332 rotates in conjunction with the fixing part motor 633. In this case, the second power transmission member 634 engaging with the first power transmission member 6332 rectilinearly moves.

In this case, the second power transmission member 634 may rectilinearly move along the fixing part casing 632, and the second power transmission member pin 6343 may rotate the fixing part link 638. Therefore, the second power transmission member 634 may rotate the fixing member 631 while rectilinearly moving upward in the gravitational direction. The fixing member 631 may move from the outside of the dust bin 220 toward the dust bin 220 and fix the dust bin 220.

Meanwhile, after a process of emptying the dust bin 220 is ended, the fixing part motor 633 operates in the reverse direction, and the first power transmission member 6332 rotates in conjunction with the fixing part motor 633.

In this case, the first power transmission member 6332 rotates, and the second power transmission member 634 rectilinearly moves downward in the gravitational direction.

When the second power transmission member 634 rectilinearly moves downward in the gravitational direction, the second power transmission member 634 pulls the fixing part link 638 downward, and the sealing frame 6311 releases the dust bin 220 while being pulled by the fixing part link 638.

Meanwhile, a fixing unit 630 according to a third embodiment of the present disclosure will be described below.

To avoid the repeated description, the description of the fixing unit 630 according to the second embodiment of the present disclosure may be applied, except for the components that have not been particularly described in the present embodiment, because the same structure and effect of the fixing unit 630 may be applied.

Unlike the second embodiment, the fixing part casing 632 according to the present embodiment may be coupled to the sidewall 124 and guide the rectilinear movement of the third power transmission member 635.

That is, the third power transmission member 635 may be rectilinearly movably accommodated in the casing main body 6321.

For example, the casing main body 6321 may be provided in the form of a polygonal basket capable of accommodating the third power transmission member 635 therein. In this case, the casing main body 6321 may be provided in the form of a basket opened at a side thereof in a direction opposite to the direction in which the sidewall 124 is disposed.

Further, the fixing part casing 632 may further include a shutter 6323 configured to open or close the fixing member entrance hole 127.

For example, the shutter 6323 may be provided in the form of a rectangular flat plate 6323*a*. One surface of the shutter 6323 may be disposed at the position at which one surface of the shutter 6323 may block the fixing member entrance hole 127 so as to be exposed to the outside of the cleaner station 100. Shutter pins 6323*c* having a cylindrical shape protrude from the other surface of the shutter 6323, and shutter links 639 may be rotatably coupled to the shutter pins 6323*c*.

The shutter 6323 may be slidably coupled to the casing main body 6321 and configured to block a part of the shutter hole 6322.

Specifically, a height of the shutter hole 6322 (a length in the direction perpendicular to the ground surface) may correspond to a height of the shutter 6323. A rail may be formed along a periphery of the shutter hole 6322 of the casing main body 6321, and the shutter 6323 may be fitted with the rail and slide. Further, a rail 6323*b* corresponding to the rail of the casing main body 6321 may be formed on the shutter 6323. Meanwhile, a length of the shutter hole 6322 in the horizontal direction (the direction parallel to the ground surface) is longer than a length of the shutter 6322 in the horizontal direction.

Therefore, when the shutter links 639 rotate, the shutter 6323 may rectilinearly and reciprocatingly move on the shutter hole 6322 and open or close the fixing member entrance hole 127.

In addition, the fixing part casing 632 may further include the casing cover 6324 coupled to the casing main body 6321 and having a guide hole 6324*a* for guiding the rectilinear movement of the third power transmission member 635.

Specifically, the casing cover 6324 may cover at least a part of an opened side of the casing main body 6321. In this case, the guide hole 6324*a* may be provided in the form of a long hole in the casing cover 6324, and a guide pin 6355 of the third power transmission member 635 may be movably inserted into and coupled to the guide hole 6324*a*.

For example, the guide hole 6324*a* may be formed in the direction perpendicular to the ground surface, and three guide holes 6324*a* may be formed on the same vertical line, but the present disclosure is not limited thereto. The arrangement of the guide holes 6324*a* and the number of guide holes 6324*a* may be changed depending on the arrangement of the guide pins 6355 and the number of guide pins 6355.

With this configuration, when the fixing part motor 633 operates, the third power transmission member 635 may rectilinearly move along the guide hole 6324*a* and transmit the power to the shutter link 639 to move the shutter 6323.

Meanwhile, in the present embodiment, the guide ribs 6344 and 6345 of the second power transmission member 634 may extend from the gear frame 6341 and be slidably coupled to the third power transmission member 635.

For example, the guide rib 6344 may protrude and extend from the gear frame 6341 toward two opposite sides in the direction parallel to the ground surface and be slidably inserted into and coupled to a guide rail 6351 of the third power transmission member 635.

With this configuration, when the fixing part motor 633 operates, the second power transmission member 634 rectilinearly moves along the guide rail 6351 of the third power transmission member 635, the second power transmission member pin 6343 may rotate the fixing part link 638.

Further, in the present embodiment, the second power transmission member 634 may further include a spring accommodation groove 6346.

The spring accommodation groove 6346 is formed in the gear frame 6341. The spring accommodation groove 6346 may be formed in the gear frame 6341 in the direction (the major axis direction) perpendicular to the ground surface so as to accommodate a spring 6359.

For example, the spring accommodation groove 6346 may be formed in a back surface of the gear frame 6341 opposite to the surface on which the second power transmission member pin 6343 is formed. In this case, the spring accommodation groove 6346 may be a groove elongated in the major axis direction of the gear frame 6341 (the direction perpendicular to the ground surface) so as to correspond to a shape of a frame portion 6357*b* of the support frame 6357 so that a support frame 6357 of the third power transmission member 635 may be accommodated in the spring accommodation groove 6346. In addition, the spring 6359 may be accommodated in the spring accommodation groove 6346, and a projection on which one end of the spring 6359 may be fixed and supported may be formed in the spring accommodation groove 6346.

With this configuration, the gear frame 6341 and the support frame 6357 may be elastically supported by the spring 6359. Therefore, when the fixing part motor 633 rotates in the forward direction (operates to surround the dust bin 220), the second power transmission member 634 may be elastically supported and prevented from rectilinearly moving until the third power transmission member 635 reaches a predetermined position. Further, when the fixing part motor 633 rotates in the reverse direction (operates to release the dust bin 220), the fixing part link 638 may be rotated by the weight of the fixing member 631, thereby preventing the second power transmission member 634 from moving upward in the gravitational direction.

Therefore, it is possible to prevent malfunction of the fixing unit 630.

Further, in the present embodiment, the second power transmission member 634 may further include the catching projection 6347.

The catching projection 6347 may be connected to the gear frame 6341 and the first guide rib 6344 and disposed at an upper side in the gravitational direction of the first guide rib 6344. The catching projection 6347 may be in contact with and supported by a rail stopper 6358 of the third power transmission member 635.

With this configuration, when the fixing part motor 633 rotates in the forward direction (operates to surround the dust bin 220), the third power transmission member 635 rectilinear moves upward, and the third power transmission member moves to a predetermined position, such that the rail stopper 6358 and the catching projection 6347 may come into contact with each other. Thereafter, the second power transmission member 634 having a lower side supported by the rail stopper 6358 may move upward together with the third power transmission member 635, and the first gear teeth 6342 may engage with the first power transmission member 6332 to transmit the power to the fixing part link 638.

The fixing unit 630 according to the second embodiment of the present disclosure may further include the third power transmission member 635.

The third power transmission member 635 may engage with the first power transmission member 6332, convert the rotational force of the fixing part motor 633 into the rectilinear movement, and guide the rectilinear movement of the second power transmission member 634. For example, the third power transmission member 635 may be a rack gear.

The third power transmission member 635 may include a guide rail 6351, second gear teeth 6352, a shutter operating wall 6353, a shutter operating pin 6354, the guide pin 6355, a pin cover 6356, the support frame 6357, the rail stopper 6358, and the spring 6359.

The guide rail 6351 may accommodate the second power transmission member 634 and guide the sliding of the second power transmission member 634.

Specifically, the guide rail 6351 may have a guide surface 6351*a* on which the second power transmission member 634 may slide. A first rail portion 6351*b* and a second rail portion 6351*c* may protrude and extend from two opposite ends of the guide surface 6351 in the horizontal direction (the direction parallel to the ground surface). In this case, the first rail portion 6351*b* and the second rail portion 6351*c* may respectively accommodate the first guide rib 6344 and the second guide rib 6345 of the second power transmission member 634.

Therefore, the second power transmission member 634 and the third power transmission member 635 may be fitted with each other and the sliding thereof may be guided.

Meanwhile, a length of the first rail portion 6351*b* may be shorter than a length of the second rail portion 6351*c*. The rail stopper 6358 is provided at the upper end in the gravitational direction of the first rail portion 6351*b* so as to be in contact with and supported by the catching projection 6347.

With this configuration, when the fixing part motor 633 rotates in the forward direction, the third power transmission member 635 may rectilinearly move by a predetermined distance and then rectilinearly move together with the second power transmission member 634.

The second gear teeth 6352 may protrude from the guide rail 6351 and engage with the first power transmission member 6332.

For example, the second gear teeth 6352 may be formed in an area corresponding to a predetermined length from a lower end in the gravitational direction of the second rail portion 6351*c* in the gravitational direction (the direction perpendicular to the ground surface).

In this case, a length along which the second gear teeth 6352 are formed may correspond to the distance of the rectilinear movement of the third power transmission member 634. Further, a length along which the second gear teeth 6352 is formed may be at least longer than a length along which the first gear teeth 6342 is formed.

With this configuration, when the fixing part motor 633 rotates in the forward direction and the first power transmission member 6332 rotates in conjunction with the rotation of the fixing part motor 633, the third power transmission member 635 engaging with the first power transmission member 6332 rectilinearly moves first. Further, after the third power transmission member 635 rectilinearly moves by a predetermined distance, the first power transmission member 6332 may engage with the first gear teeth 6342 and rectilinearly move the second power transmission member 634.

The shutter operating wall 6353 may be bent and extend from the guide rail 6351.

Specifically, the shutter operating wall 6353 may mean a kind of wall formed on the back surface of the guide surface 6351*a* and formed perpendicular to the guide rail 6351.

The shutter operating wall 6353 may have at least one shutter operating pin 6354. For example, two shutter operating pins 6354 each having a cylindrical shape may protrude from the shutter operating wall 6353 and be rotatably coupled to two shutter links 639, respectively.

Meanwhile, the shutter operating wall 6353 may have at least one guide pin 6355. For example, the guide pin 6355 having a cylindrical shape may protrude from the shutter operating wall 6353 and be coupled to be rectilinearly movable along the guide hole 6324*a* of the fixing part casing 632. The guide pin 6355 may be formed in the back surface of the shutter operating wall 6353 opposite to the surface on which the shutter operating pin 6354 is formed. In this case, the three guide pins 6355 may be formed at a predetermined interval in the gravitational direction, but the present disclosure is not limited thereto, and the number of three guide pins 6355 may be changed depending on the number of guide holes 6324*a*.

With this configuration, when the fixing part motor 633 operates and the first power transmission member 6332 rotates, the third power transmission member 635 may rectilinearly move along the guide hole 6324*a* of the fixing part casing 632, and the shutter operating pin 6354 may rotate the shutter link 639. Therefore, the third power transmission member 635 may move the shutter 6323 in the horizontal direction (the direction parallel to the ground surface) while rectilinearly moving upward in the gravitational direction, and the fixing member entrance hole 127, which is blocked by the shutter 6323, may be opened.

The pin cover 6356 may be coupled to the guide rail 6351 and prevent the guide pin 6355 from separating from the fixing part casing 632.

For example, the pin cover 6356 may be coupled to the shutter operating wall 6353 at a position at which the pin cover 6356 and the shutter operating wall 6353 face each other. The pin cover 6356 may be coupled to the guide pin 6355. In addition, a casing cover 6324 may be disposed between the shutter operating wall 6353 and the pin cover 6356.

The support frame 6357 may be coupled to the guide rail 6351 and disposed at an upper side in the gravitational direction of the second power transmission member 634.

For example, the support frame 6357 has a shape similar to a 'T' shape. A portion 6357*a* having a relatively large width may be fixedly coupled to an upper portion of the guide surface 6351*a*, and a portion 6357*b* having a relatively small width may be inserted and accommodated in the spring accommodation groove 6346 as the second power transmission member 634 moves. In this case, since the spring 6359 is disposed in the spring accommodation groove 6346, the support frame 6357 and the second power transmission member 634 may be elastically supported by the spring 6359.

With this configuration, the support frame 6357 may guide the rectilinear movement of the second power transmission member 634 and support the spring 6359.

Meanwhile, in the present embodiment, the fixing detecting parts 637 may be provided in the housing 100 and may detect whether the fixing members 631 fix the first cleaner 200.

For example, the fixing detecting part 637 may be coupled to the fixing part casing 632 and configured to come into contact with a contact portion 6356*a* extending from the pin cover 6356. For example, the fixing detecting part 637 may be disposed between a lower end and an upper end of a movement range of the contact portion 6356*a* corresponding to a range in which the contact portion 6356*a* is moved by the movement of the third power transmission member 635. That is, a first fixing detecting part 637*a* may be disposed at the upper end of the movement range of the contact portion 6356*a*, and the second fixing detecting part 637*b* may be disposed at the lower end of the movement range of the contact portion 6356*a*.

Therefore, when the contact portion 6356*a* moves to the predetermined fixing position FP1, the first fixing detecting part 637*a* may detect the contact with the contact portion 6356*a* and detect that the first cleaner 200 is fixed. In addition, when the contact portion 6356*a* moves to the predetermined releasing position FP2, the second fixing detecting part 637*b* may detect the contact with the contact portion 6356*a* and detect that the first cleaner 200 is released.

The fixing detecting part 637 may include a contact sensor. For example, the fixing detecting part 637 may include a micro-switch.

Meanwhile, in the present embodiment, the fixing unit 630 may further include the shutter links 639 linked to the third power transmission member 635 and the shutter 6323.

Specifically, the shutter link 639 may be provided in the form of an elongated flat plate or frame. Circular holes are formed at two opposite sides in the major axis direction of the shutter link 639, such that the shutter operating pin 6354 and the shutter pin 6323*c* may be penetratively coupled to the circular holes, respectively.

With this configuration, when the fixing part motor 633 operates and the third power transmission member 635 rectilinearly moves, the shutter operating pin 6354 pushes (or pulls) the shutter link 639 while rectilinearly moving, and the shutter link 639 pushes (or pulls) the shutter pin 6323*c*. In this case, the shutter 6323 connected to the shutter link 639 rectilinearly moves along the casing main body 6321.

Therefore, the shutter link 639 may convert the rectilinear movement of the third power transmission member 635 into the rectilinear movement of the shutter 6323.

A process of operating the fixing unit 630 according to the third embodiment will be described below.

In the state in which the first cleaner 200 is not coupled to the coupling part 110, the second power transmission member 634 is coupled to the third power transmission member 635, the second gear teeth 6352 engage with the first power transmission member 6332, and the first gear teeth 6342 do not engage with the first power transmission member 6332. In this case, the first gear teeth 6342 is disposed below the first power transmission member 6332 in the gravitational direction. In this case, the shutter 6323 blocks the fixing member entrance hole 127, and the sealing frame 6311 is positioned in the space surrounded by the sidewall 124 and the housing 110.

When the first cleaner 200 is coupled to the coupling part 120, the fixing part motor 633 operates in the forward direction, and the first power transmission member 6332 rotates in conjunction with the fixing part motor 633. In this case, the third power transmission member 635 engaging with the first power transmission member 6332 rectilinearly moves first.

In this case, the third power transmission member 635 may rectilinearly move along the guide hole 6324*a* of the fixing part casing 632, and the shutter operating pin 6354 may rotate the shutter link 639. Therefore, the third power transmission member 635 may move the shutter 6323 in the horizontal direction (the direction parallel to the ground surface) while rectilinearly moving upward in the gravitational direction, and the fixing member entrance hole 127, which is blocked by the shutter 6323, may be opened.

Then, after the third power transmission member 635 rectilinearly moves by a predetermined distance, the first power transmission member 6332 may engage with the first gear teeth 6342 and rectilinearly move the second power transmission member 634.

In this case, the second power transmission member 634 may rectilinearly move along the guide rail 6351 of the third power transmission member 635, and the second power transmission member pin 6343 may rotate the fixing part link 638. Therefore, the second power transmission member 634 may rotate the fixing member 631 while rectilinearly moving upward in the gravitational direction. The fixing member 631 may move from the outside of the dust bin 220 toward the dust bin 220 and fix the dust bin 220.

Meanwhile, after the process of emptying the dust bin 220 is ended, the fixing part motor 633 operates in the reverse direction, and the first power transmission member 6332 rotates in conjunction with the fixing part motor 633. In this case, both the first gear teeth 6342 and the second gear teeth 6352 engage with the first power transmission member 6332.

In this case, the first power transmission member 6332 rotates, and both the second power transmission member 634 and the third power transmission member 635 rectilinear move downward in the gravitational direction.

When the second power transmission member 634 rectilinearly moves downward in the gravitational direction, the second power transmission member 634 pulls the fixing part link 638 downward, and the sealing frame 6311 releases the dust bin 220 while being pulled by the fixing part link 638.

In addition, when the third power transmission member 635 rectilinearly moves downward in the gravitational direction, the third power transmission member 635 pulls the shutter link 639 downward, and the shutter 6323 is pulled by the shutter link 639, such that the fixing member entrance hole 127 is closed.

Meanwhile, when the first power transmission member 6332 rotates in the reverse direction, the first gear teeth 6342 disengages from the first power transmission member 6332 first, and the third power transmission member 635 further rectilinearly moves downward by a predetermined distance. That is, when the first power transmission member 6332 rotates in the reverse direction, the fixing member 631 returns to the initial position first, and the shutter 6323 closes the fixing member entrance hole 127.

Therefore, according to the present disclosure, the first cleaner 200 may automatically detect the coupled state of the first cleaner 200 and fix the dust bin 220 of the first cleaner at the time of coupling the first cleaner 200 to the cleaner station 100, which makes it possible to allow the user to seal the first cleaner 200 without applying a separate force.

In addition, the first cleaner 200 may automatically detect the coupled state of the first cleaner 200 and seal the first cleaner 200 at the time of coupling the first cleaner 200 to the cleaner station 100, which makes it possible to improve the efficiency in preventing dust from scattering.

In addition, the fixing unit 630 may stably fix the dust bin 220 by simultaneously pressing the two opposite sides of the dust bin 220 of the cleaner.

In addition, in the state in which the first cleaner 200 is not coupled, the fixing member 631 and the fixing member entrance hole 127 are blocked by the shutter 6323, such that the internal structure is invisible from the outside.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A cleaner station comprising:

a housing;

a dust collecting motor disposed in the housing and configured to generate a suction force for suctioning dust from a dust bin of a cleaner;

a dust collecting part disposed in the housing and configured to receive the dust from the dust bin;

a coupling part that is disposed in the housing and defines a coupling surface configured to couple to the cleaner; and a fixing unit configured to fix the cleaner based on the cleaner being coupled to the coupling part, wherein the fixing unit comprises:

a fixing part motor configured to generate rotational force, and a fixing member configured to, based on operation of the fixing part motor, move toward the dust bin from an outside of the dust bin, and wherein the fixing unit is configured to convert the rotational force of the fixing part motor into a linear motion to thereby move the fixing member toward the dust bin.

2. The cleaner station of claim 1, wherein the fixing unit further comprises:

a first power transmission member coupled to the fixing part motor and configured to rotate based on the rotational force of the fixing part motor; and a second power transmission member configured to linearly move based on rotation of the first power transmission member.

3. The cleaner station of claim 2, wherein the first power transmission member comprises:

a cam main body coupled to a shaft of the fixing part motor; and a connection rod inserted into and coupled to the second power transmission member, and wherein the connection rod protrudes from the cam main body and is spaced apart from a rotation axis of the cam main body.

4. The cleaner station of claim 3, wherein the fixing unit further comprises a fixing part casing that is coupled to the second power transmission member and configured to guide a linear movement of the second power transmission member, and wherein the second power transmission member comprises:

a cam coupling portion movably coupled to the cam main body; and a guide portion that extends from the cam coupling portion and is coupled to the fixing part casing.

5. The cleaner station of claim 4, wherein the fixing unit further comprises:

a link arm that connects the second power transmission member to the fixing member; and a connection pin connected to the link arm, wherein the guide portion comprises a guide portion main body that defines a pin coupling hole receiving the connection pin, and wherein an end of the connection pin is inserted into and coupled to the pin coupling hole.

6. The cleaner station of claim 2, wherein the fixing unit further comprises a fixing part casing coupled to the second power transmission member and configured to guide a linear movement of the second power transmission member, and wherein the fixing part casing comprises:

a casing main body that defines a cam accommodation hole that accommodates at least a part of the first power transmission member; and a guide rod that protrudes from the casing main body, the guide rod being inserted into and coupled to the second power transmission member.

7. The cleaner station of claim 6, wherein the fixing part casing further comprises:

a lower stopper that protrudes from the casing main body and defines a first level difference with respect to the casing main body, the lower stopper being disposed at a lower side of the second power transmission member in a gravitational direction;

an upper stopper that protrudes from the casing main body and defines a second level difference with respect to the casing main body, the upper stopper being disposed at an upper side of the second power transmission member in a direction opposite to the gravitational direction; and a guide rib that protrudes from the casing main body and connects the lower stopper and the upper stopper to each other.

8. The cleaner station of claim 2, wherein the fixing unit further comprises:

a link arm rotatably coupled to the fixing member and configured to move the fixing member based on a linear movement of the second power transmission member; and a connection pin connected to the link arm, and wherein the link arm comprises an arm main body, the arm main body having (i) a first coupling hole defined at a first end of the arm main body and coupled to the connection pin and (ii) a second coupling hole defined at a second end of the arm main body and coupled to the fixing member.

9. The cleaner station of claim 2, wherein the fixing unit further comprises a fixing part link connected to the second power transmission member and the fixing member.

10. The cleaner station of claim 9, wherein the second power transmission member comprises:

a gear frame that defines first gear teeth configured to engage with the first power transmission member; and a second power transmission member pin that protrudes from the gear frame and is rotatably coupled to the fixing part link.

11. The cleaner station of claim 10, wherein the gear frame defines a spring accommodation groove that accommodates a spring configured to extend in a gravitational direction.

12. The cleaner station of claim 9, wherein the fixing unit further comprises a third power transmission member configured to engage with the first power transmission member and to convert the rotational force of the fixing part motor into a linear movement of the second power transmission member, the third power transmission member being configured to guide the linear movement of the second power transmission member.

13. The cleaner station of claim 12, wherein the second power transmission member further comprises:

a gear frame that defines first gear teeth configured to engage with the first power transmission member; and a guide rib that extends from the gear frame and is coupled to the third power transmission member, and wherein the third power transmission member is configured to move along the guide rib.

14. The cleaner station of claim 12, wherein the third power transmission member comprises:

a guide rail that accommodates the second power transmission member and is configured to guide the linear movement of the second power transmission member; and second gear teeth that protrude from the guide rail and configured to engage with the first power transmission member.

15. The cleaner station of claim 12, wherein the fixing unit further comprises a support frame coupled to the third power transmission member and configured to guide the linear movement of the second power transmission member.

16. The cleaner station of claim 9, wherein the coupling part further comprises sidewalls disposed at opposite sides of the coupling surface and connected to the coupling surface, the sidewalls protruding relative to the coupling surface and defining a fixing member entrance hole configured to receive the fixing member, wherein the fixing unit further comprises a fixing part casing coupled to the sidewalls, and wherein the fixing member is rotatably coupled to the fixing part casing and configured to insert into and move out of the fixing member entrance hole.

17. The cleaner station of claim 16, wherein the fixing part casing comprises a shutter configured to open and close the fixing member entrance hole.

18. The cleaner station of claim 1, wherein the fixing member comprises:

a sealing frame configured to move toward the dust bin from the outside of the dust bin;

a hinge portion disposed at an end portion of the sealing frame and rotatably coupled to the housing; and a first pressing portion disposed at a sidewall of the coupling part and configured to move toward and away from the dust bin, the first pressing portion having a shape corresponding to the dust bin.

19. The cleaner station of claim 18, wherein the fixing member further comprises a second pressing portion connected to the first pressing portion, the second pressing portion having a shape corresponding to a battery housing of the cleaner.

20. The cleaner station of claim 18, wherein the fixing member further comprises a movable sealer that is disposed at a surface of the first pressing portion facing the dust bin and configured to contact the dust bin.

* * * * *